US007006776B2

(12) United States Patent
Matsuzaka et al.

(10) Patent No.: US 7,006,776 B2
(45) Date of Patent: Feb. 28, 2006

(54) ELECTROPHOTOGRAPHIC IMAGE FORMING APPARATUS HAVING OPENING AND CLOSING MEMBER FOR OPENING AND CLOSING AN OPENING THROUGH WHICH A PROCESS CARTRIDGE IS MOUNTED

(75) Inventors: Kenji Matsuzaka, Shizuoka-ken (JP); Shinya Noda, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 10/098,419

(22) Filed: Mar. 18, 2002

(65) Prior Publication Data

US 2002/0150404 A1 Oct. 17, 2002

(30) Foreign Application Priority Data

Mar. 16, 2001 (JP) ..... 2001-075867

(51) Int. Cl.
*G03G 15/00* (2006.01)

(52) U.S. Cl. ..... 399/111

(58) Field of Classification Search ..... 399/111, 399/109, 107

See application file for complete search history.

(56) References Cited

U.S. PATENT DOCUMENTS

| | | | | | |
|---|---|---|---|---|---|
| 5,041,872 | A | * | 8/1991 | Nukaya et al. | 399/107 |
| 5,115,272 | A | * | 5/1992 | Ohmori et al. | 399/110 |
| 5,749,027 | A | | 5/1998 | Ikemoto et al. | 399/113 |
| 5,878,310 | A | | 3/1999 | Noda et al. | 399/117 |
| 5,890,036 | A | | 3/1999 | Karakama et al. | 399/119 |
| 5,899,602 | A | | 5/1999 | Noda et al. | 399/111 |
| 5,920,752 | A | | 7/1999 | Karakama et al. | 399/111 |
| 5,930,562 | A | | 7/1999 | Noda et al. | 399/114 |
| 6,163,665 | A | * | 12/2000 | Watanabe et al. | 399/111 |
| 6,229,974 | B1 | | 5/2001 | Noda | 399/111 |
| 6,690,902 | B1 | * | 2/2004 | Noda et al. | 399/111 |
| 2004/0105699 | A1 | * | 6/2004 | Kubota | 399/111 |

FOREIGN PATENT DOCUMENTS

| | | |
|---|---|---|
| EP | 0 833 226 | 4/1998 |
| EP | 1 091 266 | 4/2001 |
| JP | 7-199568 | 8/1995 |
| JP | 10-274915 | 10/1998 |
| JP | 2000-75763 | 3/2000 |
| JP | 2000-132068 | 5/2000 |
| JP | 2000-347549 | 12/2000 |

* cited by examiner

*Primary Examiner*—Quana M. Grainger
(74) *Attorney, Agent, or Firm*—Fitzpatrick, Cella, Harper & Scinto

(57) ABSTRACT

A process cartridge detachably mountable to an image forming apparatus includes, a drum; a process device actable on the drum; a cartridge frame supporting these elements; a cartridge guide; and a cartridge coupling member. The apparatus includes an opening through which the cartridge is mounted and demounted; an opening and closing member for opening and closing the opening; a main assembly side guide for supporting the cartridge guide and movable in interrelation with the opening and closing member; a main assembly coupling member, for connection with the cartridge coupling member to transmit a driving force to the cartridge coupling member; and a driving connector for effecting connection and disconnection between the main assembly coupling member and the cartridge coupling member by moving the main assembly coupling member in a direction substantially perpendicular to a cartridge mounting direction in interrelation with opening and closing of the opening and closing member.

27 Claims, 56 Drawing Sheets

ELECTROPHOTOGRAPHIC IMAGE FORMING APPARATUS HAVING OPENING AND CLOSING MEMBER FOR OPENING AND CLOSING AN OPENING THROUGH WHICH A PROCESS CARTRIDGE IS MOUNTED

FIELD OF THE INVENTION AND RELATED ART

The present invention relates to an electrophotographic image forming apparatus to which a process cartridge is detachably mountable.

Here, the electrophotographic image forming apparatus forms an image on a recording material through an electrophotographic image formation type process. Examples of the electrophotographic image forming apparatus include an electrophotographic copying machine, an electrophotographic printer (laser beam printer, LED printer or the like), a facsimile machine, a word processor or a complex machine (multi function printer or the like) or the like.

The process cartridge integrally contains an electrophotographic photosensitive drum, and charging means, developing means or a cartridge, in the form of a unit or a cartridge, which is detachably mountable to a main assembly of an image forming apparatus. The process cartridge may contain the electrophotographic photosensitive drum, and at least one of charging means, developing means and cleaning means, in the form of a cartridge which is detachably mountable to the main assembly of the image forming apparatus. Or, it may be a cartridge containing integrally at least developing means and an electrophotographic photosensitive member, the cartridge being the detachably mountable to a main assembly of an image forming apparatus.

In an electrophotographic image forming apparatus using the electrophotographic image forming process, use has been made with the process cartridge type in which the process cartridge comprises as a unit the electrophotographic photosensitive member and process means actable on the electrophotographic photosensitive member, the unit being detachably mountable to the main assembly of the electrophotographic image forming apparatus. With the use of the process cartridge type, the maintenance operation can be carried out in effect by the users without the necessity of relying on serviceman, and therefore, the operability is improved. Therefore, the process cartridge type machines are widely used in the field of the image forming apparatus.

In order to provide satisfactory images by the electrophotographic image forming apparatus using such a process cartridge, it is necessary that the process cartridge is mounted at a predetermined position in the main assembly of the electrophotographic image forming apparatus to establish a correct connection of the interface portions such as various electrical contacts and a drive transmitting portion.

Referring first to FIG. 60 and FIG. 61, there are shown a process cartridge PC (FIG. 60) and a guide groove GL provided in the main assembly PR of the image forming apparatus (FIG. 61). FIG. 62 shows an image forming apparatus employing of such a process cartridge PC.

As shown in FIGS. 60–62, in the mounting and demounting of the process cartridge PC relative to the main assembly PR of the image forming apparatus, a positioning boss CB is provided on the axis of an electrophotographic photosensitive member in the form of a photosensitive drum provided in the process cartridge PC, and on the other hand, the main assembly PR of the image forming apparatus is provided with a guide groove GL for guiding and positioning the positioning boss CB of the process cartridge. When the user inserts the process cartridge PC along the mounting guide GL (cartridge mounting guide) to a predetermined position, an abutting portion P provided on the main assembly PR of the image forming apparatus is abutted to the process cartridge PC to prevent rotation about the positioning boss CB. The apparatus of such a structure has been put into practice.

In order to form an image of a satisfactory quality, it is necessary that the position of a process cartridge in the apparatus is correct. However, when users manually mount the process cartridge or when the process cartridge is pushed into the apparatus by closing the cover, the position of the process cartridge in the apparatus is not constant. Therefore, a structure has the proposed in which the process cartridge is moved to the correct position in interrelation with operation of a cover.

However, in apparatus in which the process cartridge is driven through a coupling, it has been not possible to move the process cartridge in interrelation with the operation of the process cartridge, because the engagement and disengagement of the coupling is carried out in interrelation with that cover and because it is necessary to move the cartridge after the disengagement of the coupling connection.

It is an alternative that the coupling control mechanism is interrelated with the cover, and the cartridge movement is controlled by another member, by which both can be set in the apparatus. However, the operability is not good because two actions are required.

The present invention is to provide a further development in such an apparatus and cartridge.

SUMMARY OF THE INVENTION

Accordingly, it is a principal object of the present invention to provide an electrophotographic image forming apparatus to which a process cartridge is detachably mountable wherein the mounting operationality of the process cartridge to the main assembly of the apparatus is improved.

It is another object of the present invention to provide an electrophotographic image forming apparatus to which a process cartridge can be automatically mounted to a mounting position in the main assembly of the apparatus.

It is a further object of the present invention to provide an electrophotographic image forming apparatus wherein a process cartridge can be mounted to a mounting position of the main assembly of the apparatus in interrelation with a closing operation of an opening and closing member.

It is a further object of the present invention to provide an electrophotographic image forming apparatus wherein the process cartridge can be automatically detached from the main assembly of the apparatus from the mounting position.

It is a further object of the present invention to provide an electrophotographic image forming apparatus to which a process cartridge is detachably mountable wherein the demounting operability of the process cartridge is improved.

It is a further object of the present invention to provide an electrophotographic image forming apparatus to which a process cartridge is detachably mountable, wherein mounting of the process cartridge, the driving connection of a coupling transmission system and the disconnection of the coupling transmission system can be carried out in interrelation with an opening and closing operation of an opening and closing member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS:

The preferred embodiments of the process cartridge mounting mechanism (process cartridge mounting-and-demounting mechanism) and the process cartridge according to the present invention will be described in conjunction with the accompanying drawings.

In the following descriptions, the longitudinal direction of a process cartridge is a direction in which a process cartridge is mounted to or demounted from the main assembly of the apparatus (substantially perpendicular thereto), which is substantially parallel with the surface of the recording material and crossing with (substantially perpendicular to) a feeding direction of the recording material. The "left" and "right" are left and right as the recording material is seen from the top in the feeding direction of the recording material. The top or upper surface or side of the process cartridge is the surface or side which takes an upper position when the process cartridge is mounted to the main assembly of the apparatus, and the surface or side which takes a lower position when the process cartridge is mounted to the main assembly of the apparatus, respectively.

Figure 1:
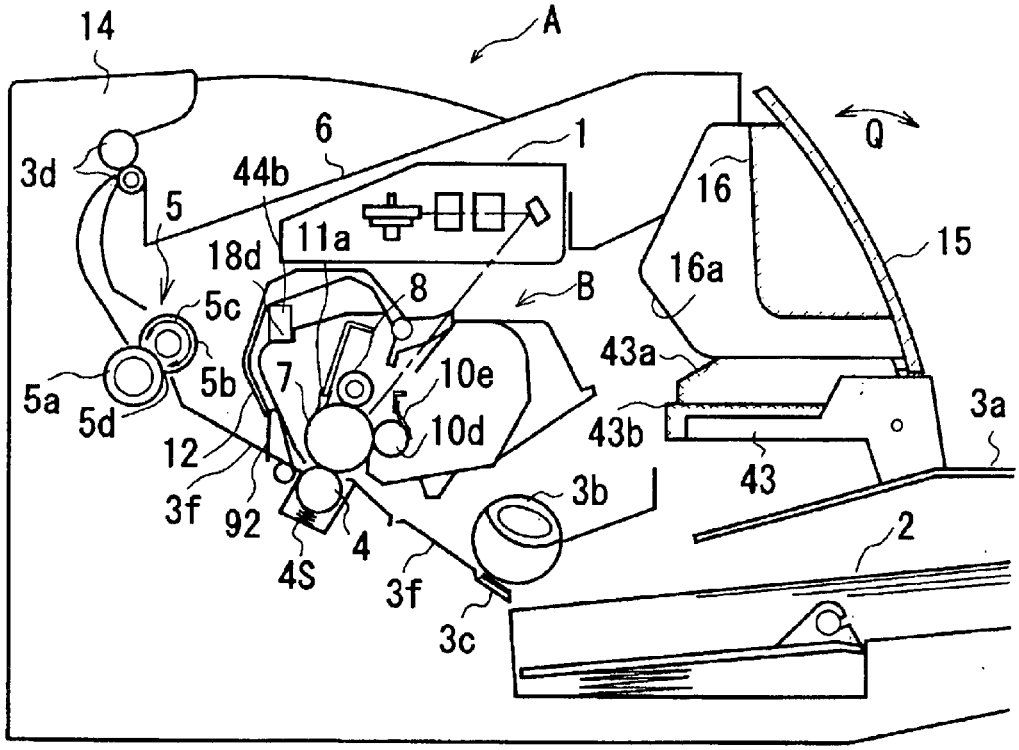
FIG. 1 is a sectional view of an electrophotographic image forming apparatus according to an embodiment of the present invention.
Figure 2:
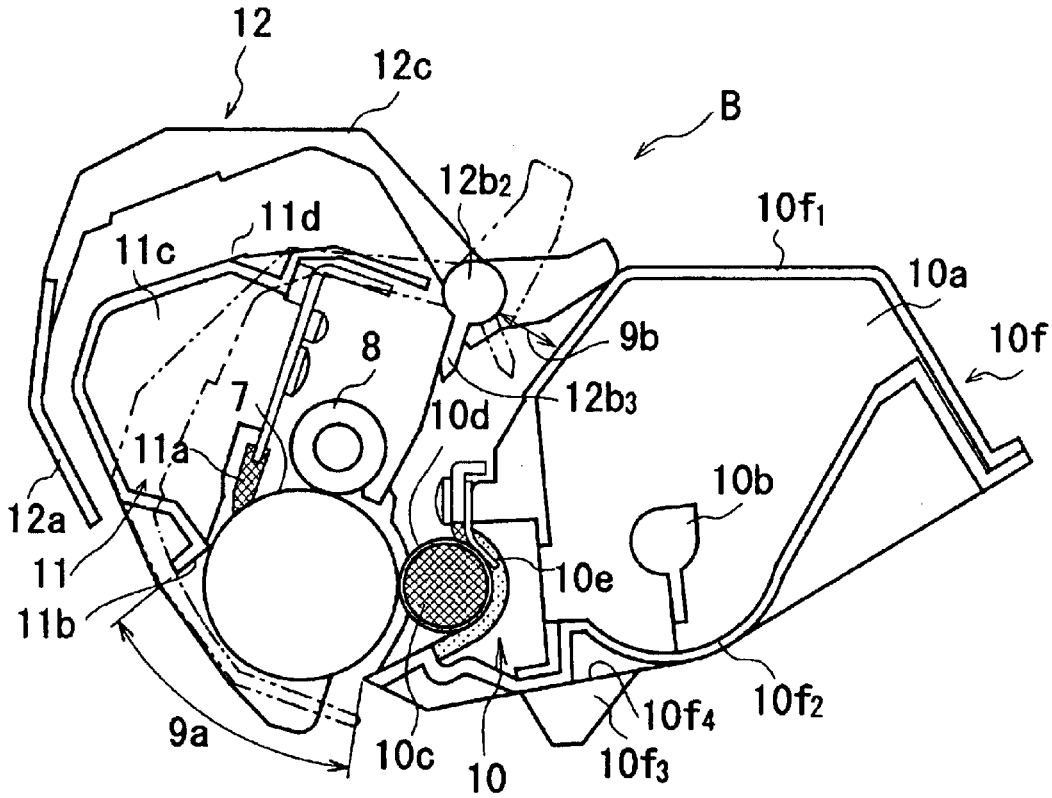
FIG. 2 is a sectional view of a process cartridge according to an embodiment of the present invention.

FIG. 1 illustrates an electrophotographic image forming apparatus according to an embodiment of the present invention. In this embodiment, a process cartridge shown in the FIG. 2 is detachably mountable to the electrophotographic image forming apparatus. FIG. 1 is a schematic illustration of the electrophotographic image forming apparatus when the process cartridge is mounted thereto, and FIG. 2 is a schematic illustration of the process cartridge.

A description will first be provided as to general arrangements of the process cartridge and electrophotographic image forming apparatus using it, and then as to the process cartridge mounting-and-demounting mechanism.

(General Arrangement)

In this embodiment, the electrophotographic image forming apparatus A (image forming apparatus) is in the form of a laser beam printer, and as shown in FIG. 1, it comprises an electrophotographic photosensitive member 7 in the form of a drum (photosensitive drum) as an image bearing member. The photosensitive drum 7 is electrically charged to a uniform potential by charging means in the form of a charging roller 8, and then is exposed to information light on the basis of image information supplied from optical means (optical system), by which an electrostatic latent image is formed on the photosensitive drum 7. The electrostatic latent image is visualized with a developer (toner) into a toner image.

In synchronism with the formation of the toner image, the recording material (recording paper, OHP sheet, textile or the like) is fed one by one from a cassette 3*a* to an image transfer station by a pick-up roller 3*b* and a press-contact member 3*c* press-contacted thereto. The toner image formed on the photosensitive drum 7 is transferred onto the recording material 2 at the transfer station by application of a transfer of voltage to the transfer roller 4. The recording material 2 now carrying the toner image transferred thereto is fed to fixing means 5 along a feeding guide 3*f*.

In this embodiment, the fixing means 5 comprises a driving roller 5*a* and a fixing rotatable member 5*d*.

The fixing rotatable member 5*d* comprises a cylindrical sheet containing therein a heater 5*b* and is rotatably supported by a supporting member 5*c*. The fixing rotatable member 5*d* applies heat and pressure to the recording material 2 passing therethrough to fix the transferred toner image. The recording material 2 now having the fixed toner image is fed by discharging rollers 3*d*, and is discharged to a discharging portion 6 through a reverse feeding path.

In this embodiment, the feeding means is constituted by the pick-up roller 3*b*, the press-contact member 3*c*, discharging rollers 3*d* and so on.

The main assembly of the image forming apparatus contains the feeding means, the fixing means 5 and driving means (unshown) for driving the process cartridge B. The driving means receives a driving force from a motor (unshown) (driving source) and functions to rotate rotatable members through a gear train (unshown).

The driving force to be supplied to the process cartridge B is transmitted to a large gear 83 (FIG. 11) through the gear train (unshown), and is transmitted to the process cartridge B by the large gear 83. The drive transmission between the large gear 83 and the process cartridge B is effected by coupling means disclosed in Japanese Patent No.02875203 and Japanese Laid-open Patent Application Hei. 10-240103, for example.

Figure 11:
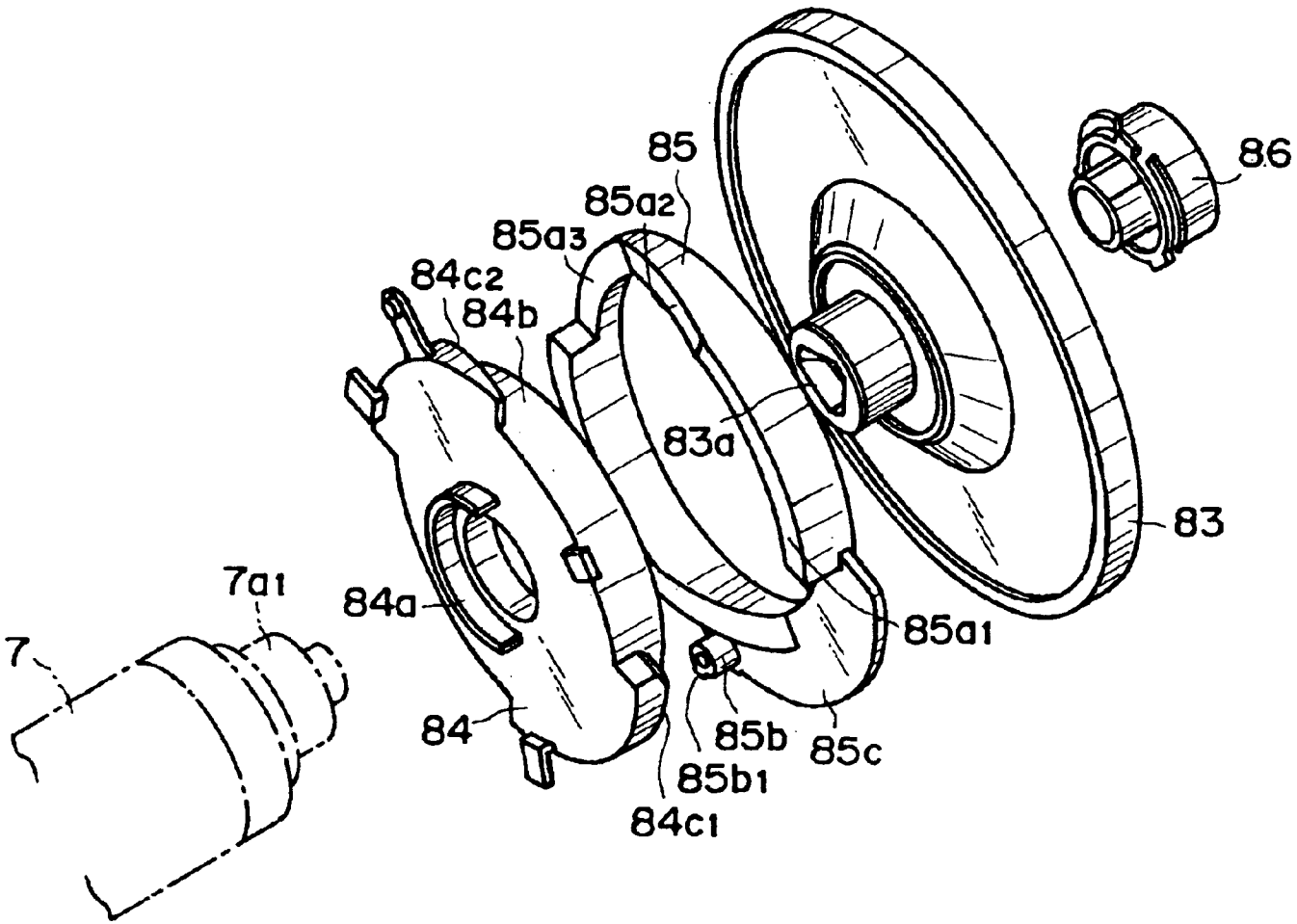
FIG. 11 is an exploded perspective view of a bearing and a large gear including a coupling cam.

As shown in FIG. 11, the coupling means comprises a large gear coupling 83*a* provided with a twisted recesses having a substantially regular triangle cross-section and having an axis coaxial with a rotational center axis of the large gear 83, and a twisted projection (driving force receiving portion 7*a*1, or drum coupling 7*a*1) having a substantially regular triangle cross-section. The detailed description will be made hereinafter. The drum coupling 7*a*1 is formed coaxially with the rotational central axis of the photosensitive drum 7 on a gear flange (unshown) fixed to one end portion of the photosensitive drum 7. The coupling means is brought into and out of the transmitting engagement by moving the large gear coupling 83*a* in the longitudinal direction of the photosensitive drum 7.

By the engagement of the coupling, the axes of the large gear 83 and the photosensitive drum 7 are aligned, and the driving force transmission is enabled, and with the transmission of the driving force, the longitudinal position of the photosensitive drum 7 is determined. Therefore, in this embodiment, there is provided driving connection means for engagement and disengagement of the coupling means.

(Process Cartridge)

The process cartridge B contains the electrophotographic photosensitive member and at least one process means. The process means includes charging means for electrically charging the electrophotographic photosensitive member, developing means for developing an electrostatic latent image formed on the electrophotographic photosensitive member, and cleaning means for removing the residual toner remaining on the photosensitive member. The process cartridge B according to this embodiment, as shown in FIG. 2, includes a rotatable photosensitive drum 7, which is an electrophotographic photosensitive member having a photosensitive layer. The surface of the photosensitive drum 7 is electrically charged to a uniform potential by application of a voltage to charging means in the form of a charging roller 8. The photosensitive drum 7 thus electrically charged is exposed to image information (light image) supplied from an optical system 1 through an exposure opening. By doing so, an electrostatic latent image is formed on the surface of the photosensitive drum 7. The electrostatic latent image is developed by developing means 10.

In the developing means 10, the toner is moved from a toner accommodating portion 10*a* to a developing roller 10*d* (rotatable developing member (developer carrying member)) by a rotatable feeding member 10*b* for feeding the toner. The developing roller 10*d* contains therein a stationary magnet 10*c*. By rotating the developing roller 10*d*, while keeping the magnet 10*c* stationary, and by regulating the thickness of a layer of the developer formed on the developing roller, a layer of the developer having a regulated thickness and having triboelectric charge is formed a on the developing roller 10*d*. The toner on the surface of the developing roller 10*d* is transferred onto the photosensitive drum 7 in accordance with the electrostatic latent image, by which a toner (visualized) image is formed on the photosensitive drum 7.

A transfer roller 4 is supplied with a voltage of a polarity opposite from the polarity of the toner image, by which the toner image is transferred onto the recording material 2. Thereafter, the residual toner remaining on the surface of the photosensitive drum 7 is removed by a cleaning blade 11*a* of the cleaning means. The removed toner is received by a receptor sheet 11*b*. The received the toner is collected in a removed toner accommodating portion 11*c*.

The process cartridge B comprises a cleaning frame 11*d* rotatably supporting the photosensitive drum 7 and supporting the cleaning means 11 and the charging roller 8, and a toner developing frame 10*f* supporting the developing means 10, the toner accommodating portion 10*a*.

The developing frame 10*f* is rotatably supported on the cleaning frame 11*d* so that the developing roller 10*d* of the developing means 10 may be opposed to the surface of the photosensitive drum 7 with a predetermined parallel gap.

At the opposite end portions of the developing roller 10*d*, there are provided spacers (unshown) for maintaining the predetermined gap between the developing roller 10*d* and the photosensitive drum 7.

Figure 3:
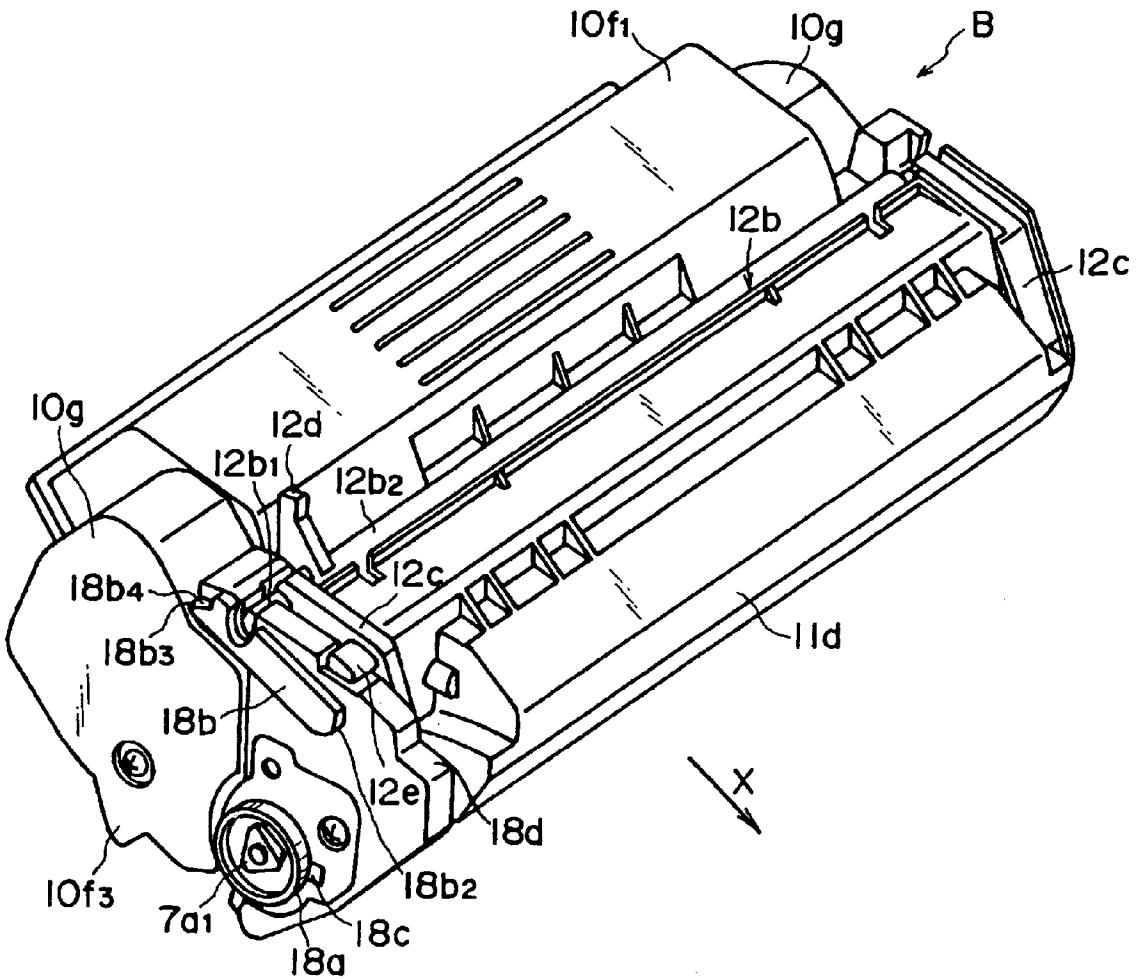
FIG. 3 is a perspective view of a process cartridge according to an embodiment of the present invention.

As shown in FIG. 3, at the sides of the toner developing device frame 10*f*, there are holder members 10*g*. Although not shown, it is provided with a hanging arm having a connecting portion for rotatably hanging the developing unit to the cleaning unit. In order to maintain the predetermined gap between the developing unit and the cleaning unit, a predetermined pressing force is applied.

The process cartridge B includes a toner developing device frame 10*f* constituted by a developing device frame 10*f*1 and a cap member 10*f*2 which are welded together, and a cleaning frame 11*d*, and these frames are coupled to constitute a cartridge frame CF.

Figure 4:
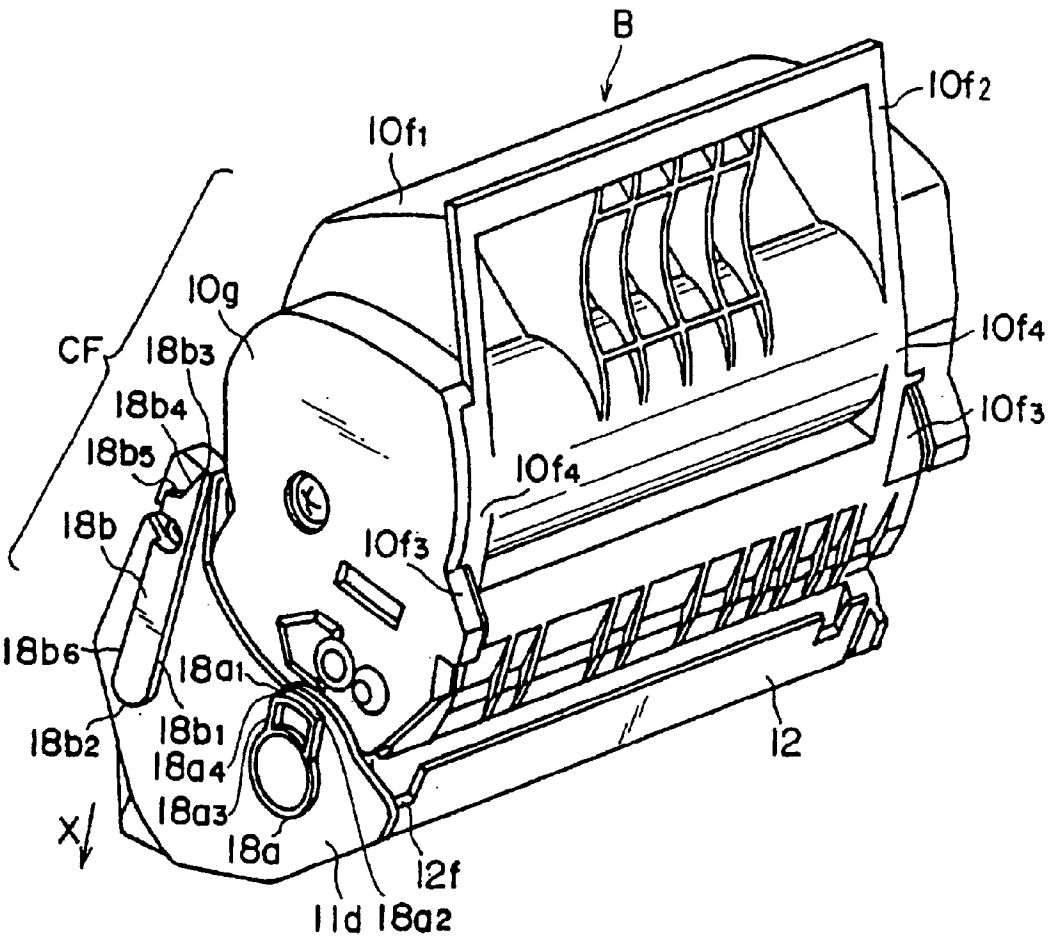
FIG. 4 is a perspective view of a process cartridge according to an embodiment of the present invention.

At the opposite longitudinal ends of the cartridge frame CF, as shown in FIGS. 3, 4, there are provided a first cartridge guide 18*b* and a second cartridge guide 18*b* (mounting guide 18*b*) for guiding mounting of the process cartridge in the direction indicated by an arrow X to the main assembly of the electrophotographic image forming apparatus (image forming apparatus) 14, and a first cartridge positioning portion 18*a* and a second cartridge positioning portion 18*a* (positioning guide 18*a*) which are coaxial with the rotational center of the photosensitive drum 7 and which are to be supported by positioning means (a first main assembly positioning portion and a second main assembly positioning portion) provided in the main assembly of the image forming apparatus.

The positioning guides 18*a* are in the form of cylindrical bosses, in which the driving side cylindrical boss has a larger diameter. The positioning guide 18*a* at the non-driving side, as shown in FIG. 4, is provided with a mounting assisting guide 18*a*1 extended rearwardly with respect to the process cartridge mounting direction. The trailing end of the mounting assisting guide 18*a*1 is formed into an outer surface 18*a*2 to be urged, and is in the form of an arcuation coaxial with the positioning guide 18*a*.

The mounting guide 18*b* to be guided has a portion to be supported 18*b*1 (lower or bottom surface 18*b*1) which is to be supported by a first main assembly side guide 41 and a second main assembly side guide 41 (movement guide 41) which will be described hereinafter, and a leading end portion or surface 18*b*2 of the mounting guide 18*b* which takes the leading end of the process cartridge in the inserting direction. The leading end portion 18*b*2 is arcuate in shape and one end connects to the lower surface 18*b*1 and the other end connects to the upper surface 18*b*6, wherein the former has a diameter larger than that of the latter. The bottom corner portion 18*b*3 of the lower surface 18*b*1 at the trailing end portion is formed into an inclined surface portion 18*b*4 inclined at an acute angle with respect to the lower surface 18*b*1. The trailing end portion of the upper surface includes an orthogonal or perpendicular surface 18*b*5 which is orthogonal with the upper surface 18*b*6.

The center of gravity of the process cartridge is between the leading end and the trailing end of the mounting guide 18*b*, so that when the process cartridge B is supported at the trailing end of the mounting guide 18*b*, the process cartridge takes a front side down position at all times.

In this embodiment, the mounting guides 18*b* are provided on the end surfaces of the cleaning frame 11*d* above the positioning guides 18*a*, and the leading end portions 18*b*2 of the mounting guides are positioned downstream of a vertical plane passing through the rotational center of the photosensitive drum 7 which is coaxial with the positioning guides 18*a*, with respect to the mounting direction. However, the mounting guides 18*b* may be provided on the toner developing device frame 10*f* or on the holder members log provided at end portions of the toner developing device frame 10*f*.

In this embodiment, the process cartridge B is provided with a drum shutter 12 which is rotatably supported on the cleaning frame 11*d*, and the drum shutter 12 is capable of simultaneously covering an exposure opening 9*b* and a transfer opening 9*a* to be opposed to the transfer roller 4.

A description will be provided as to the structure of the drum shutter 12.

As shown in FIGS. 1 and 2, the drum shutter 12 has a drum protecting portion 12*a* capable of covering the transfer opening 9*a* through which the photosensitive drum 7 and the transfer roller 4 are contacted to each other. The drum shutter 12 has a rotation shaft 12*b*, and is rotatably supported adjacent the exposure opening 9*b* of the cleaning frame lid. The rotation shaft 12*b* has sliding portions 12*b*1 for sliding contact with the cleaning frame 11*d* at the opposite end portions of the rotation shaft 12*b*, respectively, a large diameter portion 12*b*2 having a diameter larger than that of the sliding portions 12*b*1 at the portion corresponding to the exposure opening 9*b* between the sliding portions 12*b*1, and an exposure shutter portion 12*b*3 closing the exposure opening 9*b* when the drum shutter 12 is closed, the exposure shutter portion 12*b*3 being provided on the large diameter portion 12*b*2.

To the outside of the large diameter portion 12*b*2 of the rotation shaft 12*b*, one end of the connecting portion 12*c* disposed at each of left and right positions is connected, and the other end is connected to the end portion of the protecting portion 12*a*.

At the righthand side of the large diameter portion 12*b*2 of the rotation shaft 12*b*, there is disposed a cam portion 12*d* (FIG. 3) projected to the top side of the process cartridge. The righthand side connecting portion 12*c* of the drum shutter 12 is provided with a rib 12*c* projected outwardly. The rib 12*e* is received by a shutter guide 44*c* of a fixed guide 44 (FIG. 7), and functions to maintain the drum shutter 12 in the open state. In this embodiment, the above-described portions of the drum shutter 12 are integrally formed with resin material. As regards the positional relation of the righthand side mounting guide 18*b*, the rib 12*e* and the cam portion 12*d* in the longitudinal direction, the mounting guide 18*b*, the rib 12*e* and the cam portion 12*d* are arranged in the order named from the outside of the process cartridge in the longitudinal direction of the cartridge.

The drum shutter 12 is urged in the direction of closing the photosensitive drum 7 by a coil spring (unshown).

By doing so, when the process cartridge B is out of the main assembly 14 of the apparatus, the drum shutter 12 keeps the transfer opening 9*a* closed as indicated by the chain lines in FIG. 2. On the other hand, when the process cartridge is in the main assembly 14 and is in the operative position for performing an image forming operation, the drum shutter takes the open position to expose the photosensitive drum 7 to permit the photosensitive drum 7 and the transfer roller 4 to contact each other through the transfer opening 9*a* as shown by solid lines in FIG. 2.

(Process Cartridge Mounting-and-Demounting Mechanism)

Next, the mechanism for mounting or dismounting the process cartridge B, into or from, the image forming apparatus main assembly 14 will be described.

The process cartridge mounting/dismounting mechanism comprises:

(1) A pair of moving guides 41 which move between the optical system 1 and for conveying means while holding the process cartridge B;

(2) A pair of cam plates 50, and a pair of inner plates 40 having guide rails 40*a* and 40*b*, for moving the moving guides 41, during the front half of the process for opening an opening/closing cover 15 (which hereinafter will be referred to as opening/closing cover 15) and the latter half of the process for closing the opening/closing cover 15;

(3) A pair of connecting plates 51 for transmitting the rotational movement of the opening/closing cover 15 to the pair of cam plates 50, one for one;

(4) A pair of pusher arms 52 for holding the process cartridge B to the process cartridge mounting place S (which hereinafter will be referred to as the "image formation enabled position" or "image formation location") after the movement of the process cartridge B; and (5) Drum shutter opening/closing means for opening or closing the drum shutter 12 of the process cartridge B.

The process cartridge mounting/dismounting mechanism in this embodiment further comprises:

(6) A connecting means for coupling or uncoupling the coupling means which transmits the driving force, from the right side of the process cartridge B in terms of its lengthwise direction, during the front half of the process for opening the opening/closing cover 15 and the latter half of the process for closing the opening/closing cover 15; and (7) An interlocking switch 54 which detects the completion of the closing of the opening/closing cover 15, and allows electrical current to flow to enable the image forming apparatus to carry out an image forming operation.

In the process for closing the opening/closing cover 15, first, the process cartridge B is conveyed by the movement of the moving guide 41 as a cartridge mounting member, and then, the coupling means is enabled to be coupled, by the connecting means, while moving the pusher arm 52. Thereafter, the interlocking switch 54 is operated. In the process for opening the opening/closing cover 15, first, the interlocking switch 54 is operated, and then, the connecting means and pusher arm 52 are disengaged, and lastly, the moving guide 41 is moved. In the following description of the process cartridge mounting/dismounting mechanism, first, the configuration of the various components of the mechanism are described, and then, the method for assembling the various components, and the method for mounting the process cartridge B into the image forming apparatus, will be described. Lastly, the movement of the process cartridge mounting/dismounting mechanism will be described following the rotational movement of the opening/closing cover 15.

(Description of Structural Components)

(Moving Guide and First and Second Guides, on Main Assembly Side)

Figure 5:
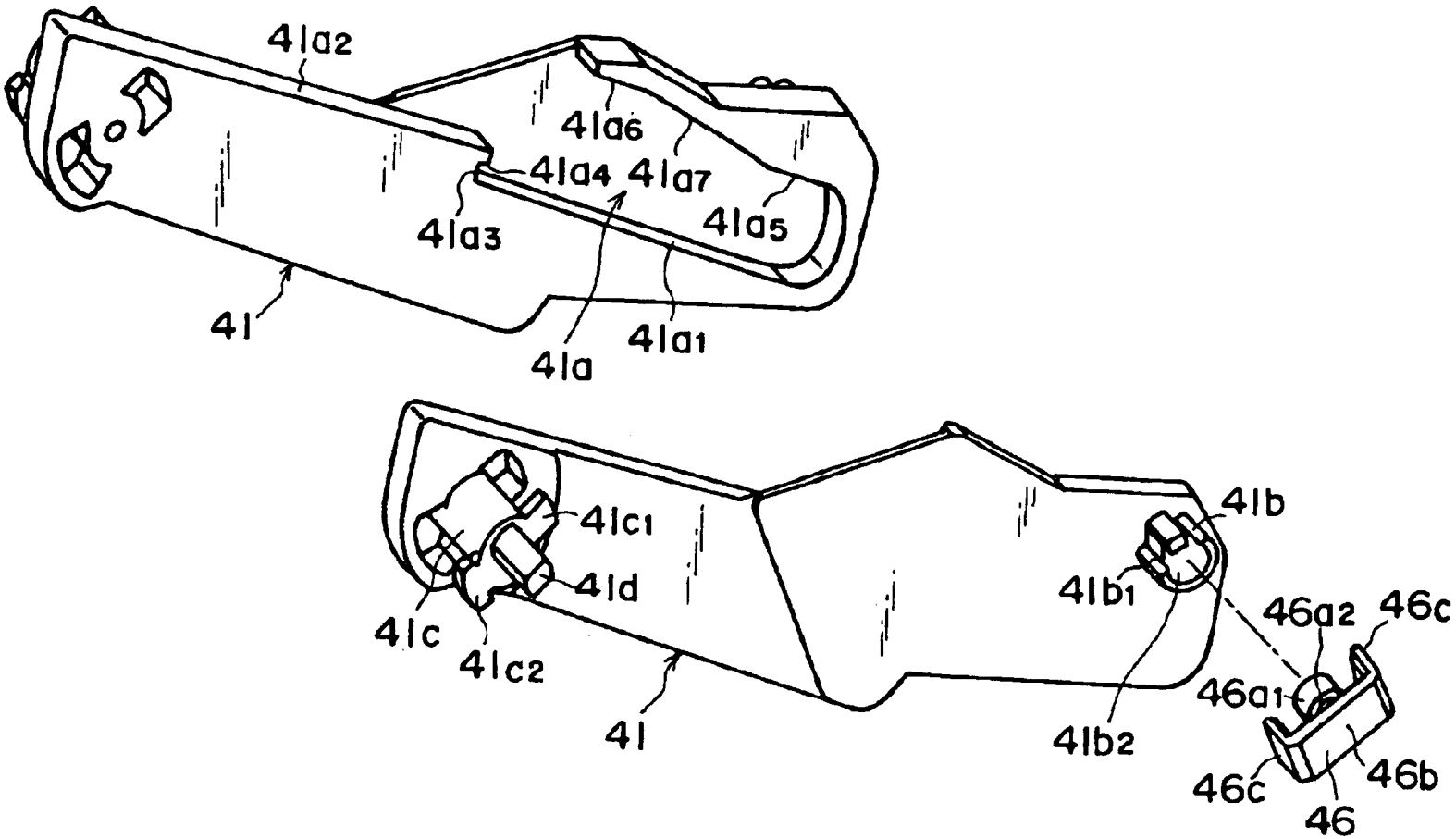
FIG. 5 is perspective views of a movement guide and a guide stopper.

The pair of moving guides 41 are attached to the left and right inner plates 40, one for one, being approximately symmetrically positioned with respect to the plane which divides the apparatus main assembly into the left and right halves in terms of the process cartridge mounting direction. Referring to FIG. 5, each moving guide 41 is provided with a guiding groove 41*a* as a guiding portion, which is in the surface facing the process cartridge B, and in which the mounting guide 18*b* of the process cartridge B engages. Each moving guide 41 is also provided with first and second bosses 41*b* and 41*c*, which are for controlling the attitude of the process cartridge B within the apparatus main assembly, and are on the surface opposite to the surface in which the guiding groove 41*a* is located. The first and second bosses 41*b* and 41*c* are disposed on the downstream and upstream sides, respectively, of the guiding groove 41*a*, in terms of the direction X in which the process cartridge B is mounted into the apparatus main assembly.

The first boss 41*b* is provided with a through hole 41*b*2, which is coaxial with the circumferential surface of the boss 41*b*. It is also provided with a snap fit claw 41*b*1, the end portion of which projects inward in terms of the radius direction of the through hole. The second boss 41*c* is provided with claws 41*c*1 and 41*c*2, which are on the end portion of the boss 41*c* and project outward in terms of the radius direction of the boss 41*c*. These claws 41*c*1 and 41*c*2 are extended so that the direction in which they extend aligns with the line connecting the rotational center of the second boss 41*c* and the rotational center of the cam plate, which will be described later, after the process cartridge is moved by the process cartridge mounting/dismounting mechanism to the second position at which the process cartridge B is capable of carrying out an image forming operation.

The guiding groove 41*a* has two sections, that is, downstream and upstream sections in terms of the process cartridge insertion direction, and the downstream section is slightly recessed from the upstream section, with the presence of a step between the two sections. The surface 41*a*1 of the downstream section of the guiding groove 41*a* is the retaining surface on which the mounting guide 18*b* of the process cartridge B rests while the moving guide 41 moves within the image forming apparatus, and the surface 41*a*2 of the upstream section, which is higher than the surface 41*a*1 of the downstream section, is a guiding surface which guides the process cartridge B when the process cartridge B is inserted into, or pulled out of, the apparatus main assembly. The retaining surface 41*a*1 and guiding surface 41*a*2 are downwardly inclined in terms of the process cartridge insertion direction, assuring that as a user inserts the process cartridge B into the image forming apparatus main assembly 14, the process cartridge B is guided into the retaining surface 41*a*1.

Figure 6:
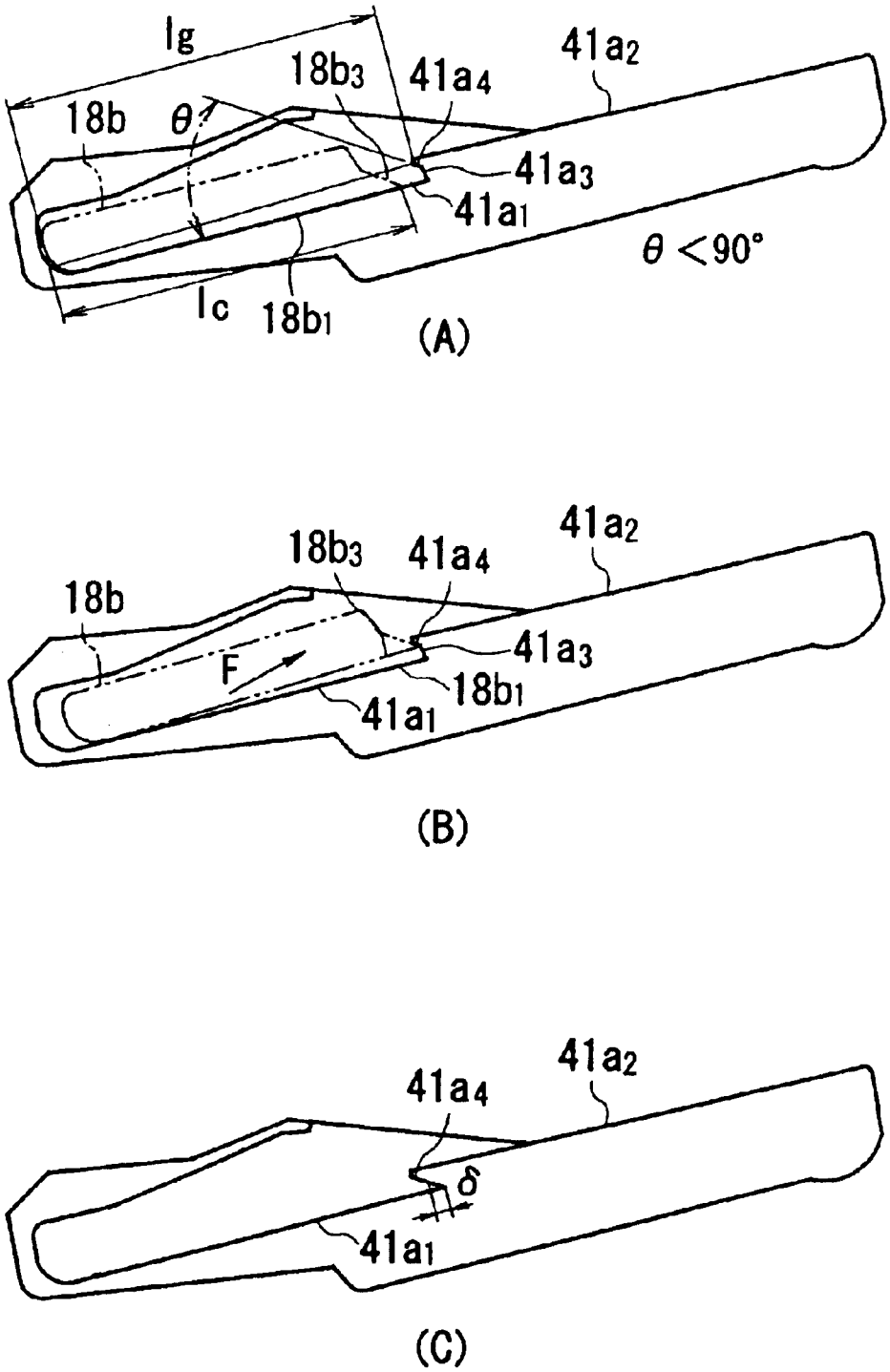
FIG. 6 is an illustration of a relationship between the movement guide and the mounting guide ((A), (B) and (C)).

Referring to FIG. 6, the step portion between the retaining surface 41*a*1 and guiding surface 41*a*2 is given a function of pushing the trailing end 18*b*3 of the mounting guide 18*b* of the process cartridge B to assure that the process cartridge B is conveyed to a predetermined location, in spite of the conveyance load, to which the process cartridge B supported by the retaining surface 41*a*1 is subjected during the movement of the moving guide 41. The stepped portion has an inclined portion 41*a*4, the theoretical extension of which forms an acute angle relative to the retaining surface 41*a*1, and a perpendicular surface 41*a*3, which is between the inclined portion 41*a*4 and retaining surface 41*a*1 and is approximately perpendicular to the retaining surface 41*a*1. The inclined portion 41*a*4 prevents the mounting guide 18*b*, supported by the retaining surface 41*a*1, from being lifted from the retaining surface 41*a*1 by the resistance of the transfer roller 4, which acts in the direction to lift the process cartridge B (FIG. 6(B)).

Referring to FIG. 6(A), in order to guide the mounting guide 18*b* of the process cartridge B from the guiding surface 41*a*2 onto the retaining surface 41*a*1, the distance 1 g from the corner of the leading end of the retaining surface 41*a*1 in terms of the process cartridge insertion direction, to the intersection between the inclined portion 41*a*4 and the guiding surface 41*a*2, and the length 1*c* of the bottom surface 18*b*1 of the mounting guide 18*b* in terms of the process cartridge inserting direction, must satisfy the following inequality:

$$1\ g > 1\ c.$$

In other words, the length of the retaining surface 41*a*1 is longer than the bottom surface 18*b*1 of the mounting guide 18*b*. Referring to FIG. 6(C), if the guiding surface 41*a*2 and retaining surface 41*a*1 are connected by the inclined surface 41*a*4 alone, the retaining surface 41*a*1 will be longer by a length of δ, being unnecessarily longer than the bottom surface 18*b*1 of the mounting guide 18*b*. In such a case, the distance by which the moving guide 41 and process cartridge B slide relative to each other as the process cartridge B is subjected to the conveyance load, will be excessively long. Thus, in this embodiment, the length of the retaining surface 41*a*1 is adjusted, being reduced in length, by the addition of the perpendicular surface 41*a*3, so that the trailing end of the mounting guide 18*b* can be more quickly pushed as the process cartridge B is subjected to the conveyance resistance.

The downwardly facing surface of the top wall of the guiding groove 41*a* is approximately parallel to the retaining surface 41*a*1. It has top surfaces 41*a*5 and 41*a*6, and a gently inclined top surface 41*a*7 which connects the top surfaces 41*a*5 and 41*a*6. The top surfaces 41*a*5 and 41*a*6 are positioned so that their distance from the retaining surface 41*a*1 and guiding surface 41*a*2, in terms of the direction perpendicular to the surfaces of the retaining surface 41*a*1 and guiding surface 41*a*2, respectively, becomes slightly greater than the thickness of the mounting guide 18*b* of the process cartridge B, in terms of the direction perpendicular to the lengthwise direction of the mounting guide 18*b*.

As for the configurations of the pair of moving guides 41, which have been described up to this point, the left and right moving guides are symmetrically positioned relative to each other, with respect to the vertical plane which divides the process cartridge B into the left and right halves. However, the right moving guide is provided with a means for transmitting a driving force to the process cartridge B, and therefore, the second boss 41*c* of the right moving guide is provided with a timing boss 41*d*, which extends beyond the claws 41*c*1 and 41*c*2 in the axial direction of the second boss 41*c*.

Next, a cartridge conveying means, more specifically, the guide rails, a cam plate, and a connecting plate, which make up the moving guide moving means, will be described. The structure of the cartridge conveying means (moving guide moving means) does not need to be limited to the one which will be described next; it is optional.

(Guide Rails of Inner Plate)

Figure 7:
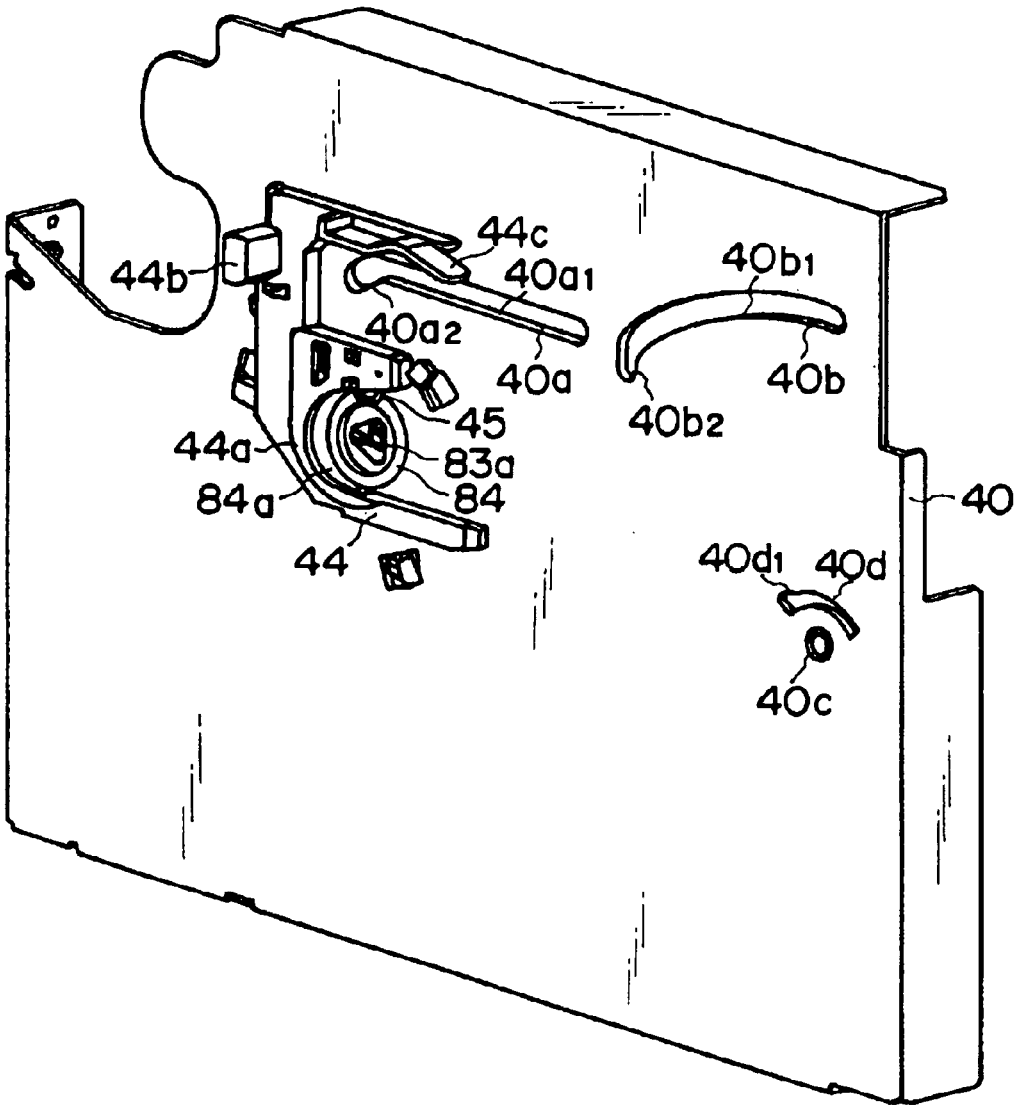
FIG. 7 is a perspective view of a fixed guide and an inner bearing provided on a right hand inner plate.

FIG. 7 shows the right inner plate 40 of the image forming apparatus main assembly 14. The right inner plate 40 is provided with a pair of guide rails 40*a* and 40*b*, as the cartridge conveying means (means for holding the cartridge mounting member), with which the bosses 41*b* and 41*c* slidably engage, respectively.

The widths (dimension in terms of the direction perpendicular to the direction in which the guides rails extend) of the guide rails 40*a* and 40*b* are equal to, or slightly greater than, the diameters of the bosses 41*b* and 41*c*, respectively, allowing the moving guide 41 to easily slide. In this embodiment, the inner plate 40 is formed of an approximately 1 mm thick metallic plate., and the guide rails 40*a* and 40*b* are holes, which have been formed by burring, and the lips of which protrude outward of the image forming apparatus. The reason for using burring as the method for forming the guide rails 40*a* and 40*b* is as follows. That is, if the guide rails 40*a* and 40*b* are formed simply by punching, the surfaces of the guide rails 40*a* and 40*b*, across which the bosses 41*b* and 41*c* of the moving guide 41 slide, respectively, will be rough, and also will be only as wide as the thickness of the metallic plate, increasing the contact pressure which acts on the bosses 41*b* and 41*c*. Thus, as the moving guide 41 repeatedly slides on the guide rails, the bosses 41*b* and 41*c* will be shaved across the areas in contact with the edges of the guide rails 40*a* and 40*b*, respectively, which sometimes will result in the disengagement of the moving guide 41 from its predetermined position in the apparatus main assembly. This is the reason burring is used instead of simple punching. In other words, burring is used to create the guide rails 40*a* and 40*b*, which are smoother and wider, across the surfaces across which the bosses 41*b* and 41*c* slide, in order to prevent the bosses 41*b* and 41*c* from being prematurely shaved by the guide rails 40*a* and 40*b*, respectively. In other words, the usage of burring as the method for forming the guide rails 40*a* and 40*b* is a countermeasure for the premature shaving of the bosses 41*b* and 41*c* by the guide rails 40*a* and 40*b*.

With the provision of the pair of guide rails 40*a* and 40*b*, and the pair of bosses 41*b* and 41*c* of the moving guide 41, the moving guide 41 is allowed to move between the optical system 1, and the conveyance path for the recording medium 2.

The first guide rail 40*a*, in which the first boss 41*b* engages, has a nearly horizontal portion 40*a*1, which is on the opening/closing cover 15 side, and an inclined portion 40*a*2, which is located at the deeper end of the guide rail 40*a*, and is inclined downward in terms of the process cartridge insertion direction. The two portions 40*a*1 and 40*a*2 are connected by a smoothly curved portion. The second guide rail 40*b*, in which the second boss 41*c* engages, has an arcuate portion 40*b*1, which bulges upward, and a vertical straight portion 40*b*2, which is located on the first guide rail 40*a* side. The two portions 40*b*1 and 40*b*2 are connected by a smoothly curved portion. Further, the inner plate 40 is provided with a hole 40*c*, in which the rotational shaft 50*a* of the cam plate 50, which will be described later, is borne. The axial line of the hole 40*c* coincides with the center of the curvature of the arcuate portion 40*b*1. The inner plate 40 is also provided with an arcuate hole 40*d*, which is located near the hole 40*c*, and the center of the curvature of which coincides with the axial line of the hole 40*c*.

In this embodiment, the hole 40*c* is also formed by burring. The arcuate hole 40*d* is provided with an assembly facilitation portion 40*d*1, which is the deeper end portion of the arcuate hole 40*d* in terms of the direction in which the opening/closing cover is closed, and is slightly wider in terms of the radius direction of its curvature. This assembly facilitation portion 40*d*1 is where the assembly facilitation claw 50*e* of the cam plate 50 (FIG. 8) is put through when the cam plate 50 is attached to the inner plate 40. After the assembly facilitation claw 50*e* is put through the assembly facilitation portion 40*d*1 of the arcuate hole 40*d*, the cam 50 is rotated in the direction in which the opening/closing cover is opened. As the cam 50 is rotated, the back surface of the assembly facilitation claw 50*e* comes into contact with the upper edge of the arcuate hole 40*d*, preventing the cam plate 50 from disengaging from the inner plate 40 in terms of the axial direction of the rotational shaft 50*a*.

(Cam Plate)

To the outward surface of the inner plate 40, that is, the surface opposite to where the moving guide 41 is mounted, the cam plate 50 is attached, which is provided with a rotational shaft 50*a*, the rotational axis of which coincides with the center of the curvature of the arcuate portion 40*b*1 of the second guide rail 40*b*.

Figure 8:
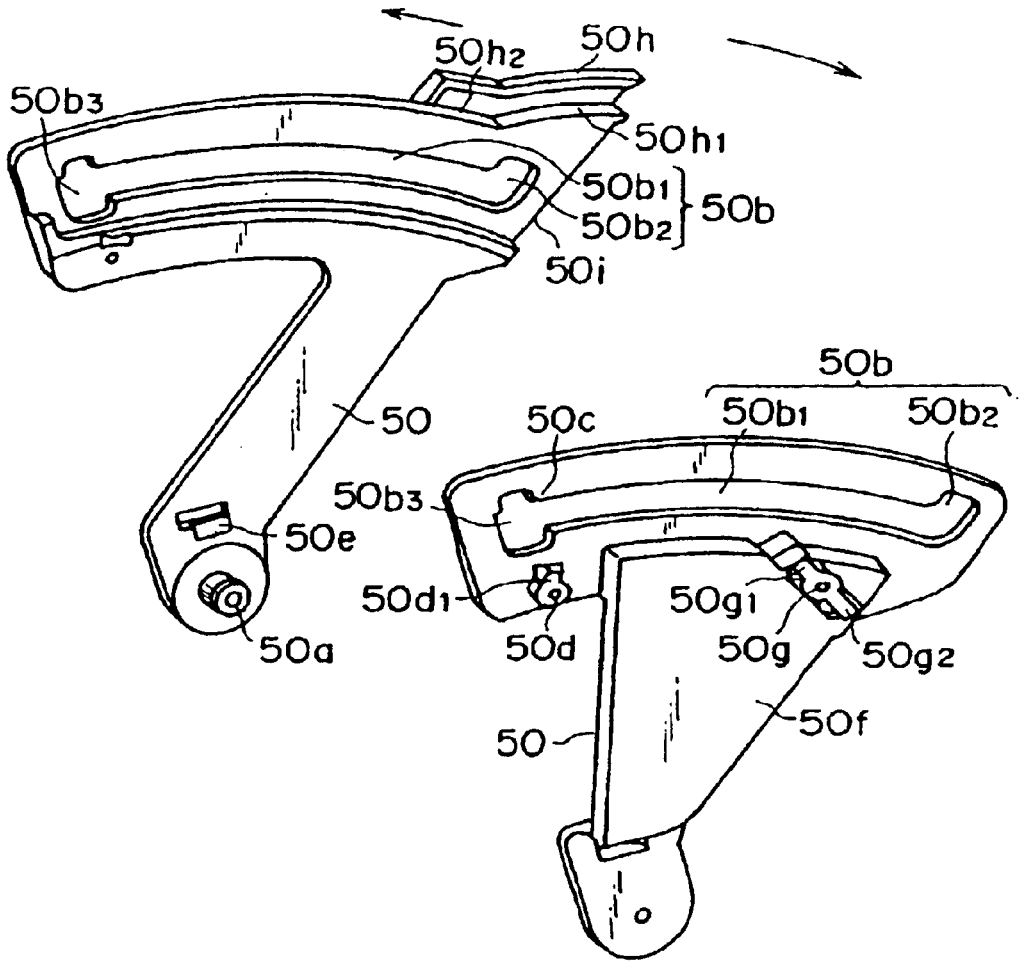
FIG. 8 is a perspective view of a cam plate.
Figure 9:
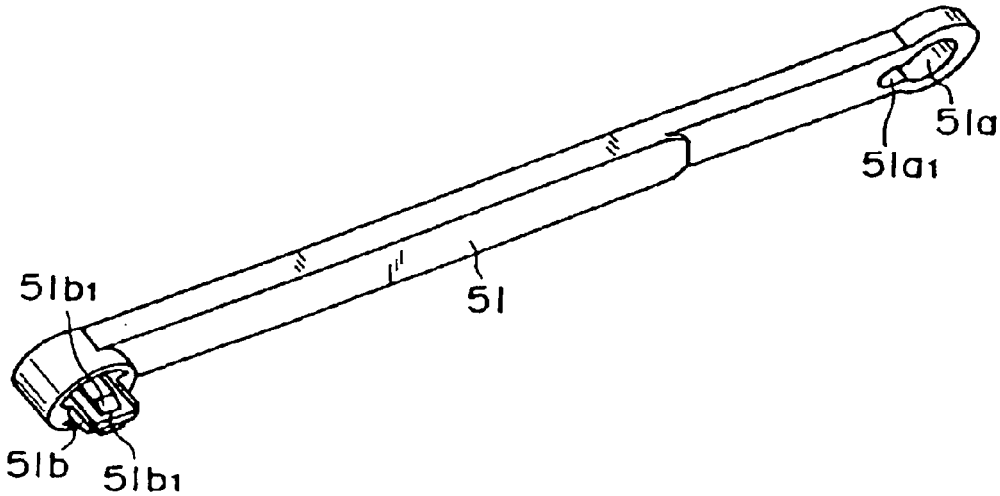
FIG. 9 is a perspective view of a connection plate.

Referring to FIG. 8, the cam plate 50 is provided with a cam hole 50*b*, which has an arcuate portion 50*b*1 (which hereinafter may be referred to as arcuate hole), and a straight portion 50*b*2 (which hereinafter may be referred to as a straight groove hole). The center of the curvature of the arcuate portion 50*b*1 of the cam hole 50*b* coincides with the axial line of the rotational shaft 50*a*. The straight portion (straight groove hole) 50*b*2 of the cam hole 50*b* is continuous from the inward end of the arcuate portion 50*b*1 of the cam hole 50*b*, in terms of the direction in which the opening/closing cover 15 is closed, and extends outward in terms of the radius direction of the curvature the cam hole 50*b*.

Into this cam hole 50*b*, the second boss 41*c* of the moving guide 41 engages after being put through the second guide rail 40*b* of the inner plate 40. The radius of the arcuate portion 50*b*1 of the cam hole 50*b* is smaller than that of the arcuate portion 40*b*1 of the second guide rail 40*b*, and is nearly equal to the distance between the bottom end of the straight portion 40*b*2 of the second guide rail 40*b* and the hole 40*c*. The distance between the tip of the straight portion (straight groove hole) 50*b*2 of the cam hole 50*b* and the rotational shaft 50*a* is slightly greater than the radius of the arcuate portion 40*b*1 of the second guide rail 40*b*. The widths of the arcuate portion 50*b*1 of the cam hole 50*b* and straight groove hole 50*b* are slightly greater than the diameter of the second boss 41*c* of the moving guide 41.

At the leading end of the arcuate portion 50*b*1 of the cam hole 50*b*, in terms of the direction in which the opening/closing cover 15 is opened, an assembly facilitation portion 50*b*3 is provided, through which the claws 41*c*1 and 41*c*2 on the tip of the second boss 41*c* of the moving guide 41 are put during the apparatus assembly. The assembly facilitation portion 50*b*3 is shaped so that it extends from the end of the arcuate portion 50*b*1, both outward and inward of the cam hole 50*b*, in terms of the radius direction of the arcuate portion 50*b*1 of the cam hole 50*b*. One or both of these two extending portions of the assembly facilitation portion 50*b*3 are rendered narrower than the diameter of the second boss 41*c* of the moving guide 41, in order to prevent the second boss 41*c* of the moving guide 41 from entering the outward portion of the assembly facilitation portion 50*b*3, with respect to the arcuate portion 50*b*1, in terms of the radius direction of the cam hole 50*b*, during the apparatus assembly. Further, the cam plate 50 is provided with a temporarily holding rib 50*c*, which is on the surface opposite to the surface facing the inner plate 40, and in the adjacencies of the upstream end of the assembly facilitation portion 50*b*3 in terms of the direction in which the opening/closing cover 15 is closed.

The guide rails 40*a* and 40*b* of the inner plate 40 are such holes that have been formed by burring, and their lips slightly protrude toward the cam plate 50. Therefore, in order to accommodate the guide rails 40*a* and 40*b*, the cam plate 50 is tiered around the cam hole 50*b* by a height equal to the distance by which the lips of the guide rails 40*a* and 40*b* protrude toward the cam plate 50. The aforementioned temporary positioning rib 50*c* is located above this tiered portion of the cam plate 50, so that as the claw 41*c*1 of the moving guide 41 goes over this temporary positioning rib 50*c* during the apparatus assembly, the cam plate 50 is flexed by this tiered portion.

The cam plate 50 is also provided with a connecting boss 50*d*, which is in the adjacencies of the assembly facilitation portion 50*b*3, that is, the trailing end of the cam hole 50*b*, on the surface opposite to the surface on which the rotational shaft 50*a* is present. The end portion of the connecting boss 50*d* constitutes a claw 50*d*1. There is the aforementioned assembly facilitation claw 50*e* near the rotational shaft 50*a*. The assembly facilitation claw 50*e* is fitted into the arcuate hole 40*d* of the inner plate 40 to prevent the disengagement of the cam plate 50.

The descriptions given above regarding the configuration of the cam plate 50 are common to both the left and right cam plates.

Next, the cam plate 50 on the driving means side (which hereinafter will be referred to as the right cam plate) will be described. The right cam plate 50 is provided with a raised portion, which is on the same side as the side on which the connecting boss 50*d* is provided, and is on the inward side of the cam hole 50*b* in terms of the radius direction of the cam hole 50*b*. The top surface 50*f* of this raised portion is slightly outward of the surface in which the cam hole 50*b* is present. The top surface 50*f* is provided with a second boss 50*g*. The distance by which the surface 50*f* is raised is greater than the height of the connecting boss 50*d*. The end portion of the second boss 50*g* is provided with a pair of claws 50*g*1 and 50*g*2, which extend in the radius direction of the boss 50*g*.

The cam plate 50 on the side from which the process cartridge is not driven (which hereinafter will be referred to as the left cam plate) is provided with the second cam portion 50*h*, which is located near the straight portion (straight groove hole) 50*b*2 of the cam hole 50*b* and on the outward side of the cam hole 50*b* in terms of the radius direction of the cam hole 50*b*, and a contact surface 50*i*, which is on the upstream side of the cam plate 50 in terms of the rotational direction in which the opening/closing cover 15 closes. The second cam portion 50*h* is a portion of the cam plate 50, which is for driving the pusher arm 52 as the means for accurately positioning the left side of the process cartridge, and will be described later. It has a gently arcuated arm driving portion 50*h*1, which extends from the edge of the arcuate periphery of the main structure of the cam plate 50, approximately in the direction in which the opening/closing cover 15 closes, and a gently arcuated arm holding or retaining portion 50*h*2, the center of the curvature of which coincides with that of the axial line of the rotational shaft 50*a* of the cam plate 50. These portions 50*h*1 and 50*h*2 are in the form of a groove, the open side of which, in terms of the lengthwise direction of the process cartridge, faces the inner plate 40. The second cam portion 50*h* protrudes more inward of the apparatus main assembly than the inwardly tiered portion of the cam plate 50 for accommodating the inwardly protruding lips of the guide rail 40*b*. The pusher arm 52 fits in the gap created by the difference between the distances by which the second cam portion 50*h* and the tiered portion of the cam plate 50, protrude inward of the apparatus main assembly. The contact surface 50*i* extends in the radius direction of the rotational shaft 50*a*, and its height in terms of the thickness direction of the cam plate 50 is the same as that of the bottom wall of the second cam portion 50*h*.

(Connecting Plate)

The cam plate 50 and opening/closing cover 15 are connected by the connecting plate 51, together forming a four-joint linkage. The connecting plate 51 has a hole 51*a*, which is located in one of the lengthwise end portions, and into which the connecting boss 50*d* of the cam plate 50 rotationally engages, and a shaft 51*b*, which is located at the other lengthwise end, and has a pair of snap-fitting claws 51*b*1. The hole 51*a* is provided with a recess 51*a*1 for preventing the claw 50*d*1 of the connecting boss 50*d* of the cam plate 50 from hanging up on the connecting plate 51 when connecting the connecting plate 51 and cam plate 50. The recess 51*a*1 extends from one side of the connecting plate 51 to the other in terms of the axial direction of the shaft 51*b*. The pair of snap-fitting claws 51*b*1 are symmetrically positioned with respect to the line connecting the centers of the hole 51*a* and shaft 51*b*. Further, the shaft 51*b* is provided with a pair of intermediate portions, which are symmetrically positioned with respect to the line perpendicular to the line connecting the centers of the hole 51*a* and shaft 51*b*, being therefore at the middle of the intervals between the pair of snap-fitting claws 51*b*1 in terms or the circumferential direction of the shaft 51*b*, reinforcing the shaft 51*b* against the load which acts upon the shaft 51*b* in the direction of the line which connects the centers of the hole 51*a* and shaft 51*b* of the connecting plate 51.

(Cover and Cover Backing)

Figure 10:
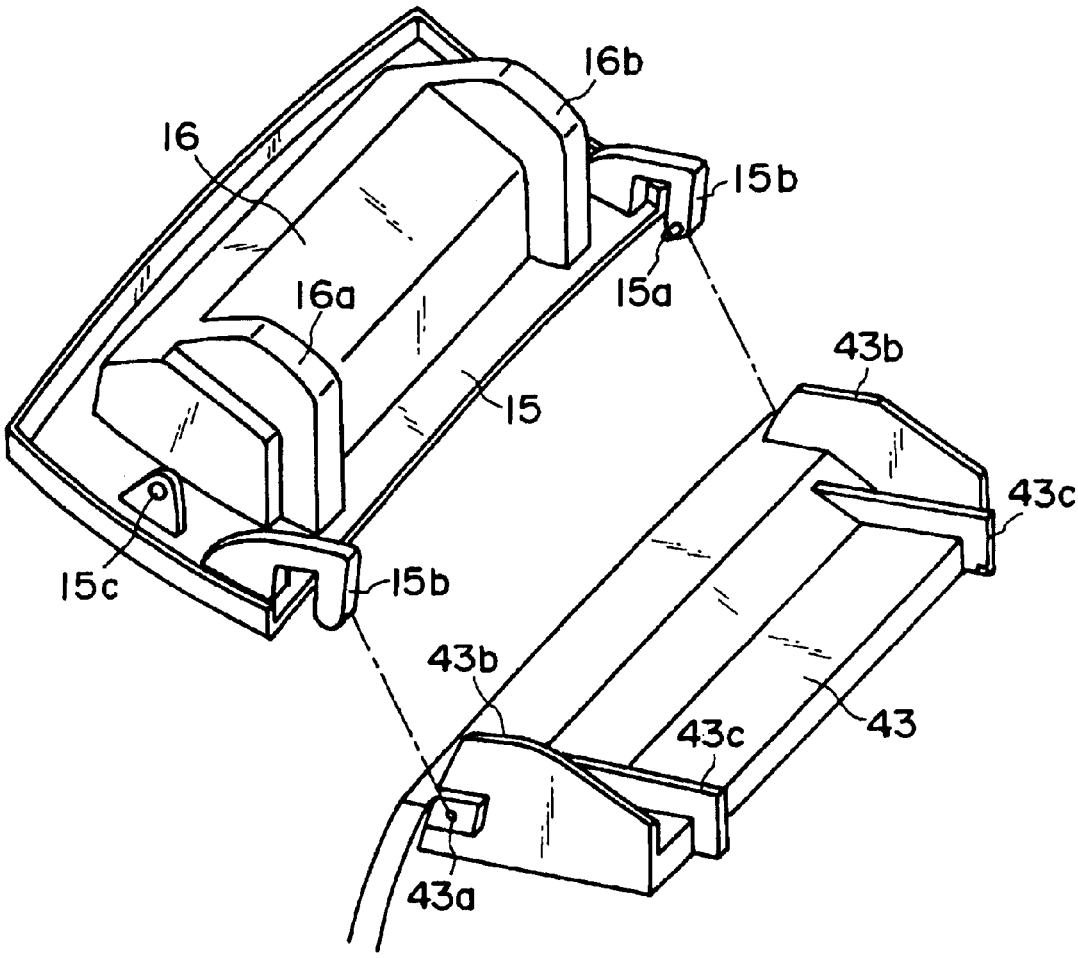
FIG. 10 is a perspective view of an opening and closing cover and a front guide.

Referring to FIG. 10, the opening/closing cover 15 is provided with a pair of hinges 15*b* having a center boss 15*a*, and a pair of plates having a connecting hole 15*c* into which the shaft 51*b* of the connecting plate 51 fits. The pair of hinges 15*b* and the pair of plates having the connecting hole 15*c* are on the back side of the opening/closing cover 15, near the lengthwise ends of the opening/closing cover 15, one for one. The opening/closing cover 15 is also provided with a backing 16, which is for increasing the rigidity of the opening/closing cover 15, and is fixed to the inward surface of the opening/closing cover 15. The backing 16 is provided with a pair of projections 16*a*, 16*b*, which are located near the lengthwise end of the backing 16, and function as guides for approximately guiding the process cartridge B when mounting the process cartridge B into the image forming apparatus.

(Front Guide)

Also referring to FIG. 10, there are front guides 43 between the left and right inner plates 40, and being fixed thereto. The front guide 43 is provided with a pair of supporting holes 43*a*, in which the pair of center bosses 15*a* of the opening/closing cover 15 are rotationally supported, one for one. The front guide 43 is also provided with a pair of side guide ribs 43*b* and a pair of contact ribs 43*c*, which are located near the lengthwise ends of the front guide 43, one for one.

Each side guide 43*b* is disposed so that the position of its inward surface coincides with the inward surface of the corresponding moving guide 41. Not only does it guide the positioning guide 18*a* of the process cartridge B and the process cartridge B itself, but also accurately positions the process cartridge B in terms of the lengthwise direction of the process cartridge B in coordination with the other side guide 43*b*. Each contact rib 43*c* is disposed on the inward side of the side guide 43*b* in terms of the lengthwise direction of the opening/closing cover 15, and contacts the downwardly facing surface 10*f*4 of the toner/developing means holding frame 10*f* of the process cartridge B.

(Driving Means)

Referring to FIGS. 7 and 11, the right and left inner plates 40 are provided with an inward bearing 84, which is located higher than the transfer roller 4. With the provision of this inward bearing 84, a large gear 83 having a large gear coupling 83*a* for transmitting a driving force to the photoconductive drum 7 is rotationally supported by the inner plate 40.

The opposite side of the large gear coupling 83*a* of the large gear 83 is rotationally supported by an outward bearing 86 fixed to a gear cover (unshown) attached to the inner plate 40.

The inward bearing 84 is provided with an arcuate cartridge catching/retaining portion 84*a* for holding the process cartridge B to a position in which the large coupling 83*a* of the process cartridge B is engageable (final process cartridge position in the apparatus main assembly: second location). The location of the arcuate cartridge catching/retaining portion 84*a* corresponds to the final process cartridge position in the apparatus main assembly, and the center of the curvature of the arcuate cartridge catching/retaining portion 84*a* coincides with the axial line of the large gear 83. The arcuate cartridge catching/retaining portion 84*a* catches the positioning guide 18*a* of the process cartridge B. The inward bearing 84 is also provided with a cylindrical portion 84*b* and a cam surface (84*c*1 and 84*c*2), both of which are on the large gear 83 side. The cam surface (84*c*1 and 84*c*2) faces outward in terms of the radius direction of the cylindrical portion 84*b*.

On the cam surface side of the inward bearing 84, a cylindrical coupling cam 85 is provided. The coupling cam 85 rotationally fits around the cylindrical portion 84*b*, and has a cam surface (85*a*1 and 85*a*2) which contacts the cam surface (84*c*1 and 84*c*2). As the coupling cam 85 rotates, it allows the large gear 83 to move in its axial direction due to the function of the cam surfaces. Further, the coupling cam 85 is provided with a boss 85*b*, which is located on the outward edge of the cylindrical peripheral surface of the coupling cam 85 in terms of the radius direction of the coupling cam 85. More specifically, the coupling cam 85 is provided with a circumferential rib 85*c*, which is attached to the large gear 83 side of the cylindrical peripheral surface of the coupling cam 85, and projects in the radius direction of the coupling cam 85. The boss 85*b* is attached to this circumferential rib 85*c*, projecting in the axial direction of the coupling cam 85. The tip of the boss 85*b* is provided with a claw 85*b*1. Between the outward bearing 86 and large gear 83, there is spring, which keeps the large gear 83 pressed toward the inward bearing 84.

(Thruster Rod)

Figure 12:
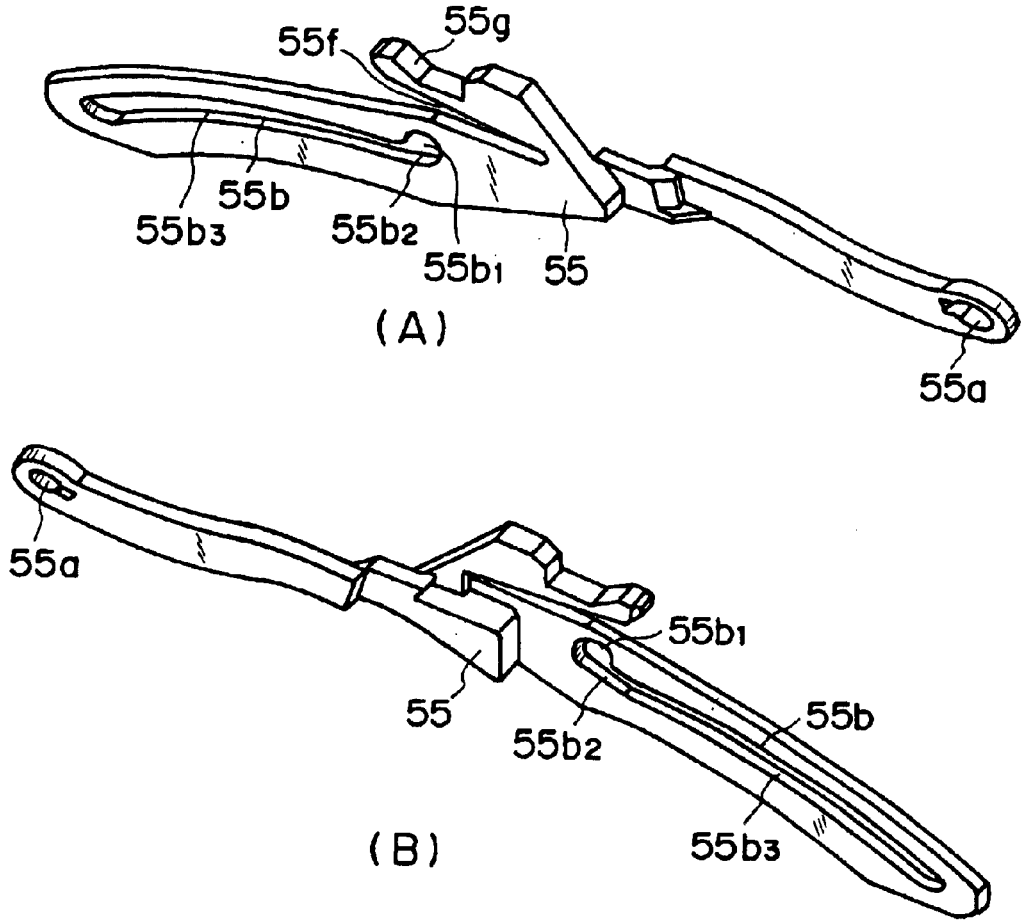
FIGS. 12 ((A) and (B)) are perspective views of a thruster rod.

FIGS. 12(A) and 12(B) show a thruster rod 55. The thruster rod 55 constitutes a connecting rod which connects the second boss 50*g* to the right cam plate 50 and the boss 85*b* of the coupling cam 85. It is on the right inner plate 40, and forms the second four-joint linkage. As shown in FIGS. 12(A) and 12(B), the thruster rod 55 is provided with two through holes: keyhole-shaped hole 55*a* and an elongated hole 55*b*. The keyhole-shaped hole 55*a* has a size and a configuration for the claw 85*b*1 of the coupling cam 85 to be put through, and the boss 85*b* is slidably fitted therein. The elongated hole 55*b* is a hole through which the second boss 50*g* of the cam plate 50 is slidably put. The elongated hole 55*b* has three sections: a straight portion 55*b*1, which extends downward approximately perpendicular to the line connecting the center of the end portion, on the keyhole-shaped hole 55*a* side, and the center of the keyhole-shaped hole 55*a*; an inclined portion 55*b*2, which extends diagonally downward from the bottom end of the straight portion 55*b*1; and an arcuate portion 55*b*3, which extends diagonally downward from the bottom end of the inclined portion 55*b*2. Below the arcuate portion 55*b*3, a boss is located, and the tip of the boss is provided with a claw.

Above the straight portion 55*b*1 of the elongated hole 55*b*, a lifting surface 55*f* is provided, which is recessed in the lengthwise direction of the thruster rod 55, appearing like a U-shaped groove which is laid on its side and opens toward the direction opposite to the keyhole-shaped hole 55*a*. Further, above the lifting surface 55*f*, a backup portion 55*g* is provided, which is an upwardly open recess. These portions are integral parts of the thruster rod 55.

(Stationary Guide)

As is evident from FIG. 7, there is a stationary guide 44, which surrounds the inward bearing 84. The stationary guide 44 is approximately in the form of a letter E, being open toward the area, and extends beyond the cartridge catching/ retaining portion 84*a* of the inward bearing 84, and inward end of the first guide rail 40*a* of the inner plate 40.

The stationary guide 44 is provided with: a butting portion 44*a*, which surrounds the cartridge catching/retaining portion 84*a*, and is enabled to come into contact with the butting surface 18*c* located on one of the lengthwise ends of the process cartridge B as the process cartridge B is mounted; a rotation controlling portion 44*b*, which is located higher than the butting portion 44*a*, and on the downstream side of the cartridge catching/retaining portion 84*a* in terms of the process cartridge mounting direction, and fixes the position of the process cartridge B in terms of the rotational direction of the process cartridge B, by being contacted by the butting surface 18*d* provided on the process cartridge frame to control the rotational movement of the process cartridge B, during an image forming operation; and a shutter guide portion 44*c*, which is located higher than the rotational controlling portion 44*b*, and constitutes one of the components of the mechanism for opening or closing the aforementioned drum shutter 12.

Figure 13:
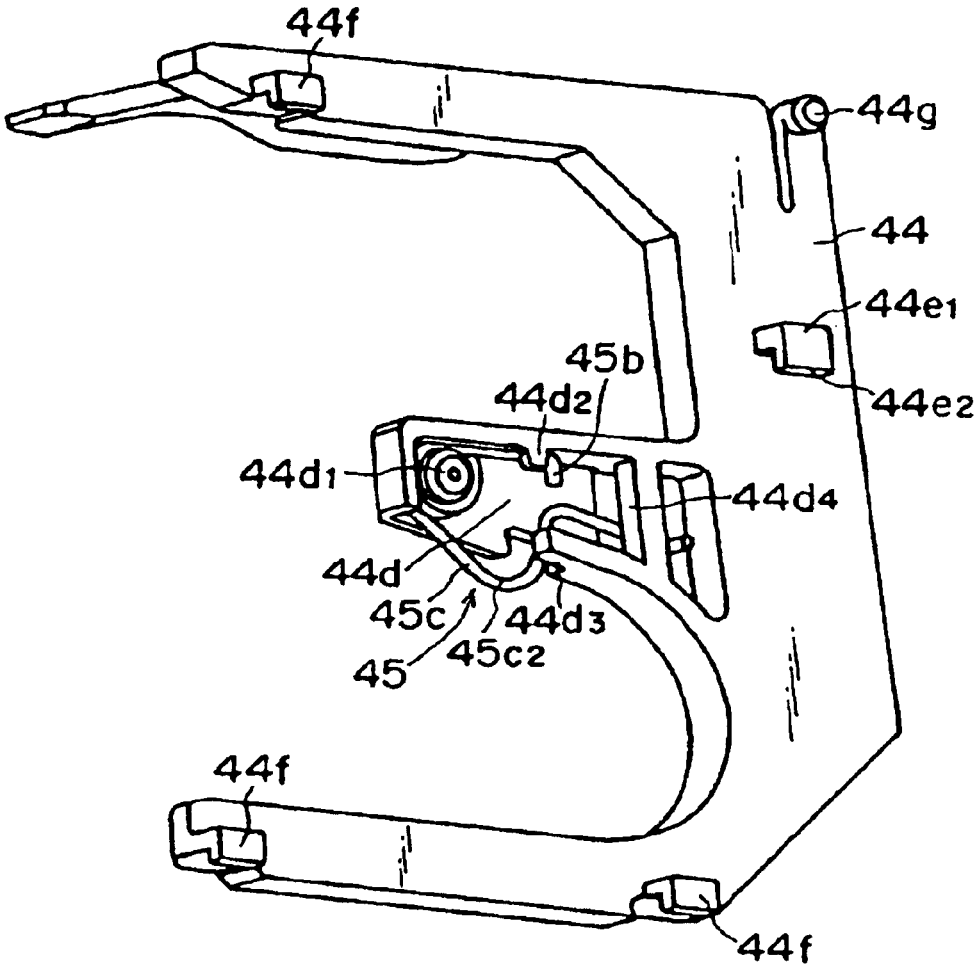
FIG. 13 is perspective views of a fixed guide and a screw coil spring.

Further, referring to FIG. 13, the stationary guide 44 is provided with a helical torsion coil spring 45, which is located in the middle portion among the three horizontal portions of the approximately E shaped stationary guide 44, and is for keeping the positioning guide 18*a* of the process cartridge B pressed upon the cartridge catching/retaining portion 84*a*, on the upstream side of the cartridge catching/retaining portion 84*a* in terms of the cartridge mounting direction. Thus, the surface of the stationary guide 44, which is placed in contact with the inner plate 40 is provided with a recess 44*d*, in which the helical torsion coil spring 45 is placed and is allowed to play its role. The recess 44*d* houses, a boss 44*d*1, around which the coiled portion of the helical torsion coil spring 45 is fitted, a claw 44*d*2 for preventing the stationary arm portion 45*b* of the helical torsion coil spring 45 from becoming dislodged, and a regulative claw 44*d*3 and a regulative rib 44*d*4 for regulating the position of the functional arm of 45*c* of the helical torsion coil spring 45, in terms of the lengthwise direction of the process cartridge B.

Also, the stationary guide 44 is provided with a positioning rib 44*e*1, which is for accurately positioning the stationary guide 44 relative to the right inner plate 40 and fixing it thereto, and is located on the surface opposite to the surface on which the rotation controlling portion 44*b*, in correspondence to the rotation controlling portion 44*b* is provided. The positioning rib 44*e*1 accurately positions the stationary guide 44 relative to the right inner plate, in terms of the vertical direction, by being engaged into the positioning hole (unshown) of the right inner plate 40. The tip of the positioning rib 44*e*1 is provided with a claw 44*e*2, which prevents the stationary guide 44 from becoming dislodged from the right inner plate 40. Further, the stationary guide 44 is provided with three locking claws 44*f* for keeping the stationary guide 44 fixed to the right inner plate 40, and a projection 44*g* for preventing the stationary guide 44 from horizontally sliding, ensuring that the stationary guide 44 remains firmly fixed to the right inner plate 40, maintaining the proper attitude.

(Conveying Means Frame)

A bearing for rotationally supporting the transfer roller 4 is slidably attached to a conveying means frame 90 (FIG. 28), which provides a surface across which the recording medium is conveyed. The conveying means frame 90 is provided with a positioning portion 90*a*, which is located adjacent to, and above, the left end of the transfer roller 4, in terms of the axial direction of the roller 4, and the position of which corresponds to the position of the rotational axis of the large gear 83. The positioning portion 90*a* holds the positioning boss 18*a* of the process cartridge B to the position in which the process cartridge B is capable of carrying out an image forming operation. This positioning portion 90*a*, and the pusher arm 52, which will be described later, together constitute the means for accurately positioning the left side of the process cartridge B.

(Push Arm)

Figure 14:
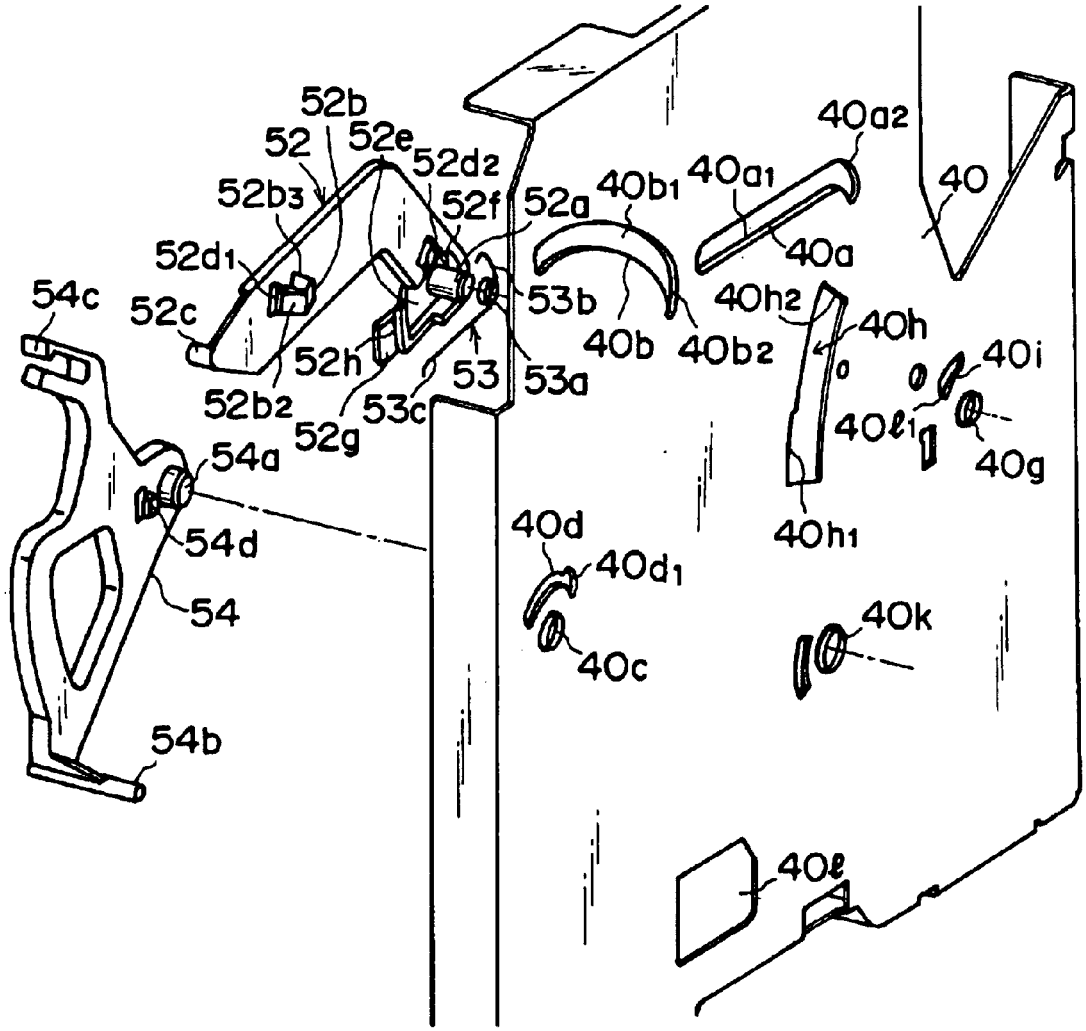
FIG. 14 is an exploded perspective view of a pushing arm and an inter-relating (interlocking) switch.
Figure 15:
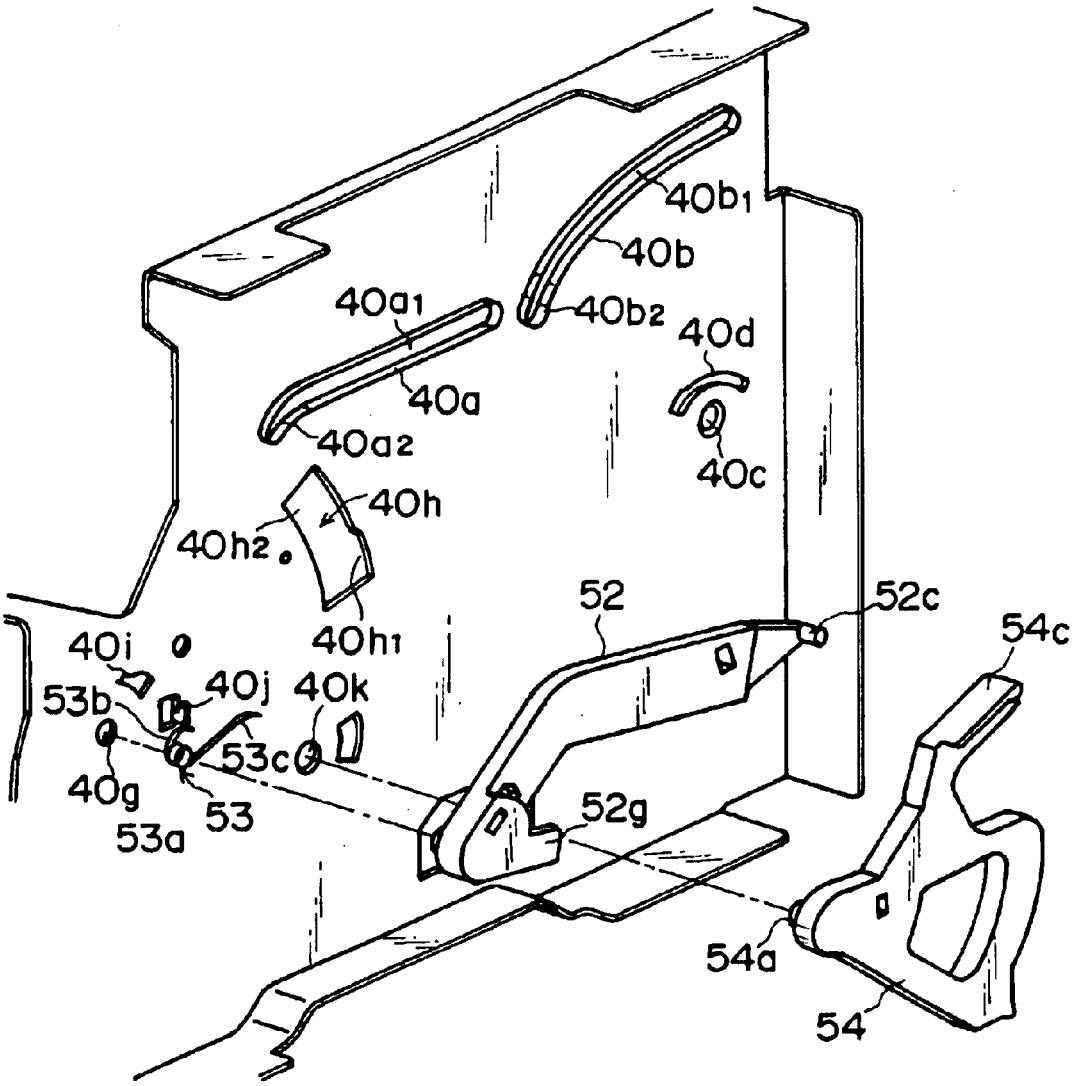
FIG. 15 is an exploded perspective view of a pushing arm and an inter-relating (interlocking) switch.

Referring to FIGS. 14 and 15, the left inner plate 40 is provided with a pusher arm 52, which has the function of holding the positioning boss 18*a* of the process cartridge B to the positioning portion 90*a*, after the process cartridge B is moved by the process cartridge mounting/dismounting mechanism, the movement of which is linked to the closing movement of the opening/closing cover 15.

The pusher arm 52 is rotationally supported by the left inner plate 40; the rotational shaft 52*a* of the pusher arm 52 is rotationally engaged in the hole 40*g* of the left inner plate 40. Further, the pusher arm 52 is provided with a resilient pressing portion 52*b*, which is pushed through a fan shaped hole 40*h* of the left inner plate 40.

The pusher arm 52 is provided with a helical torsion coil spring 53, which is fitted around the base portion of the rotational shaft 52*a*, and keeps the pusher arm 52 pressed upward to prevent the resilient pressing portion 52*b* from invading the path of the positioning guide 18*a* of the process cartridge B.

The tip of the resilient pressing portion 52*b* is provided with a boss 52*c*, which is for allowing the pusher arm 52 to oscillate, and engages in the second cam portion 50*h* of the cam plate 50. Further, the pusher arm 52 is provided with claws 52*d*1 and 52*d*2, which are for attaching the pusher arm 52 to the left inner plate 40, and are located adjacent to the base portion of the resilient pressing portion 52*b*, and the rotational shaft 52*a*, respectively. The claws 52*d*1 and 52*d*2 are put through the fan-shaped hole 40*h* and key-shaped hole 40*i* of the left inner plate 40, and latch on the back sides of the fan-shaped hole 40*h*, the key-shaped hole 40*i* functioning as a locking device for preventing the pusher arm 52 from becoming disengaged from the left inner plate 40.

In addition, the pusher arm 52 is provided with: a recess 52*e* in which the aforementioned helical torsion coil spring 53 is disposed; a rib 52*f* as a means for preventing the functional arm 53*b* of the helical torsion coil spring 53 from dislodging; a protective rib 52*g*, which is large enough to keep the helical torsion coil spring 53 almost completely covered, within the rotational range, after the stationary arm 53*c* of the helical torsion coil spring 53 supported by the spring anchor portion 40*j* of the left inner plate 40 is fixed; and a temporarily holding rib 52*h*, which makes it possible to temporarily hold the stationary arm 53*c* of the helical torsion coil spring 53 to the pusher arm 52 before attaching it to the spring anchor portion 40*j*. They are near the base portion of the rotational shaft 52*a*.

(Interlocking Switch)

Referring to FIGS. 14 and 15, the left inner plate 40 is provided with an interlocking switch 54, which is rotationally supported by the plate 40. It presses a microswitch 91 (FIG. 58) provided on a circuit board, at the very end of the closing of the opening/closing cover 15. As the interlocking switch 54 presses the microswitch 91, current flows through various parts of the image forming apparatus main assembly, readying it for an image forming operation.

The interlocking switch 54 comprises: a rotational shaft 54*a* which functions as a pivot; a lever 54*b* which presses the microswitch 91; an elastic portion 54*c* which elastically bends as it presses on the contact surface 50*i* of the cam plate 50; and a claw 54*d* for attaching the interlocking switch 54 to the inner plate 40. The left inner plate 40 is provided with a hole 40*k*, the position of which corresponds to that of the rotational shaft 54*a*, and a hole 40*l* located outside the operational range of the lever 54*b*.

(Assembly Method)

Next, the method for assembling the above described various components will be described.

As will be understood from FIGS. 5, 7, and 15, and the like drawings, the moving guide 41 is attached to the inner plate 40 in the following manner. First, the claws 41*c*1 and 41*c*2 located at the tip of the second boss 41*c* are aligned with the arcuate portion 40*b*1 of the second guide rail 40*b*, and put though the arcuate portion 40*b*1. Then, the moving guide 41 is rotated. As the moving guide 41 is rotated, the claws 41*c*1 and 41*c*2 latch on the lips of the second guide rail 40*b*, preventing the second boss 41*c* from disengaging from the inner plate 40. Then, the first boss 41*b* of the moving guide 41 is put through the first guide rail 40*a*. Next, the moving guide 41 is moved toward the inclined portion 40*a*2 of the first guide rail 40*a*, and a guide stopper 46 as a disengagement prevention device is fitted in the through hole 41*b*2 of the first boss 41*b*.

Referring to FIG. 5, the guide stopper 46 comprises: a cylindrical portion 46*a*1 which is located in the center of the guide stopper 46, and fits in the through hole 41*b*2; a shaft 46*a*2, which is located also in the center of the guide stopper 46, and is smaller in diameter than the cylindrical portion 46*a*1; and a bottom portion 46*b*, to which the cylindrical portion 46*a*1 is connected, with the interposition of the shaft portion 46*a*2. The guide stopper 46 also comprises a pair of side walls 46*c*, which perpendicularly project from the lengthwise ends of the bottom portion 46*b*, one for one.

Thus, as the cylindrical portion 46*a*1 and shaft portion 46*a*2 of the guide stopper 46 are fitted into the through hole 41*b*2, the snap-fitting claw 41*b*1 latches on the stepped portion between the cylindrical portion 46*a*1 and shaft portion 46*a*2, and the pair of side walls 46*c* is enabled to contact the inner plate 40, on the outward side of the lips of the guide rail 40*a* formed by burring. The first boss 41*b* is structured so that when the first boss 41*b* of the moving guide 41 is fitted through the inclined portion 40*a*2 of the guide rail 40*a*, the position of the snap-fitting claw 41*b*1 in terms of the circumferential direction of the first boss 41*b* coincides with the direction in which the inclined portion 40*a*2 diagonally extends. Therefore, the presence of the snap-fitting claws 41*b*1 does not adversely affect assembly efficiency. With the provision of the above described structural arrangement, even if the moving guide 41 is subjected to such force that might cause the moving guide 41 to fall into the inward side of the left or right inner plate, the snap-fitting claw 41*b*1 remains latched on the cylindrical portion 46*a*1 of the guide stopper 46, and the pair of side walls 46*c* remain in contact with the inner plate 40, preventing the moving guide 41 from disengaging from the inner plate 40.

Each side wall 46*c* of the guide stopper 46 is rendered substantially taller than the lips of the first guide 40*a* formed by burring. Therefore, it does not occur that bottom portion 46*a* of the guide stopper 46 is shaved by coming into contact with the flush surface left on the lips of the first guide rail 40*a* when the first guide rail 40*a* was formed by burring.

After attaching the moving guide 41 to the inner plate 40, the cam plate 50 shown in FIG. 8 and the like are attached.

When the moving guide 41 is in the position at which the second boss 41*c* contacts the bottom end of the straight portion 40*b*2 of the guide rail 40*b*, the direction in which the claws 41*c*1 and 41*c*2 of the second boss 41*c* extend aligns with the hole 40*c*, the axial line of which coincides with the rotational axis of the cam plate 50.

Thus, the assembly facilitation hole 50*b*3 of the cam plate 50 is aligned with the second boss 41*c* of the moving guide 41, and the rotational shaft 50*a* is inserted into the hole 40*c*. As the rotational shaft 50*a* is inserted into the hole 40*c*, the cam plate 50 comes into contact with the inner plate 40, since the assembly facilitation claw 50*e* is positioned so that as the assembly facilitation hole 50*b*3 is aligned with the second boss 41*c*, the assembly claw 50*e* aligns with the assembly facilitation portion 40*d*1 of the arcuate hole 40*d*.

In this state, the cam plate 50 is rotated in the direction in which the opening/closing cover 15 is opened. As the cam plate 50 is rotated, the temporary holding rib 50*c* passes the back side of the claw 41*c*1 of the second boss 41*c* of the moving guide 41; the claws 41*c*1 and 41*c*2 come into contact with the edge of the cam hole 50*b*; and the assembly facilitation claw 50*e* latches on the edges of the arcuate hole 40*d*. As a result, the cam plate is properly fixed to inner plate 40.

In consideration of the variance in component size resulting from manufacturing errors, a gap is provided between the surface on which the temporary holding rib 50*c* and the claws 41*c* 1 and 41*c*2 located at the top of the second boss 41*c* of the moving guide 41, and the height of the temporary holding rib 50*c* is rendered slightly greater than this gap. Therefore, the temporary holding 50*c* is caught by the claw 41*c*1 of the second boss 41*c* of the moving guide 41, preventing the cam plate 50 from rotating far enough to allow the assembly facilitation hole 50*b*3 of the cam plate 50 to align with the second boss 41*c* of the moving guide 41. Therefore, the boss 41*c* does not disengage from the assembly facilitation hole 50*b*3 of the cam plate 50.

The right cam plate 50 is attached to the right inner plate 40 in the following manner. First, the thruster rod 55 is connected to the coupling cam 85, and the elongated hole 55*b* of the thruster rod 55 is aligned with the claws 50*g*1 and 50*g*2 of the second boss 50*g*. Then, the right cam plate 50 is attached to the right inner plate 40. Thereafter, the thruster rod 55 is rotated to make the elongated hole 55*b* intersect with the direction in which the claws 50*g*1 and 50*g*2 extend. Then, the coupling cam 85 is fitted around the cylindrical portion 84*b* of the inward bearing 84, completing the four joint linkage comprising the cam plate 50, the coupling cam 85, and the thruster rod 55.

Thereafter, the cam plate 50 is rotated, as described above, to complete the process for attaching the moving guide 41 and cam plate 50 to the inner plate 40.

Referring to FIG. 13, after the helical torsion coil spring 45 is placed in the recess 44*d* of the stationary guide 44, the positioning rib 44*e*1 and locking claws 44*f* of the stationary guide 44 are aligned with the positioning hole (unshown) and connecting holes (unshown) of the right inner plate 40, and are fitted therein. Then, the stationary guide 44 is slid. As the stationary guide 44 is slid, the claw 44*e*2 of the positioning rib 44*e*1, and the locking claws 44*f*, latch on the edges of the positioning hole and connecting holes, by their back surfaces. Further, the slide regulating projection 44*g* fits in the corresponding connecting hole (unshown), fixing the position of the stationary guide 44 relative to the inner plate 40 in terms of the direction in which the stationary guide 44 is slid.

Referring to FIGS. 14 and 15, before the pusher arm 52 is attached to the left inner plate 40, the helical torsion coil spring 53 is attached to the pusher arm 52.

More specifically, the coiled portion 53*a* of the helical torsion coil spring 53 is fitted around the rotational shaft 52*a*, and the functional arm 53*b* is set under the rib 52*f*. Then, the stationary arm 53*c* is rested on the temporary holding rib 52*h*, also called a temporary stationary arm rest 52*h*, which is on the back side of the protective rib 52*g*.

The pusher arm 52 is structured so that as the resilient pressing portion 52*b* is aligned with the wider portion 40*h*, that is, the bottom end portion of the fan-shaped hole 40*h*, the claw 52*d*2 aligns with the wider portion 40*i*1 of the key-shaped hole 40*i*. When the pusher arm 52 is in the above described state, the spring anchor portion 40*j* of the left inner plate 40 can be seen above the protective rib 52*g*.

The pusher arm 52 being in the above described state, the stationary arm 53*c* of the helical torsion coil spring 53 is transferred from the temporary stationary arm rest 52*h* to the spring anchor portion 40*j* by being held by its tip. As a result, the resiliency stored in the helical torsion coil spring 53 is released, and pivots the pusher arm 52 upward, causing the claw 52*d*1 located at the base portion of the resilient pressing portion 52*b*, and the claw 52*d*2 located near the rotational shaft 52*a*, to latch on the edges of the fan shaped hole 40*h* and key shaped hole 40*i*, respectively, completing the process for attaching the pusher arm 52.

During this process, as the pusher arm 52 is rotated upward by the resiliency of the helical torsion coil spring 53, the butting portion 52*b*3, that is, the tip of the resilient pressing portion 52*b* comes into contact with the top end 40*h*2 of the fan-shaped hole 40*h*, allowing the pulling surface 52*b*2 located at the base portion of the resilient pressing portion 52*b*, to escape upward above the path of the positioning guide 18*a* of the process cartridge B, and then, remains on standby. As the pusher arm 52 enters into the standby state, the stationary arm 53*c* of the helical torsion coil spring 53 moves to a position at which it is hidden behind the protective rib 52*g* of the pusher arm 52.

After the various components are attached to the left and right inner plates 40, various units, for example, the conveying means frame 90 unit, to which the conveying means, the transfer roller 4, the fixing means 5, and the like, have been attached, the optical system 1 unit, and the like units, are attached to the left and right inner plates 40. Thereafter, the external trims and shells inclusive of the opening/closing cover 15 are attached to complete an image forming apparatus.

During the above described final stage of the assembly, the wide portion 40*h*1 of the fan-shaped hole 40*h* of the left inner plate 40 is plugged by the positioning portion 90*a* of the conveying means frame 90, so that the pusher arm 52 is prevented from becoming disengaged after the image forming apparatus is completely assembled.

In order to attach the opening/closing cover 15, the center boss 15*a* of each hinge 15*b* of the opening/closing cover 15 is fitted into the corresponding supporting hole 43*a* of the front guide 43, by elastically deforming the hinge 15*b* in the lengthwise direction of the process cartridge B. The front guide 43 is fixed to the left and right inner plates 40.

Next, the method for connecting the connecting plate 51 to the cam plate 50 and opening/closing cover 15 will be described.

Figure 27:
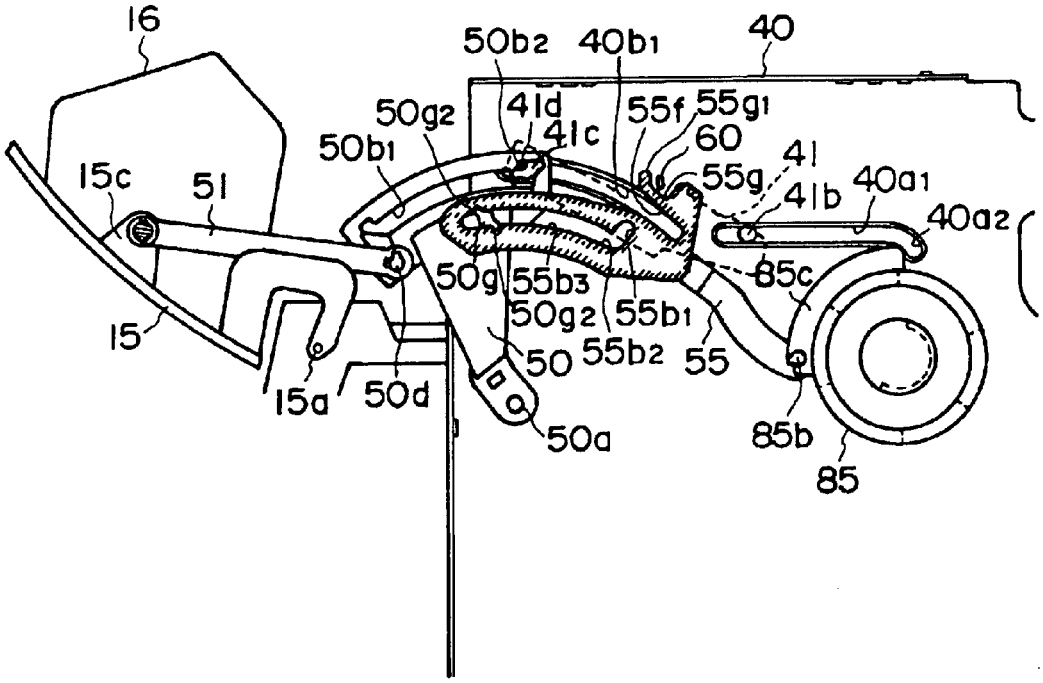
FIG. 27 is an illustration of a process cartridge inserting operation into the process cartridge mounting-and-demounting mechanism, at the righthand side inner plate in the image forming apparatus, as seen at the same timing as with FIG. 26.

As will be understood referring to, for example, FIG. 27, rotating the opening/closing cover 15 and the cam plate 50 in the opening direction of the opening/closing cover 15 exposes the connecting boss 50*d* and the connecting hole 15*c*, by which the cam plate 50 and the opening/closing cover 15 are connected to each other. The claw 50*d*1 of the connecting boss 50*d* points outward in terms of the radius direction of the cam plate 50. The recess 51*a*1 of the hole 51*a* of the connecting plate 51 extends toward the shaft 51*b*. Therefore, as the connecting plate 51 is pointed outward in terms of the radius direction of the cam plate 50, the claw 50*d*1 and recess 51*a*1 engage with each other. As a result, the connecting plate 51 becomes attached to the cam plate 50.

Thereafter, the shaft 51*b* is put through the connecting hole 15*c* by rotating the connecting plate 51. As the shaft 51*b* is put through the connecting hole 15*c*, the snap fitting claw 51*b*1 latches on the edge of the connecting hole 15*c*, preventing the shaft 51*b* from disengaging.

As a result, the opening/closing cover 15 and cam plate 50 rotationally supported by the image forming apparatus main assembly 14 form the four-joint linkage connected by the connecting plate 51. With the provision of this structural arrangement, the linking mechanism becomes such a mechanism that the moving guide 41 is moved by the cam plate 50 during the first half of the process for closing the opening/closing cover 15, and the latter half of the process for opening the opening/closing cover 15.

(Mounting of Process Cartridge into Apparatus Main Assembly and Dismounting of Process Cartridge from Apparatus Main Assembly)

Next, referring to FIGS. 16–25, the processes carried out by an operator to mount the process cartridge B into, or dismount the process cartridge B from, the image forming apparatus A equipped with the process cartridge mounting/dismounting mechanism, will be described.

Figure 16:
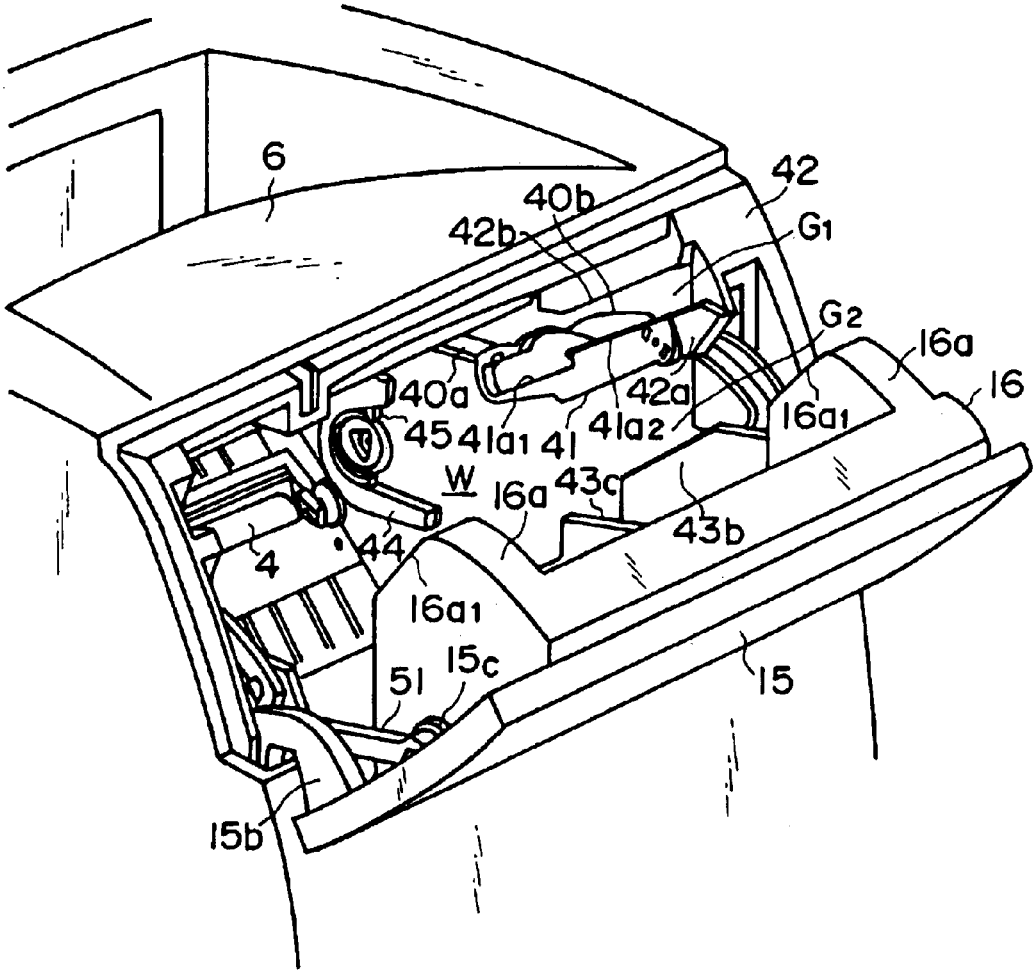
FIG. 16 is a perspective view of a process cartridge mounting-and-demounting mechanism.

As the opening/closing cover 15 of the image forming apparatus main assembly A is fully opened (fully open state), an opening W, through which the process cartridge B is mounted or dismounted, is exposed. In this state, the moving guide 41 is tilted diagonally downward in terms of the process cartridge insertion direction, as shown in FIG. 16. On the upstream side, there are left and right auxiliary guides or covers 42, which are symmetrically fixed to the left and right inner plate 40, one for one.

Figure 17:
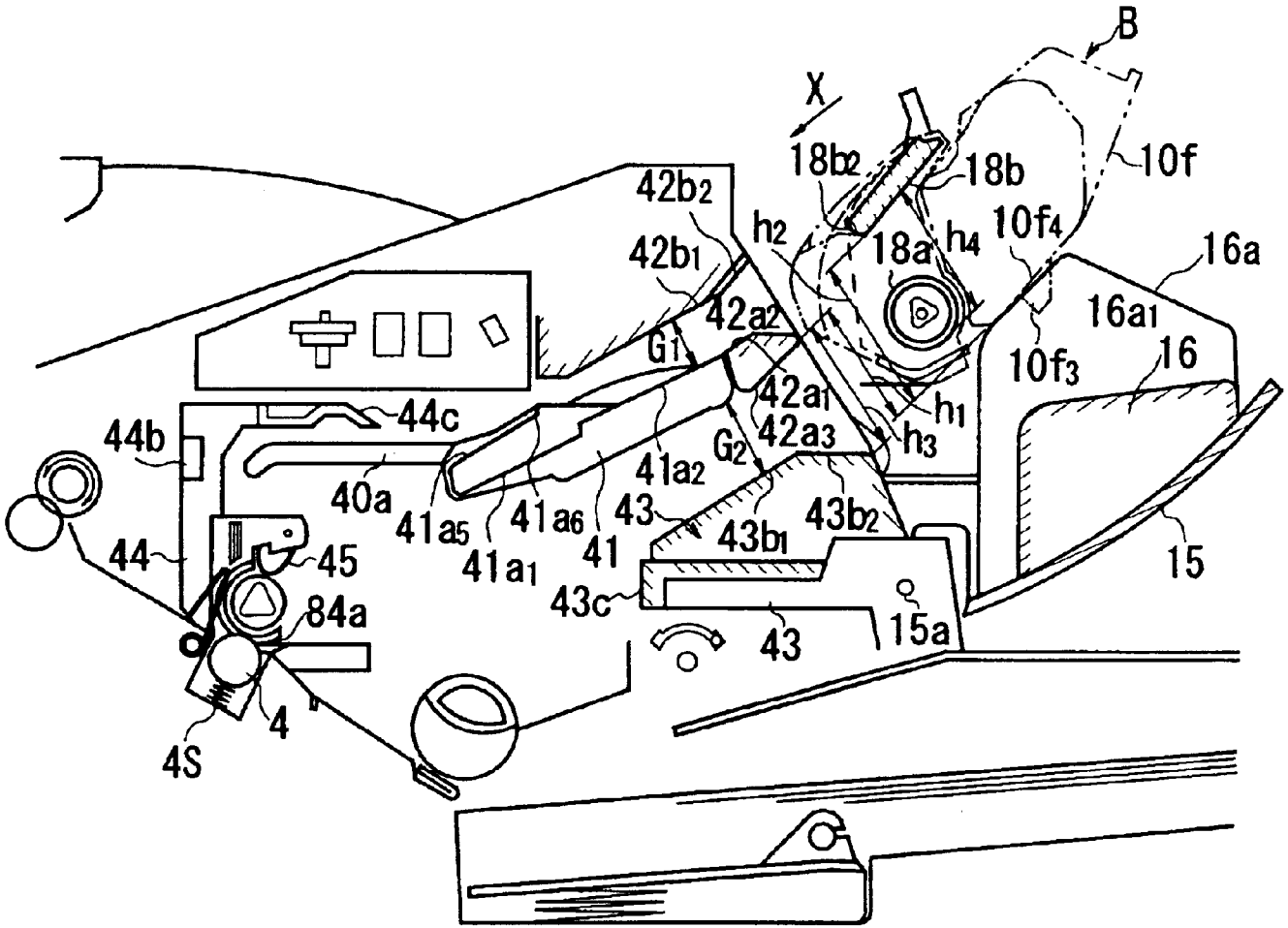
FIG. 17 is an illustration of an inserting operation of the process cartridge into a process cartridge mounting-and-demounting mechanism.

As will be more easily understood referring to FIG. 17, each auxiliary guide 42 has a mounting/dismounting assistance portion 42*a*, which is in connection with the trailing end of the moving guide 41, and a top regulating portion 42*b*, which has such a surface that is virtually in contact with, and flush with, the top surface 41*a*6 of the moving guide 41.

The mounting/dismounting assistance portion 42*a* is provided with a front guiding surface 42*a*1 contiguous with the guiding surface 41*a*2, an entry guiding surface 42*a*2, which is contiguous with the front guiding surface 42*a*1, and is gentler in inclination than the front guiding surface 42*a*1, being virtually horizontal, and a bottom guide surface 42*a*3, which is located below the front guiding surface 42*a*1 and entry guiding surface 42*a*2, and extends toward the bottom surface of the moving guide 41, being steeper in inclination than the front guiding surface 42*a*1.

Further, the top regulating portion 42*b* is provided with a top regulating surface 42*b*1, which is virtually continuous and flush with the top surface 41*a*6 of the moving guide 41, and a top entry guiding surface 42*b*2, which is contiguous with the top regulating surface 42*b*1, being virtually parallel to the bottom guiding surface 42*a*3, and extends diagonally upward from the top regulating surface 42*b*1.

The side guide 43*b* of the above described front guide 43 is provided with an inclined surface 43*b*1, which is virtually parallel to the guiding surface 41*a*2 of the moving guide 41, being only slightly greater in inclination than the guiding surface 41*a*2 of the moving guide 41, and a horizontal surface 43*b*2 which is on the opening/closing cover 15 side and is contiguous with the inclined surface 43*b*1.

Thus, on the inward surface of each of the left and right inner plates 40 visible through an opening W which appears as the opening/closing cover 15 is opened, there are two guiding grooves: a top guide G1 and a bottom guide G2. The top guide G1 is wider on the entry side because of the configuration of the entry guiding surface 42*a*2 and the top entry guiding surface 42*b*2 is formed by the top regulating portion 42*b*, mounting/dismounting assisting portion 42*a* of the auxiliary guide or cover 42, and the moving guide 41, and extends diagonally downward in terms of the process cartridge insertion direction. The bottom guide G2 is wider on the entry side because of the configuration of the bottom guide surface 42*a*3 and the horizontal surface 43*b*2 is formed by the mounting/dismounting assisting portion 42*a*, moving guide 41, and side guide 43*b*, and extends diagonally downward in terms of the cartridge insertion direction.

Referring to FIG. 10, the center bosses 15*a* of the opening/closing cover 15 are on the bottom side of the opening/closing cover 15. Therefore, the opening/closing cover 15 opens downward, causing the backing 16 to face upward toward the opening W. Each of the projections 16*a* of the backing 16 is provided with a loosely guiding surface 16*a*1, which extends diagonally downward in terms of the process cartridge insertion direction.

As described above, the process cartridge B comprises: the pair of positioning guides 18*a*, which are on the both lateral walls of the cartridge frame CF, one for one, and the axial line of which coincides with the rotational axis of the photoconductive drum 7; and the pair of mounting guides 18*b*, which are in the form of a rib, and extend in the direction in which the process cartridge B is mounted or dismounted. The process cartridge B also comprises a pair of projections 10*f*3, which are located on the downwardly facing surface of the toner/developing means holding frame 10*f*, near the lengthwise ends thereof, one for one.

When inserting the process cartridge B through the opening W, the mounting guides 18*b* and positioning guides 18*a* of the process cartridge B are aligned with the top and bottom guides G1 and G2 on the side walls of the opening W, respectively, and the process cartridge B is inserted until the mounting guides 18*b* abut the deepest ends of the guiding grooves 41*a* of the moving guides 41. During this process, the projections 16*a* of the backing 16 regulate the position of the process cartridge B at the opening W, to a certain degree; in other words, they function as rough guides which make it easier for the mounting guides 18*b* and positioning guides 18*a* of the process cartridge B to be guided to the top and bottom guides G1 and G2, respectively. More specifically, a structural arrangement is made so that the distance h1 from the loosely guiding surface 16*a*1 to the highest point of the entry guiding surface 42*a*2 on the opening/closing cover 15 side, and the distance h2 from the downwardly facing surface of the toner/developing means holding frame 10*f* to the intersection between the bottom surface 18*b*1 and end surface 18*b*2 of the mounting guide 18*b*, are set to satisfy the following inequality:

$$h1<h2.$$

Further, another structural arrangement is made so that the distance h3 from the highest point of the entry guiding surface 42*a*2 on the opening/closing cover side to the higher point of the horizontal surface 43*b*2 of the side guide 43*b*, and the distance h4 from the intersection between the bottom surface 18*b*1 and the end surface 18*b*2 of the mounting guide 18*b* to the bottom surface of the positioning guide 18*a*, are set to satisfy the following inequality:

$$h3>h4.$$

Figure 18:
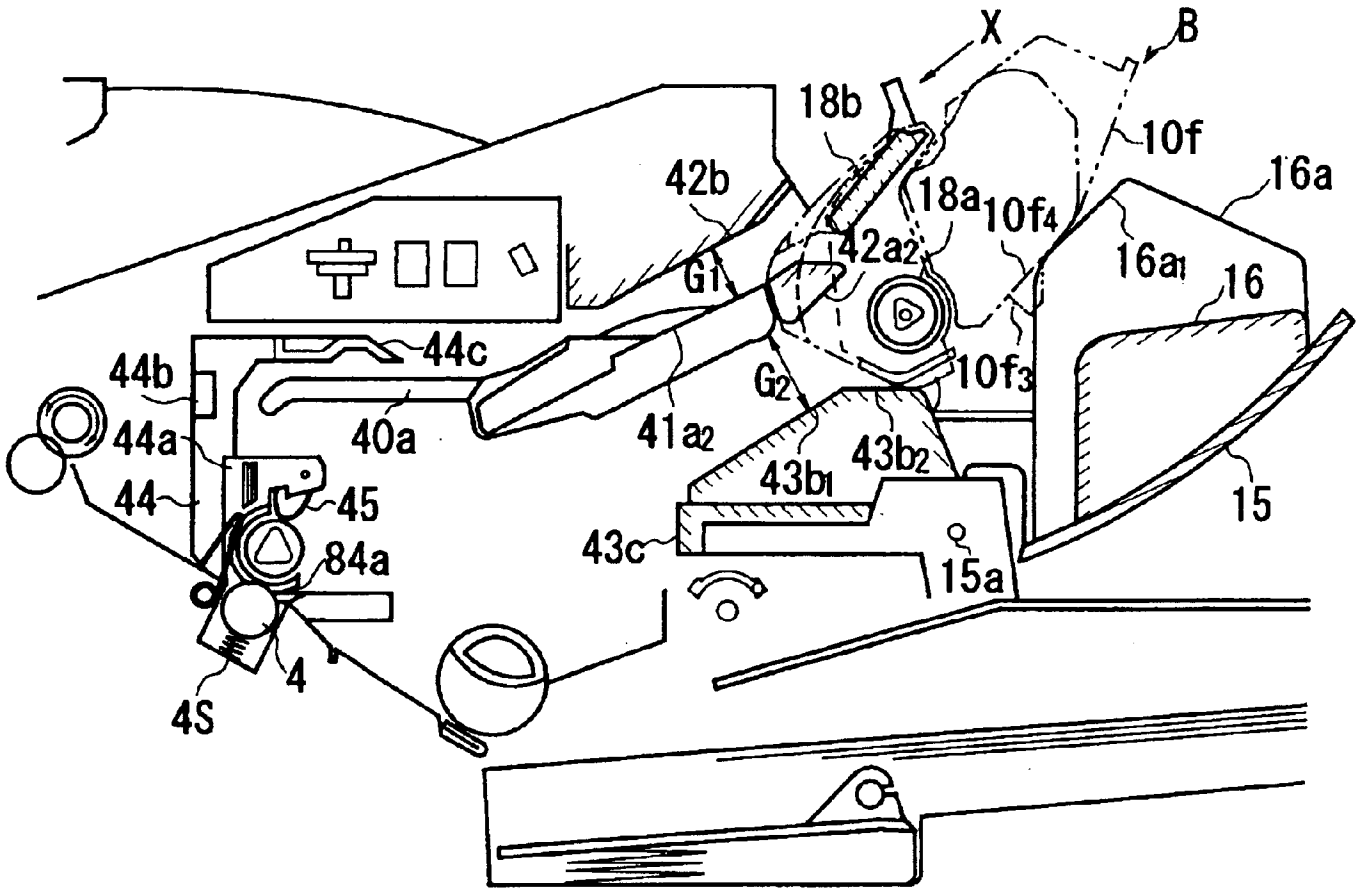
FIG. 18 is an illustration of an inserting operation of the process cartridge into a process cartridge mounting-and-demounting mechanism.

With the provision of these structural arrangements, as the process cartridge B is inserted while making the bottom wall of the toner/developing means holding frame 10*f* follow the loosely guiding surface 16*a*1, that is, the top surface of the projection 16*a*, the mounting guide 18*b* and the positioning guide 18*a* are spontaneously guided to the entrances of the top and bottom guides G1 and G2, respectively, as shown in FIGS. 17 and 18. The position of the process cartridge B in this state is the position from which the process cartridge B is inserted into the apparatus main assembly 14 to mount the process cartridge B into the apparatus main assembly 14, or the position from which the process cartridge B can be picked up by an operator.

Figure 19:
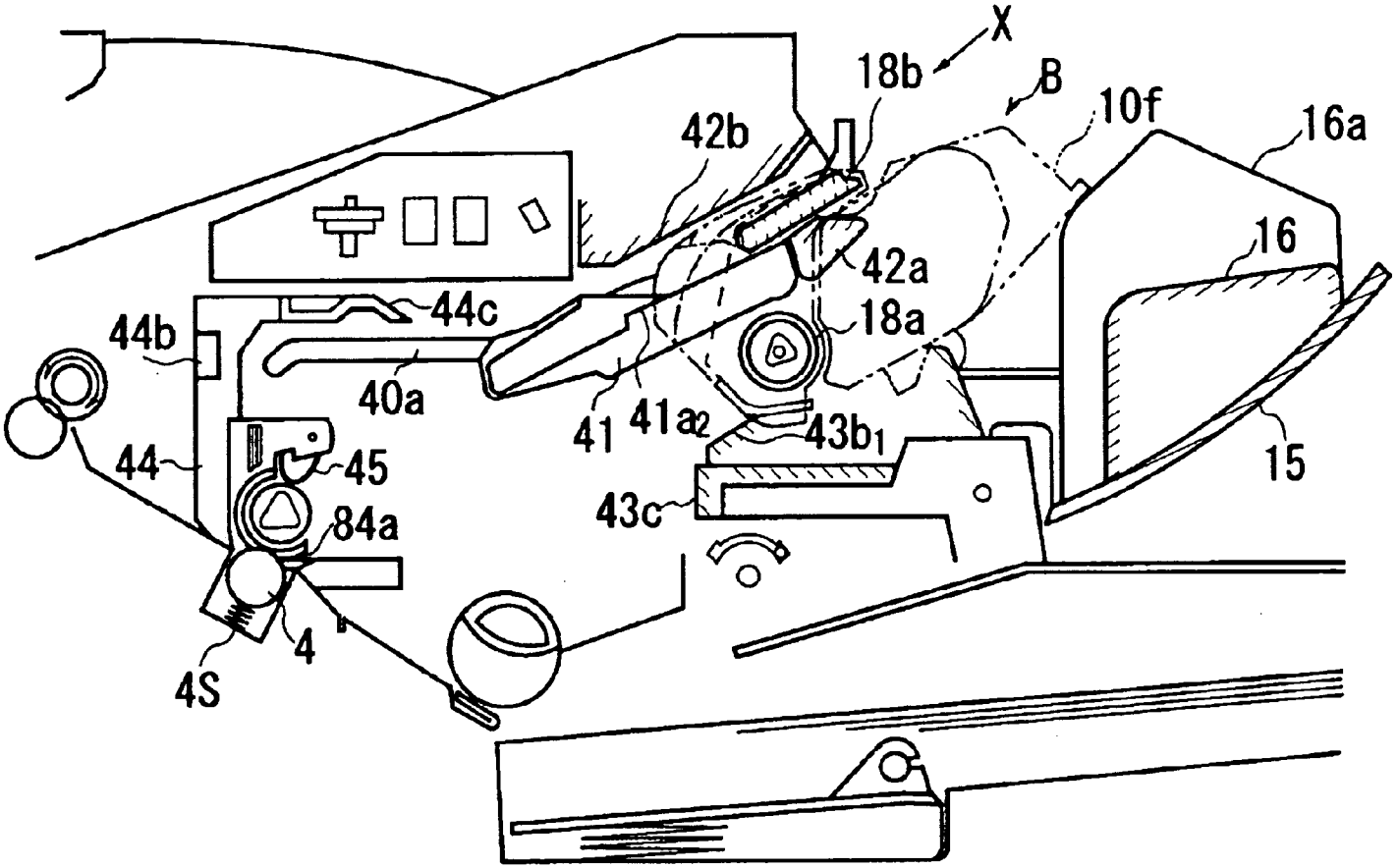
FIG. 19 is an illustration of a process cartridge inserting operation into the process cartridge mounting-and-demounting mechanism.

Referring to FIG. 19, until the mounting guide 18*b* begins to slide onto the guiding surface 41*a*2 of the moving guide 41, the projection 16*a* remains in contact with the trailing end of the toner/developing means holding frame 10*f*, and keeps the process cartridge B tilted downward in terms of the process cartridge insertion direction, making it easier for the process cartridge B to be moved inward of the guiding groove 41*a* of the moving guide 41, by the self-weight of the process cartridge B.

The reason why the projections 16*a* are located near the lengthwise ends of the backing 16, and the center portion is kept low, is to secure a gap large enough for the hand of a user to be easily put through when mounting or dismounting, or when dealing with a paper jam. In other words, the configuration is made to make the opening W, which is exposed as the opening/closing cover 15 is opened, satisfy both the requirement for providing the region for the mounting of the process cartridge B and the requirement for providing the gap for a user to access the interior of the image forming apparatus.

Figure 22:
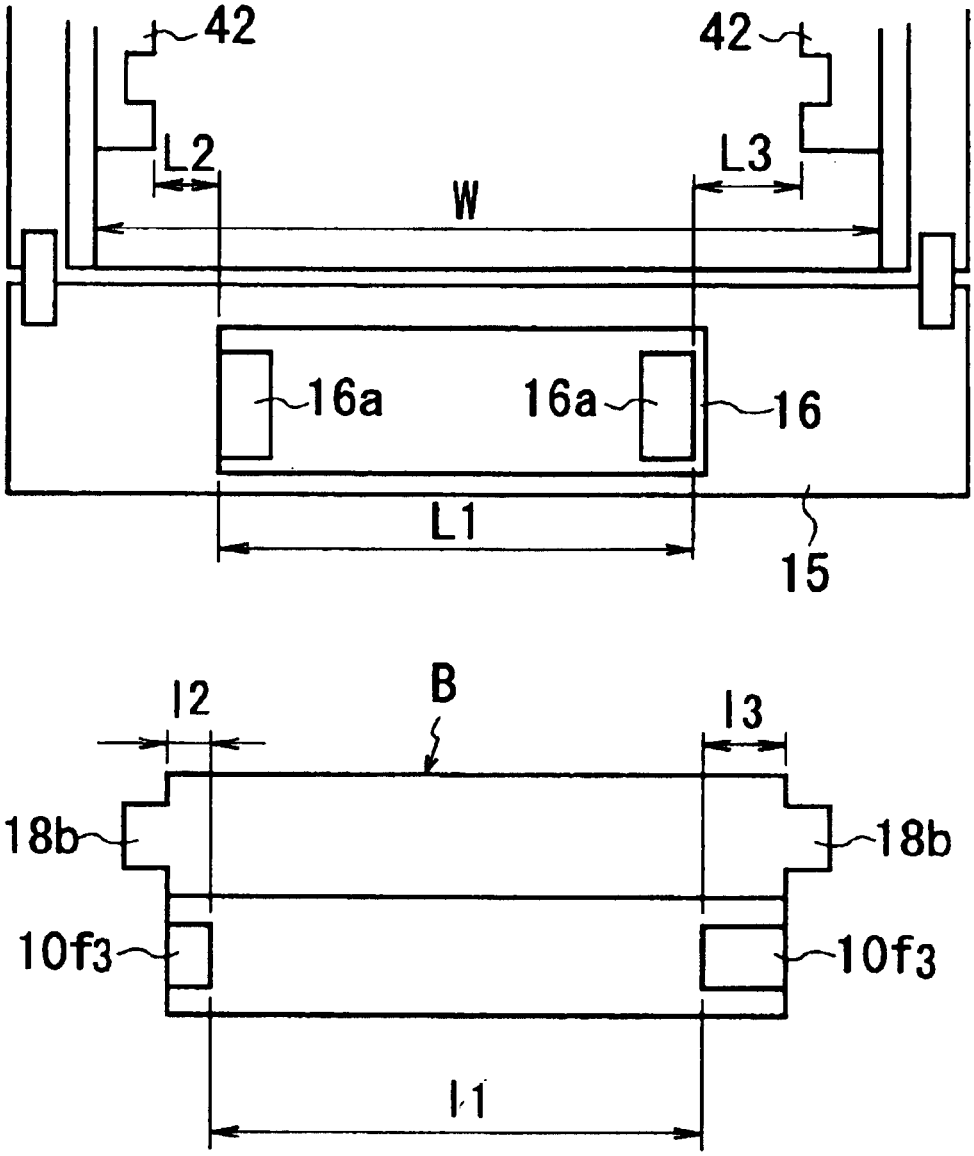
FIG. 22 is an illustration of a positional relation, in the longitudinal direction, of the back cap projection and a projection of the process cartridge at an opening W.

At this time, referring to FIG. 22, the relationship between the projection 16*a* and process cartridge B, at the opening W, in terms of the lengthwise direction of the process cartridge B, will be described.

When the gap between the outward sides of the two projections 16*a* of the backing 16 is denoted by L1; the gap between the outward surface of the left projection 16 and the inward surface of the left auxiliary guide, is denoted by L2; the gap between the outward surface of the right projection 16 and inward surface of the right auxiliary guide is denoted by L3; the gap between the inward sides of the two projections 10*f*3 of the process cartridge B is denoted by l1; the gap between the inward surface of the left projection and the left lateral wall of the cartridge frame CF is denoted by l2; and the gap between the inward surface of the right projection and the lateral wall of the cartridge frame CF is denoted by l3, the following relations are satisfied:

$$L1<l1 \tag{1}$$

$$L2 \doteq l2+(l1-L1)/2+((L1+L2+L3)-(l1+l2+l3))/2 \tag{2}$$

$$L3 \doteq l3+(l1-L1)/2+((L1+L2+L3)-(l1+l2+l3))/2 \tag{3}$$

Thus, since inequality (1) is satisfied, the pair of projections 16*a* located near the lengthwise end of the backing 16 fit between the projections 10*f*3 on the bottom wall of the toner developing means holding frame 10*f*, and from approximations (2) and (3), it is evident that by loosely aligning the projections 10*f*3 with the projections 16*a*, the process cartridge B can be aligned with the opening W in terms of the lengthwise direction of the process cartridge B.

As described above, the front guiding surface, which is the bottom surface of the top guide G1, and the guiding surface 41*a*2, are tilted downward in terms of the process cartridge mounting direction, and the trailing end of the mounting guide 18*b* is extended beyond a point corresponding to the center of the gravity of the process cartridge B. Therefore, as the mounting guides 18*b* and positioning guides 18*a* of the process cartridge B are guided to the top and bottom guides G1 and G2 with the use of projections 16*a* of the backing 16 constructed as described above, the process cartridge B is tilted downward in terms of the process cartridge mounting direction, being automatically guided inward of the moving guide 41 by its own weight.

As will be understood referring to FIG. 19, the inclined surface 43*b*1 of the side guide 43*b*, that is, the bottom surface of the bottom guide G2, is slightly greater in inclination than the guiding surface 41*a*2. Therefore, as the process cartridge B is inserted deeper, the positioning guide 18*a* leaves the inclined surface 43*b*1 of the side guide 43*b*. For this reason, the process cartridge mounting/dismounting mechanism is structured so that as the process cartridge B is inserted through the opening W, the mounting guide 18*b* is caught by the moving guide 41.

Figure 20:
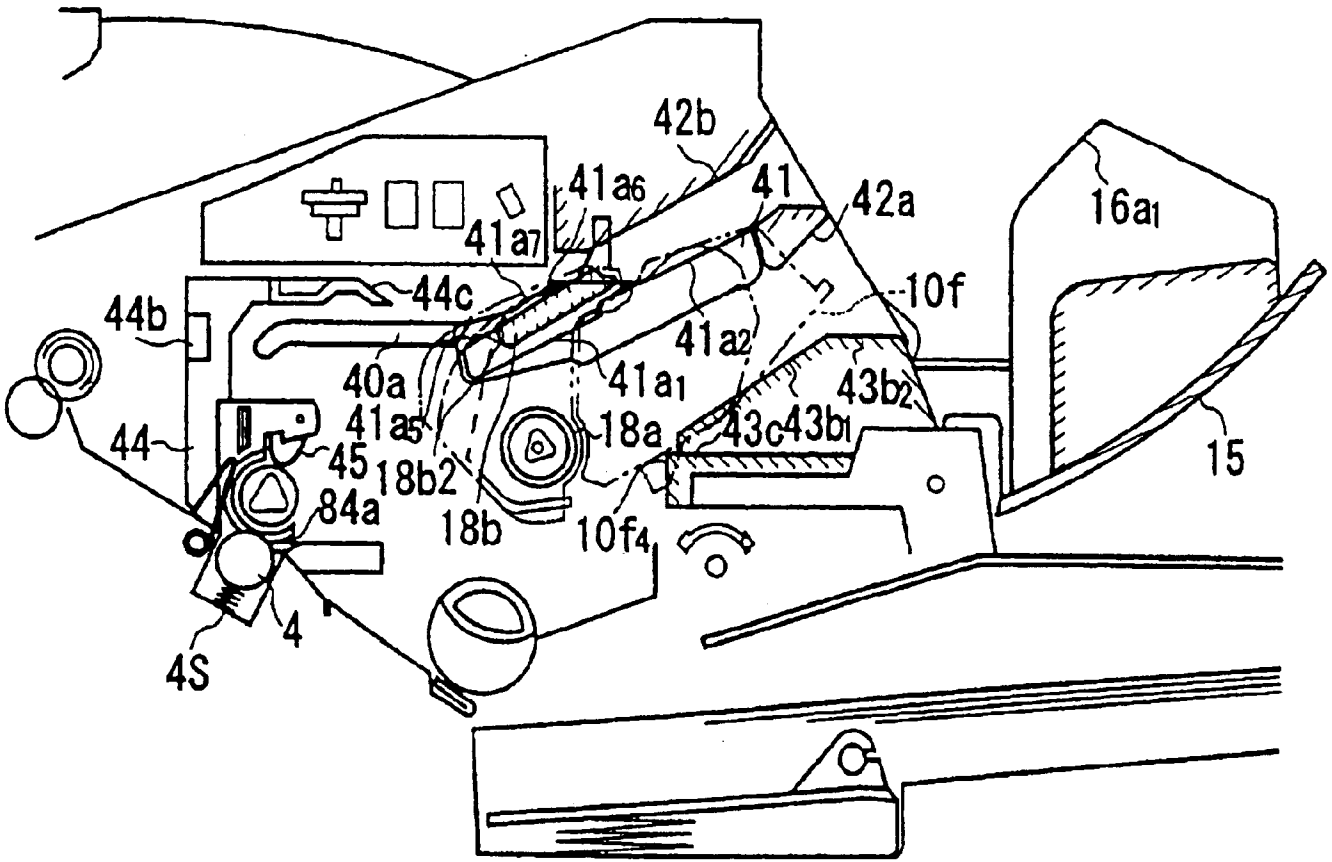
FIG. 20 is an illustration of a process cartridge inserting operation into the process cartridge mounting-and-demounting mechanism.
Figure 21:
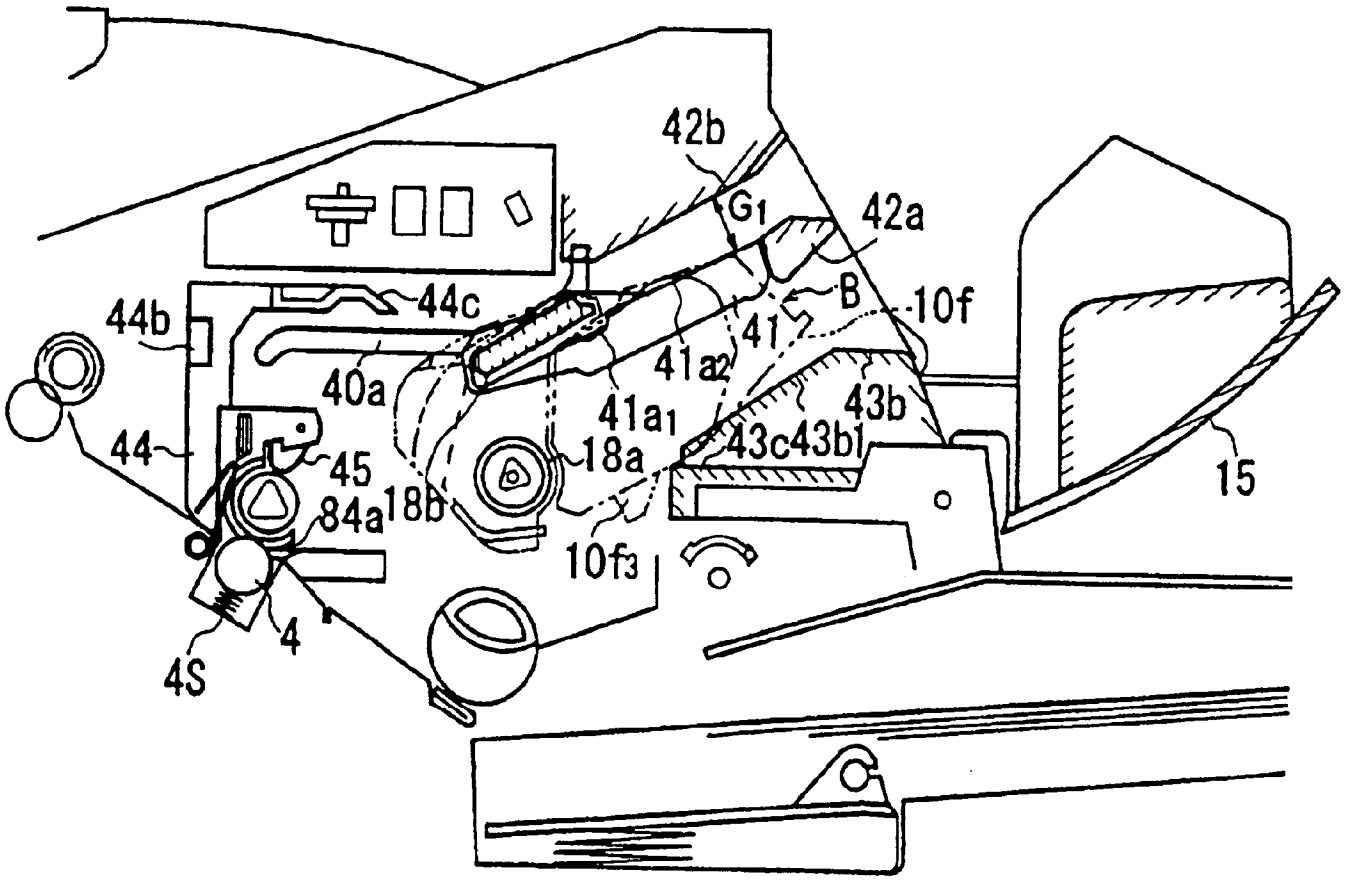
FIG. 21 is an illustration of a process cartridge inserting operation into the process cartridge mounting-and-demounting mechanism.

As the process cartridge B is inserted deeper after being caught by the guiding surface 41*a*2 of the moving guide 41, the end surface 18*b*2 of the mounting guide 18*b* comes into contact with the inclined top surface 41*a*7 of the moving guide 41 (FIG. 20). The end surface 18*b*2 of the mounting guide 18*b* is smooth and arcuate, and the bottom side of the inclined top surface 41*a*7 forms a retaining surface 41*a*1, which is lower than the guiding surface 41*a*2. Therefore, as the process cartridge B is inserted inward of the guiding groove 41*a*, its attitude is changed by the function of the inclined top surface 41*a*7, in the direction to increase its inclination. Consequently, the end surface 18*b*2 of the mounting guide 18*b* comes into contact with the deepest end of the retaining surface 41*a*1, ending the mounting of the process cartridge B into the moving guide 41, as shown in FIG. 21. As is evident from the descriptions given up to this point, when the process cartridge B is mounted into the moving guide 41 by an operator, the process cartridge B is inserted diagonally downward into the apparatus main assembly.

Referring to FIGS. 20 and 21, when the attitude of the process cartridge B is changed in the direction to increase the inclination of the process cartridge B, the end of the contact rib 43*c* of the front guide 43 comes into contact with the bottom surface 10*f*4 of the toner/developing means holding frame 10*f*, and the process cartridge B tilts downward in terms of the process cartridge mounting direction, with the contact rib 43*c* and bottom surface 10*f*4 remaining in contact with each other.

The process cartridge mounting/dismounting mechanism is structured so that after the completion of the insertion of the process cartridge B into the moving guide 41, the contact point between the bottom surface 10*f*4 of the toner/developing means holding frame 10*f* and the contact rib 43*c* will be on the trailing side with respect to the center of gravity of the process cartridge B in terms of the process cartridge mounting direction. Therefore, at the completion of the process cartridge B insertion into the moving guide 41, the process cartridge B assumes such an attitude that the toner/developing means holding frame 10*f* side of the process cartridge B, that is, the side which becomes the trailing side in terms of the process cartridge mounting direction, has been lifted. Thus, after being inserted through the opening W, the process cartridge is supported in such a manner that the bottom side of the end surface 18*b*2 of the mounting guide 18*b* is supported by the deeper end of the retaining surface 41*a*1 of the guiding groove 41*a*, and the bottom surface 10*f*4 of the toner/developing means holding frame 10*f* is supported by the contact rib 43*c* of the front guide 43, as shown in FIG. 21. For this reason, the bottom corner 18*b*3 of the trailing end of the mounting guide 18*b* has been lifted, 18*b*3 also being used to denote the trailing end of the mounting guide 18*b*. The contact rib 43*c* is structured so that the bottom corner 18*b*3 of the trailing end of the mounting guide 18*b* will become level with the guiding surface 41*a*2 of the moving guide 41.

At this time, the inclination of the guiding surface 41*a*2 will be described.

If the inclination of the guiding surface 41*a*2 is too gentle, it is impossible for the process cartridge B to be guided inward of the moving guide 41 by its own weight, and therefore, the process cartridge B must be pushed inward by a user. On the contrary, if the inclination of the guiding surface 41*a*2 is too steep, the process cartridge B slides down too fast into the apparatus main assembly as it is released by a user during the process cartridge B insertion. As a result, it is possible for the impact, to which the process cartridge B is subjected as it reaches the deepest end of the moving guide 41, to become large enough to damage the process cartridge B and/or the image forming apparatus main assembly 14. Therefore, the inclination of the guiding surface 41*a*2 is desired to be in a range of 15 to 50 deg. relative to a horizontal direction. In this embodiment, the inclination of the guiding surface 41*a*2 is set to approximately 26 deg. relative to a horizontal direction.

As described previously, the process cartridge B is inserted into the moving guide 41, from the point (first location) at which the guiding surface 41*a*2 of the guiding groove 41*a* connects to the front guide surface 42*a*1 of the auxiliary guide 42. The moving guide 41 assumes such an attitude (first attitude) that it tilts downward in terms of the process cartridge mounting direction, that is, such an attitude that when the process cartridge B is at the point beyond which the process cartridge B is mounted into the moving guide 41, that is, the point at which the guiding surface 41*a*2 is contiguous with the front guiding surface 42*a*1, the direction X in which the process cartridge B is mounted into the guiding groove 41*a* intersects with the direction in which the recording medium 2 is conveyed by the conveying means. This is for the following reason. That is, as will be understood from FIG. 27, the process cartridge mounting/dismounting mechanism is structured so that when the opening/closing cover 15 is fully open, the second boss 41*c* of the moving guide 41 will be at the end of the straight portion (groove hole) 50*b*2 of the cam hole 50*b*, and the first boss 41*b* will be at the end of the first guide rail 40*a* on the opening/closing cover 15 side.

In this embodiment, the moving guide 41 of the process cartridge mounting/dismounting mechanism is structured so that its movement is linked to the opening or closing movement of the opening/closing cover 15. Thus, if the moving guide 41 is structured so that the trailing end (end on the cover side) of the moving guide 41 can be pushed by the process cartridge B, the moving guide 41 escapes into the interior of the image forming apparatus, making it impossible to engage the mounting guide 18*b* of the process cartridge B into the guiding groove 41*a* of the moving guide 41. Therefore, in this embodiment, the auxiliary guide 42 having the mounting/dismounting assisting portion 42*a* contiguous with the trailing end of the moving guide 41 is provided, being fixed to the inner guide 40, on the upstream side of the moving guide 41 in terms of the direction X in which the process cartridge B is mounted. The above described problem is solved by this auxiliary guide 42; it is assured that the mounting guide 18*b* of the process cartridge B is guided to the guiding groove 41*a* of the moving guide 41.

Further, the process cartridge mounting/dismounting mechanism is structured so that the process cartridge B is mounted into the moving guide 41, the movement of which is linked to the opening or closing movement of the opening/closing cover 15. Therefore, when the opening/closing cover 15 has been partially closed, the moving guide 41 has moved inward of the image forming apparatus, and therefore, a gap has been created between the moving guide 41 and the mounting/dismounting assisting portion 42*a* of the auxiliary guide 42. When the opening/closing cover 15 has been only slightly closed, and therefore, the above described gap is small enough for the mounting guide 18*b* to easily slide over from the mounting/dismounting assisting portion 42*a* to the moving guide 41, the process cartridge B can be mounted. However, as this gap widens to a certain extent, it becomes impossible for the mounting guide 18*b* of the process cartridge B to be engaged into the guiding groove 41*a* of the moving guide 41. Further, as the gap becomes even wider, it is conceivable that the mounting guide 18*b* will slip into the wrong space in the image forming apparatus through this gap.

Thus, in this embodiment, the backing 16 is provided with the projections 16*a* to prevent the process cartridge B from being inserted when the opening/closing cover 15 has been partially closed.

Figure 23:
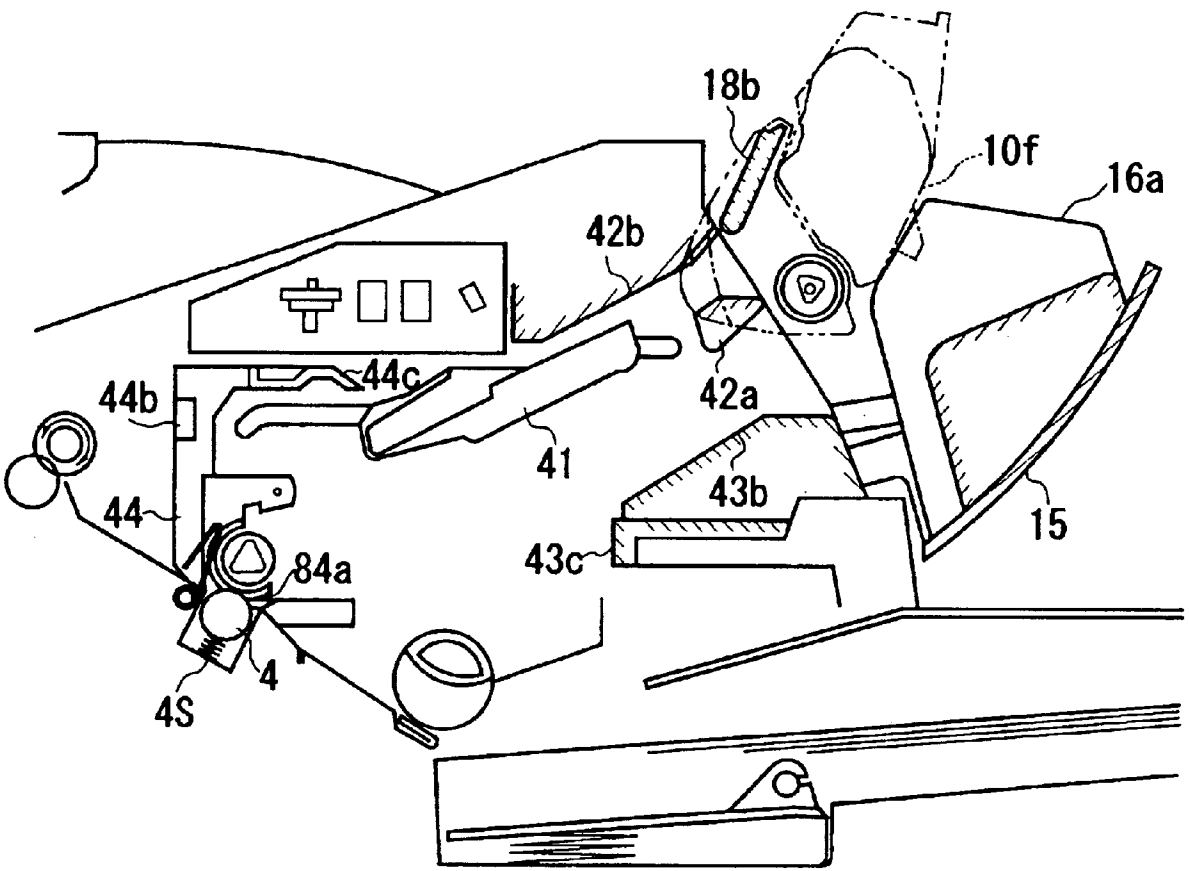
FIG. 23 is an illustration of an obstruction against insertion of the process cartridge into the process cartridge mounting-and-demounting mechanism in the process of opening and closing of the cover.

In other words, when the opening/closing cover 15 has been closed by a substantial angle, the projection 16*a* of the backing 16 has come closer to the top regulating portion 42*b*, making the space between the projection 16*a* and the top regulating portion 42*b* too small for the insertion of the process cartridge B, as shown in FIG. 23.

Figure 24:
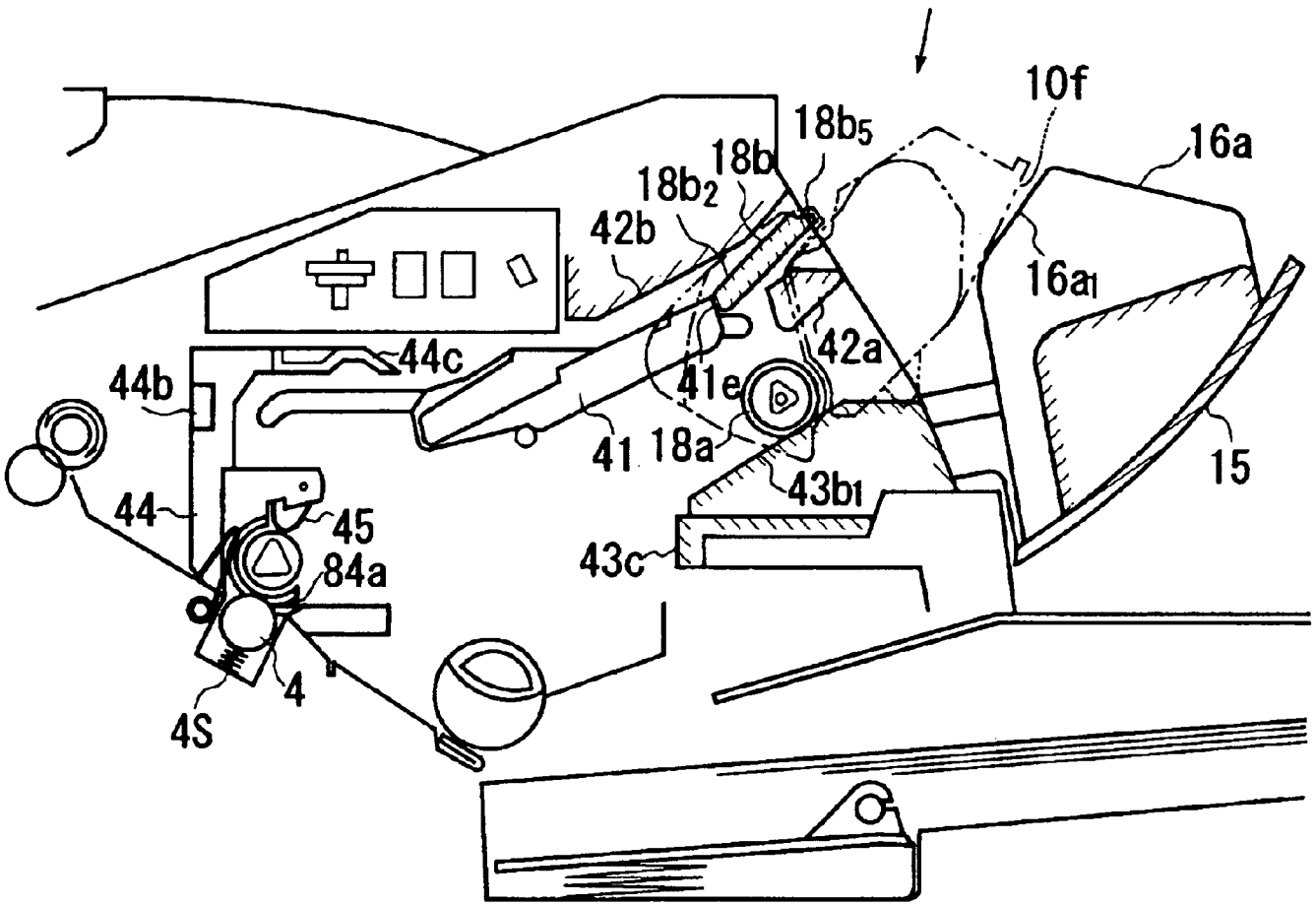
FIG. 24 is an illustration of an obstruction against insertion of the process cartridge into the process cartridge mounting-and-demounting mechanism in the process of opening and closing of the cover.

Referring to FIG. 24, when the opening/closing cover 15 has been partially closed, but the process cartridge B is still insertable, the projection 16 has been made to intrude into the normal path through which the process cartridge B is mounted or dismounted, and also the inclination of the loosely guiding surface 16*a*1 of the backing 16 relative to the horizontal direction has been increased, by the rotation of the opening/closing cover 15. Therefore, it has become impossible for the process cartridge B to be inserted, unless the process cartridge B is inserted at an angle steeper than the normal angle.

When the opening/closing cover 15 has been partially closed, the guiding surface 41*a*2 of the moving guide 41 is uncontiguous with the front guiding surface 42*a*1 of the auxiliary cover 42. Thus, if the process cartridge B is inserted into the apparatus main assembly, in this condition, at a steeper angle than the normal angle, in a manner to make the bottom surface of the process cartridge B follow the loosely guiding surface 16*a*1 of the projection 16*a*, the leading end surface 18*b*2 of the mounting guide 18*b* comes into contact with the trailing end 41*e* of the moving guide 41. At this moment, the positioning guide 18*a* contacts the inclined surface 43*b* 1 of the side guide 43*b*, and the bottom surface of the toner/developing means holding frame 10*f* contacts the projection 16*a* of the backing 16. As a result, the process cartridge B is regulated in its attitude.

Figure 25:
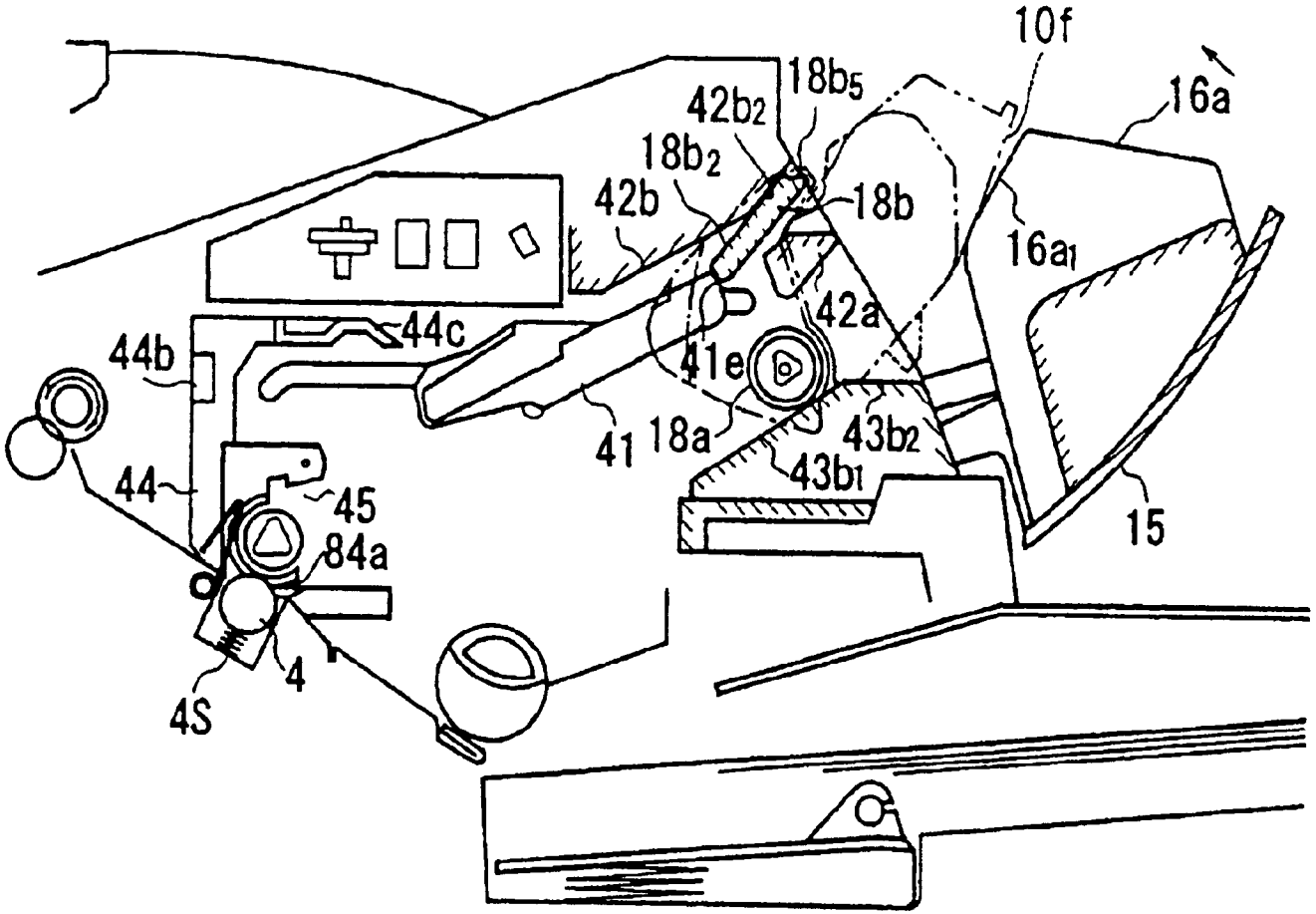
FIG. 25 is an illustration of an obstruction against insertion of the process cartridge into the process cartridge mounting-and-demounting mechanism in the process of opening and closing of the cover.

As the opening/closing cover 15 is further closed from the position at which there are three (six) contacts, that is, the leading end 18*b*2 of the mounting guide 18*b* is in contact with the trailing end 41*e* of the moving guide 41; the positioning guide 18*a* is in contact with the inclined surface 43*b*1 of the side guide 43*b*; and the bottom surface of the toner/developing means holding frame 10*f* is in contact with the projection 16*a*, the moving guide 41 moves inward of the image forming apparatus, and the projection 16*a* of the backing 16 rotates upward. As a result, the process cartridge B is caused to rotate counterclockwise. Consequently, the corner of the mounting guide 18*b*, at which trailing end of the top surface of the mounting guide 18*b* connects to the perpendicular surface 18*b*5 of the mounting guide 18*b*, comes into contact with the top entry guiding surface 42*b*2 of the auxiliary guide 42, preventing the opening/closing cover 15 from being closed further (FIG. 25). In other words, when the process cartridge B is inserted into the apparatus main assembly, the opening/closing cover 15 of which has been partially closed, the opening/closing cover 15 cannot be closed, preventing the problem that the process cartridge B is improperly mounted into the apparatus main assembly.

Incidentally, even after the process cartridge B has been inserted into the apparatus main assembly, the opening/closing cover 15 of which has been partially closed, and the process cartridge B has become immovable, the process cartridge B can be pulled out of the apparatus main assembly, by rotating the opening/closing cover 15 in the opening direction. More specifically, as the opening/closing cover 15 is rotated in the opening direction, the moving guide 41 moves toward the opening W, and pushes the leading end 18*b*2 of the mounting guide 18*b*, forcing the process cartridge B outward. Then, as the opening/closing cover 15 is opened further, the aforementioned gap between the guiding surface 41*a*1 of the moving guide 41 and the front guiding surface 42*a*1 of the auxiliary guide 42 becomes smaller, and the mounting guide 18*b* moves across the gap, and settles in the guiding groove 41*a*, becoming ready for the mounting of the process cartridge B.

(Description of Movement of Process Cartridge Mounting/Dismounting Mechanism)

(Moving Guide Movement Linked to Opening/Closing Cover Movement)

Figure 26:
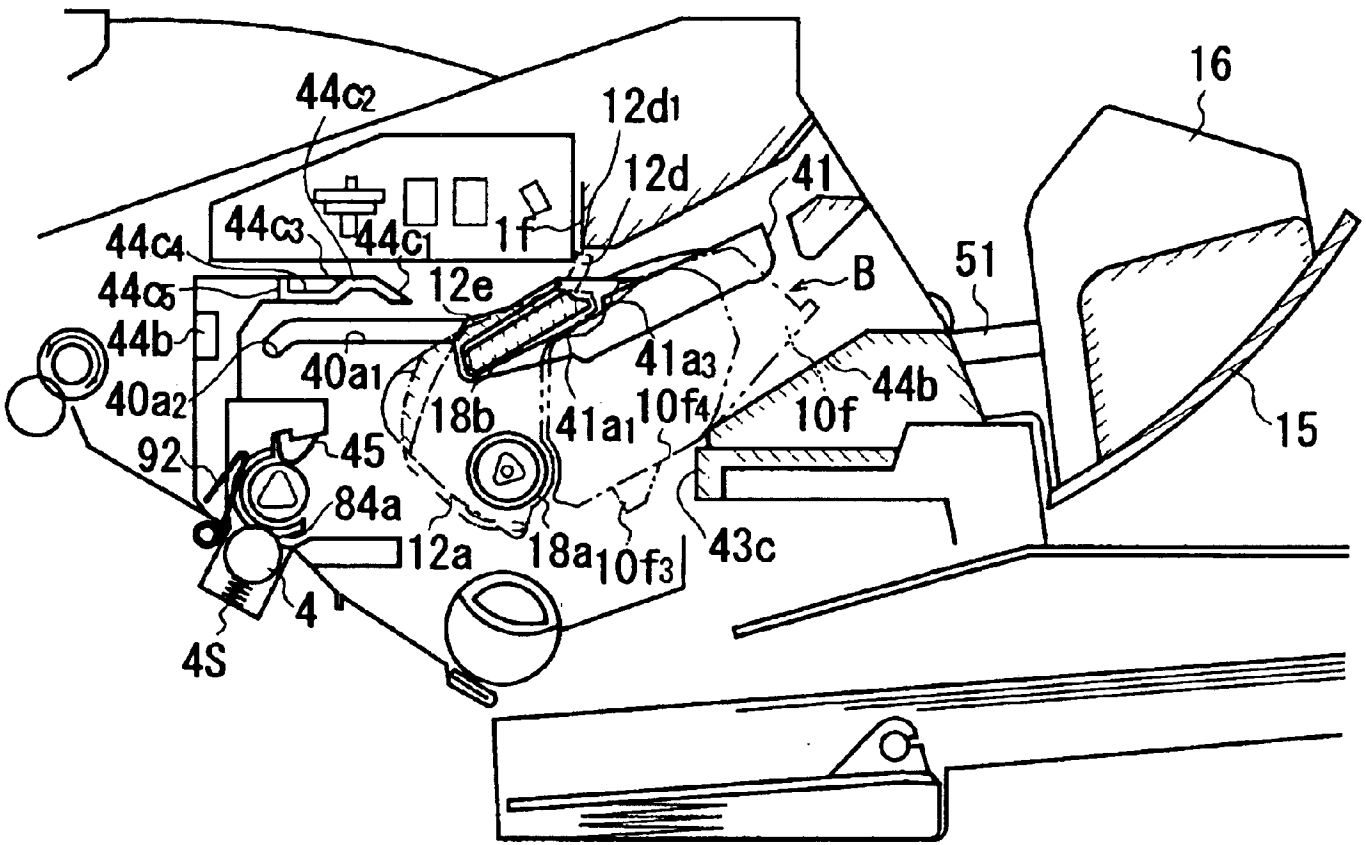
FIG. 26 is an illustration of a process cartridge inserting operation into the mounting-and-demounting mechanism of the process cartridge, more particularly an illustration of the motion of the process cartridge, at the righthand side inner plate in the image forming apparatus.
Figure 28:
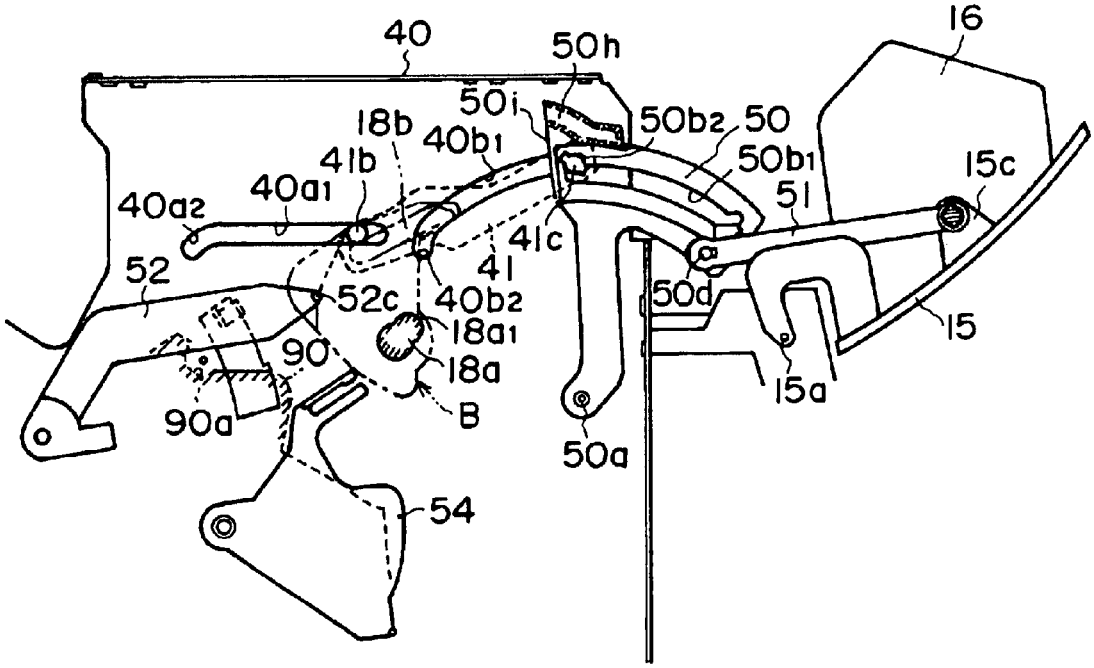
FIG. 28 is an illustration of a process cartridge inserting operation into the process cartridge mounting-and-demounting mechanism, at the left-hand side inner plate in the image forming apparatus, as seen at the same timing as with FIG. 26.
Figure 32:
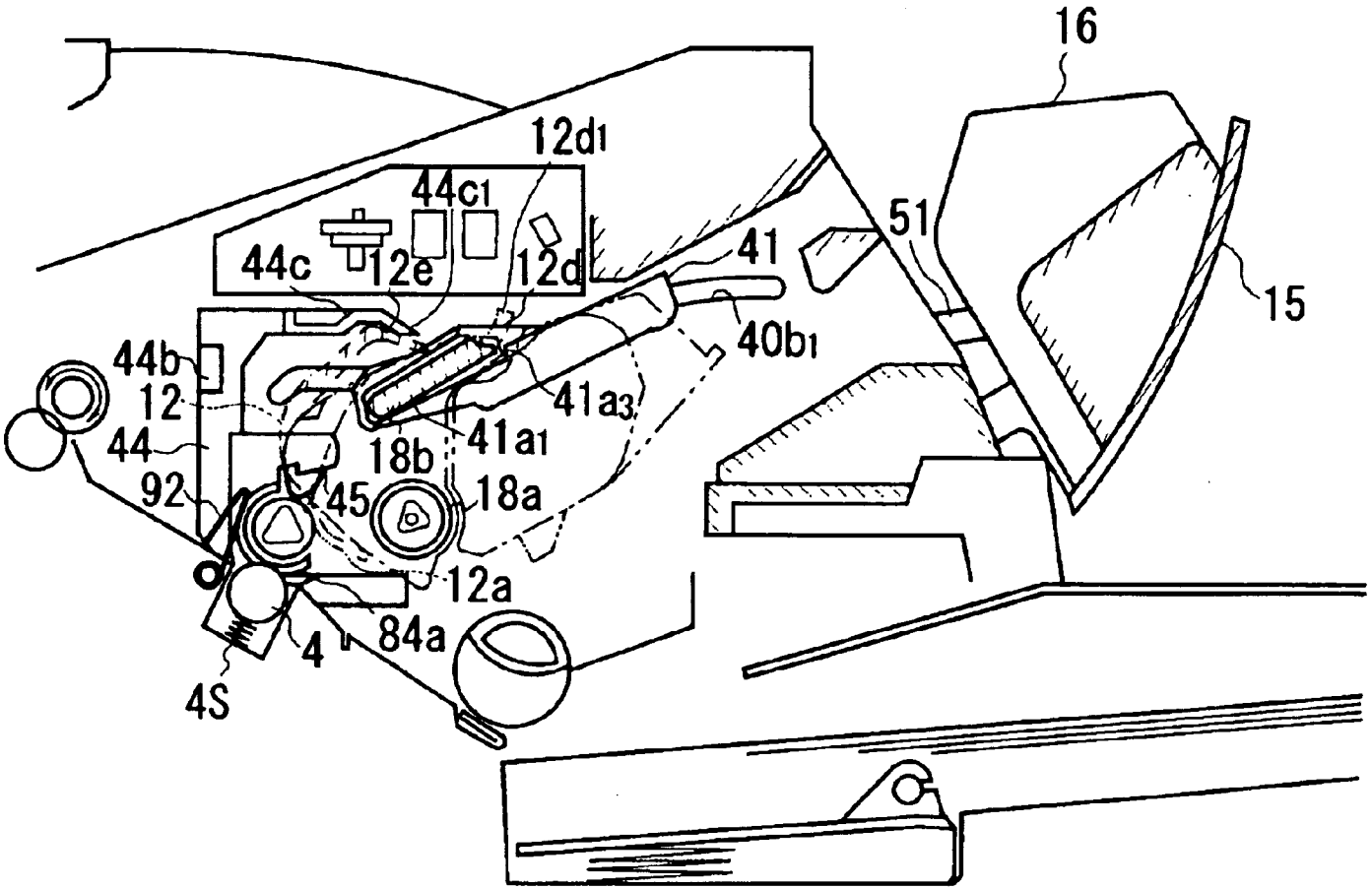
FIG. 32 is an illustration of a process cartridge inserting operation into the mounting-and-demounting mechanism of the process cartridge, more particularly an illustration of the motion of the process cartridge, at the righthand side inner plate in the image forming apparatus.
Figure 33:
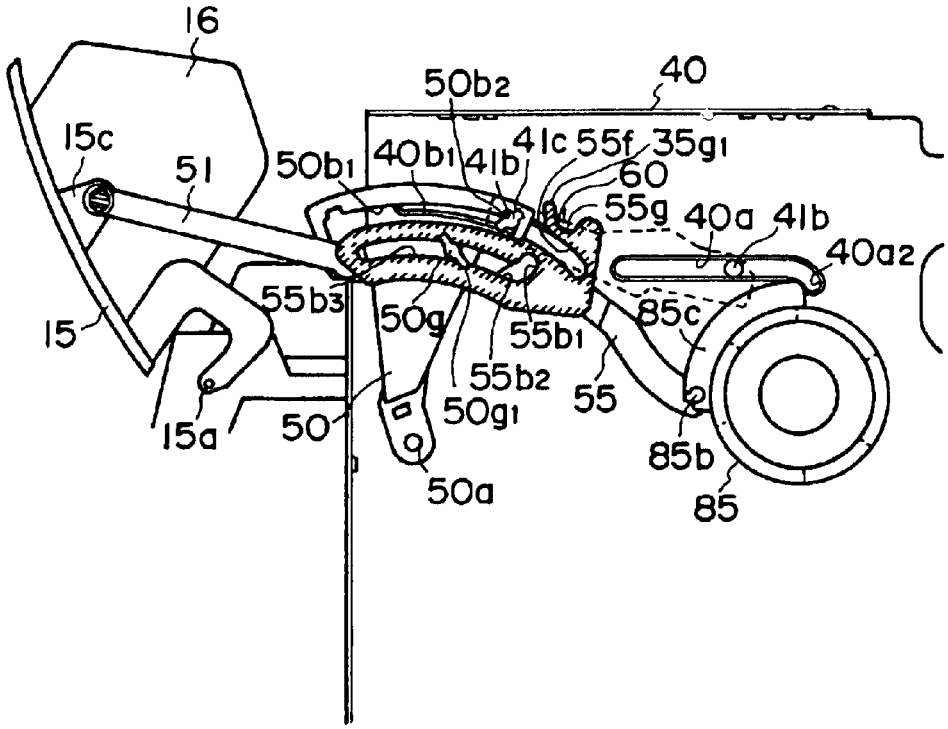
FIG. 33 is an illustration of a process cartridge inserting operation into the process cartridge mounting-and-demounting mechanism, at the righthand side inner plate in the image forming apparatus, as seen at the same timing as with FIG. 32.
Figure 34:
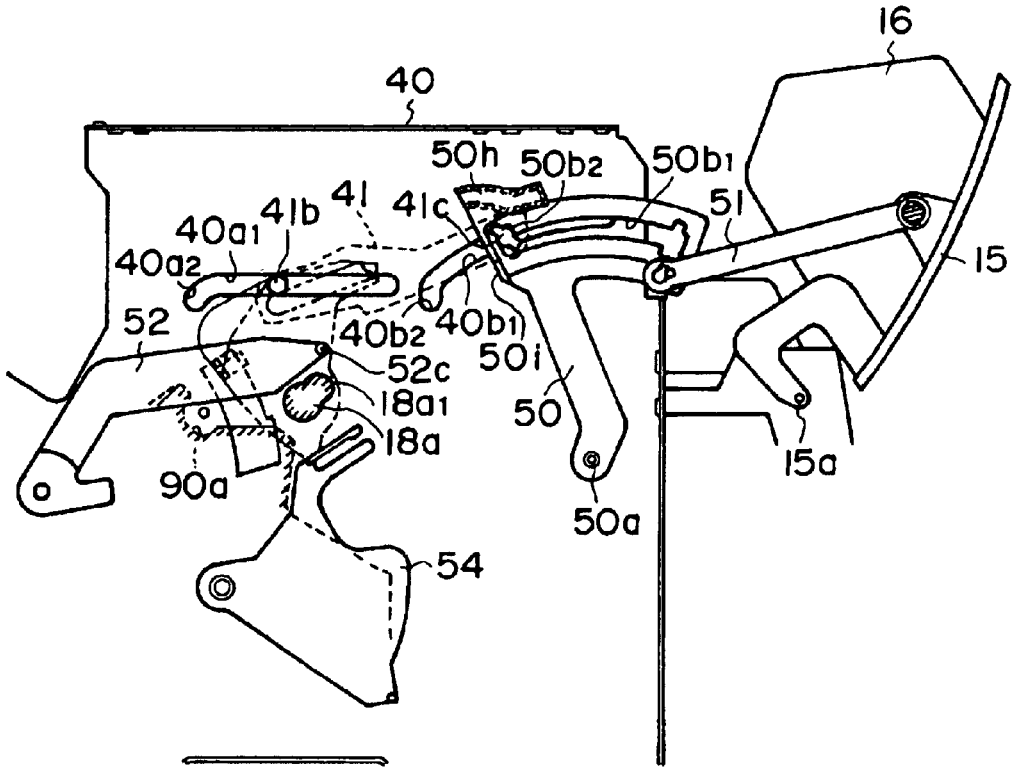
FIG. 34 is an illustration of a process cartridge inserting operation into the process cartridge mounting-and-demounting mechanism, at the left hand side inner plate in the image forming apparatus, as seen at the same timing as with FIG. 32.
Figure 35:
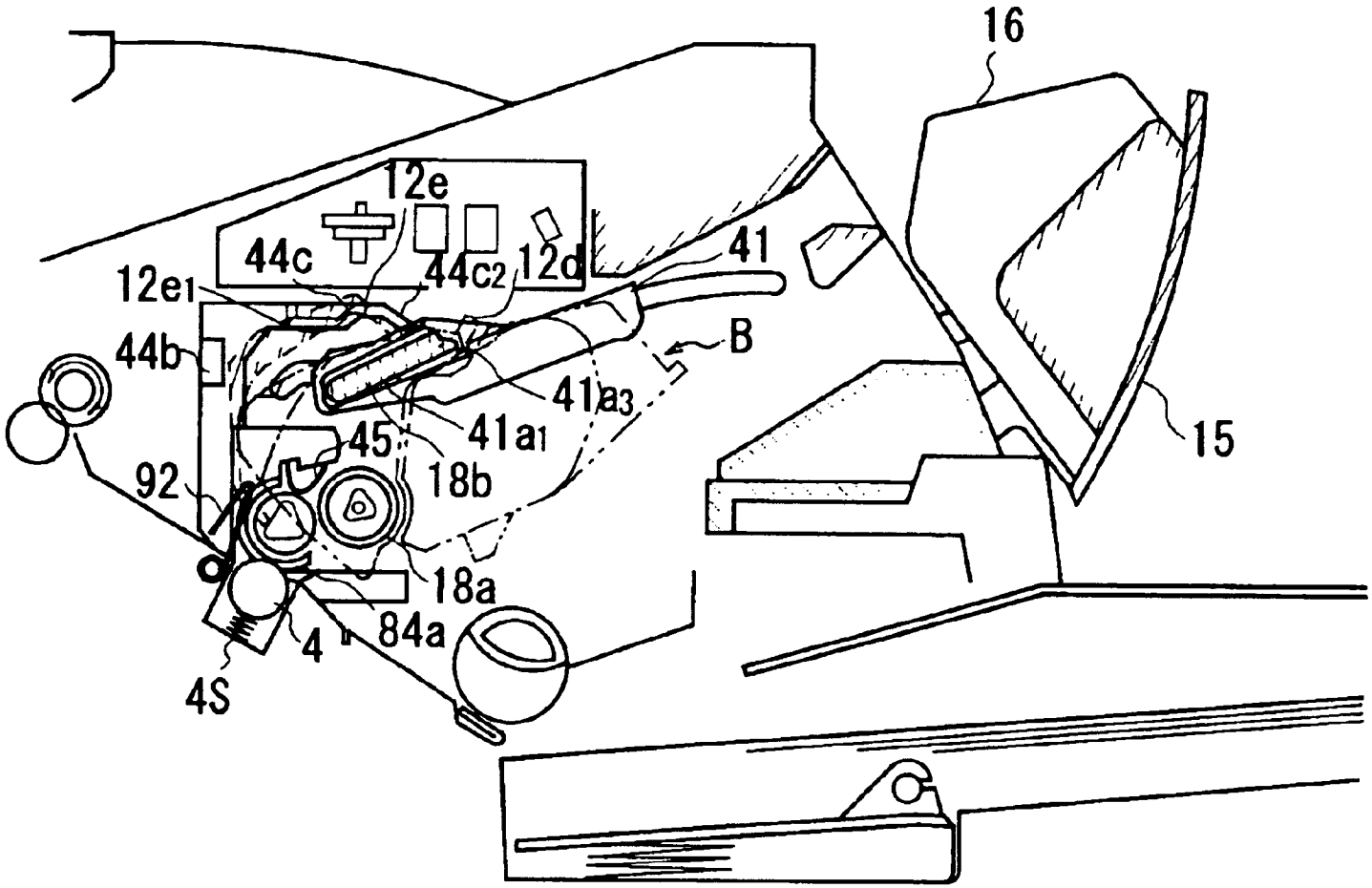
FIG. 35 is an illustration of a process cartridge inserting operation into the mounting-and-demounting mechanism of the process cartridge, and more particularly an illustration of the motion of the process cartridge, at the righthand side inner plate in the image forming apparatus.
Figure 36:
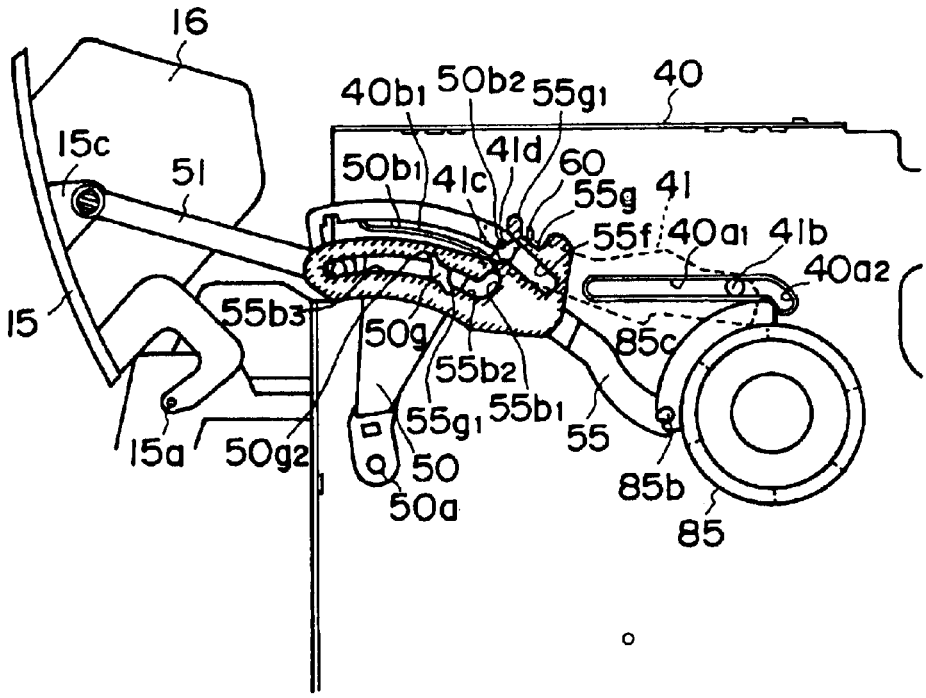
FIG. 36 is an illustration of a process cartridge inserting operation into the process cartridge mounting-and-demounting mechanism, at the righthand side inner plate in the image forming apparatus, as seen at the same timing as with FIG. 35.
Figure 37:
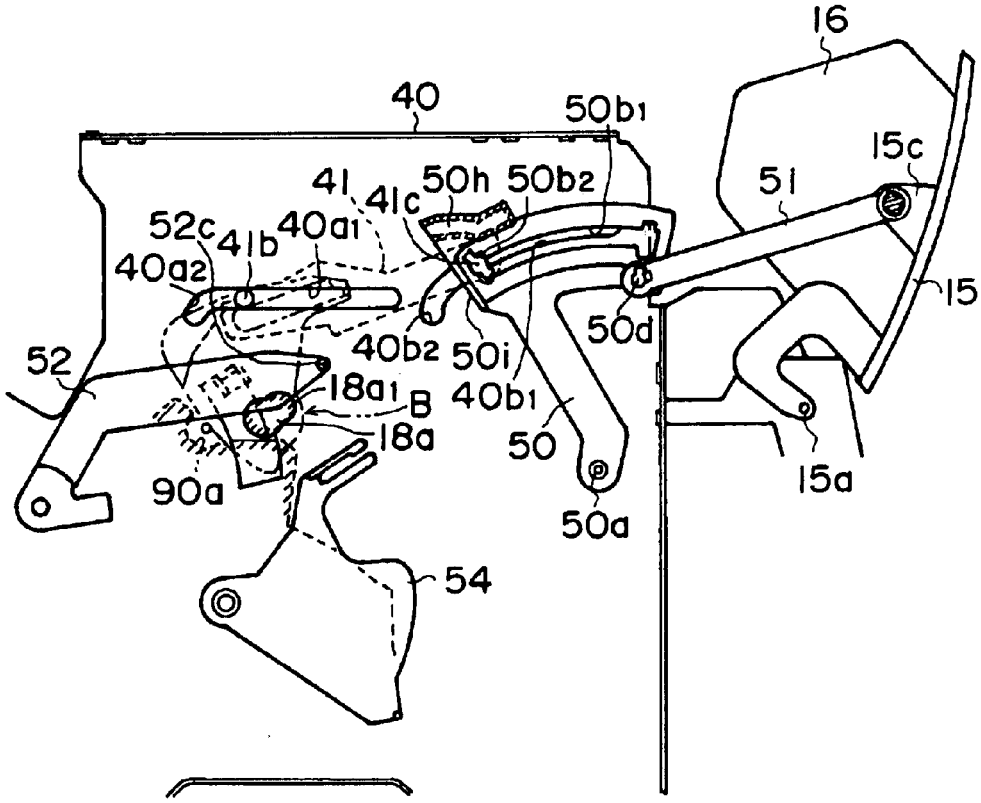
FIG. 37 is an illustration of a process cartridge inserting operation into the process cartridge mounting-and-demounting mechanism, at the left hand side inner plate in the image forming apparatus, as seen at the same timing as with FIG. 35.
Figure 38:
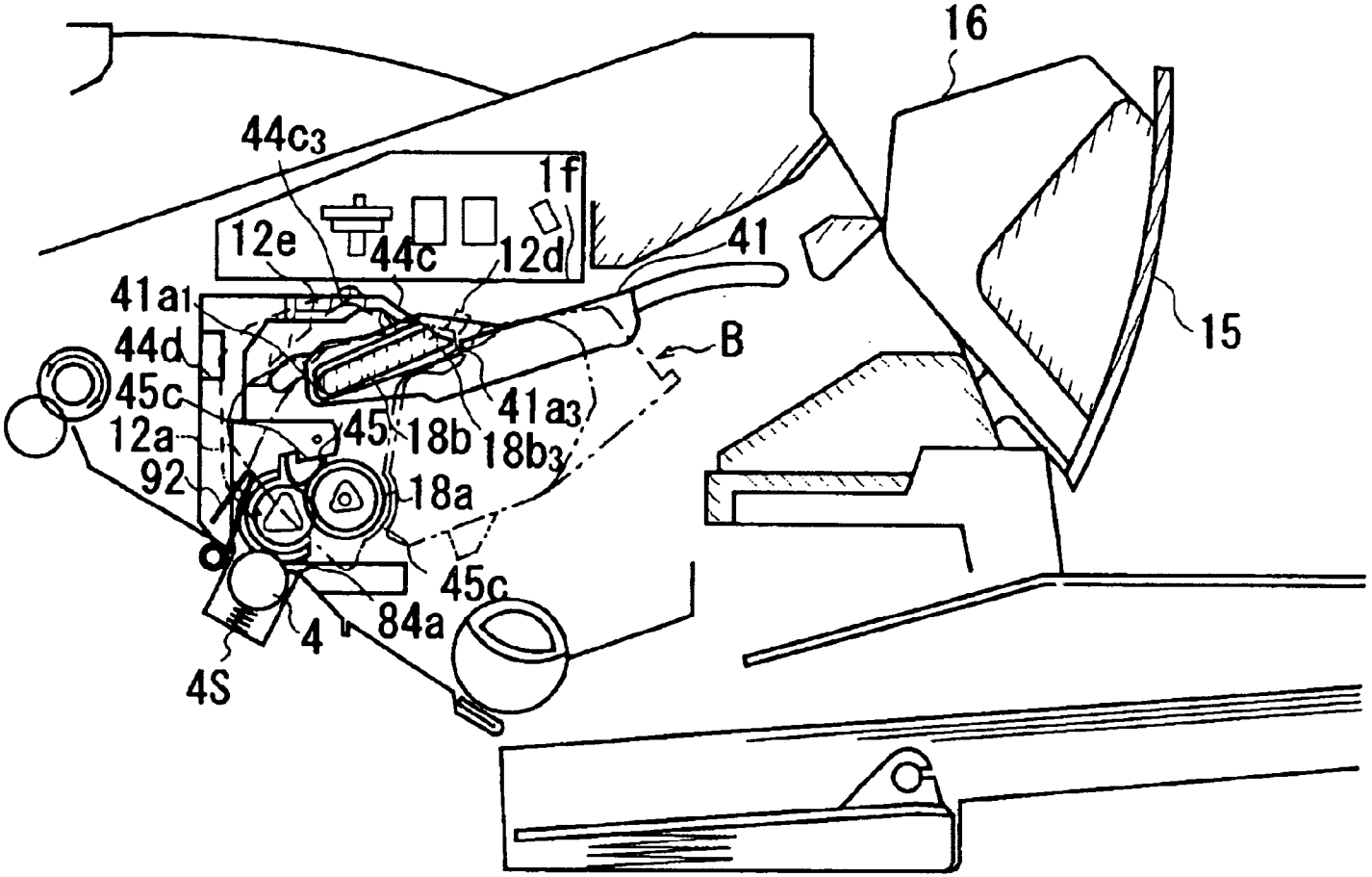
FIG. 38 is an illustration of a process cartridge inserting operation into the mounting-and-demounting mechanism of the process cartridge, and more particularly an illustration of the motion of the process cartridge, at the righthand side inner plate in the image forming apparatus.
Figure 39:
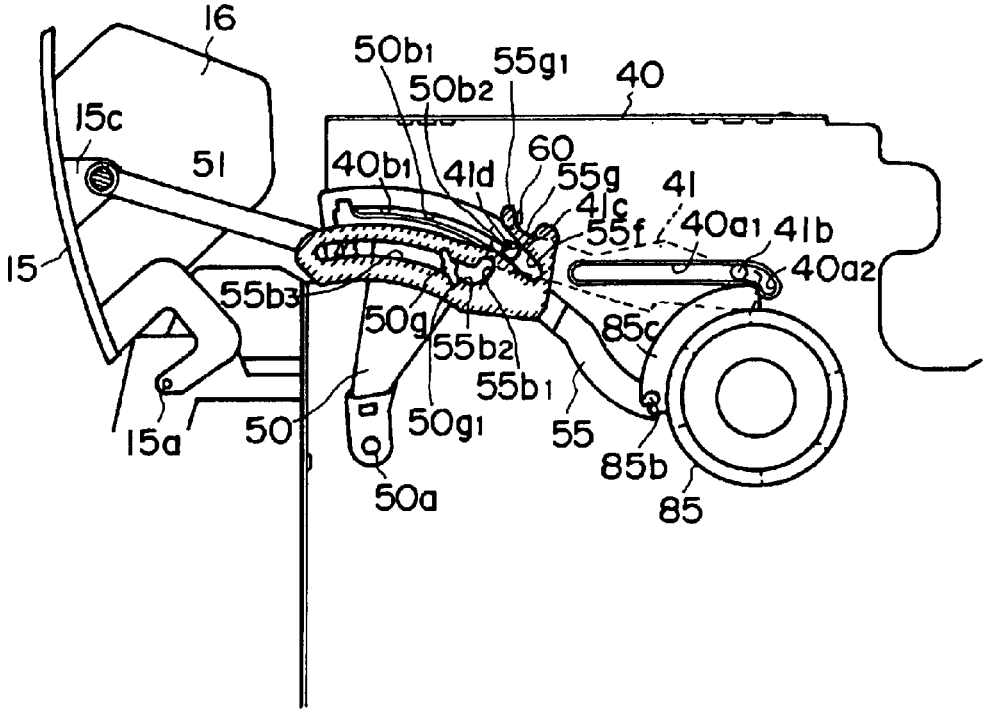
FIG. 39 is an illustration of a process cartridge inserting operation into the process cartridge mounting-and-demounting mechanism, at the righthand side inner plate in the image forming apparatus, as seen at the same timing as with FIG. 38.
Figure 40:
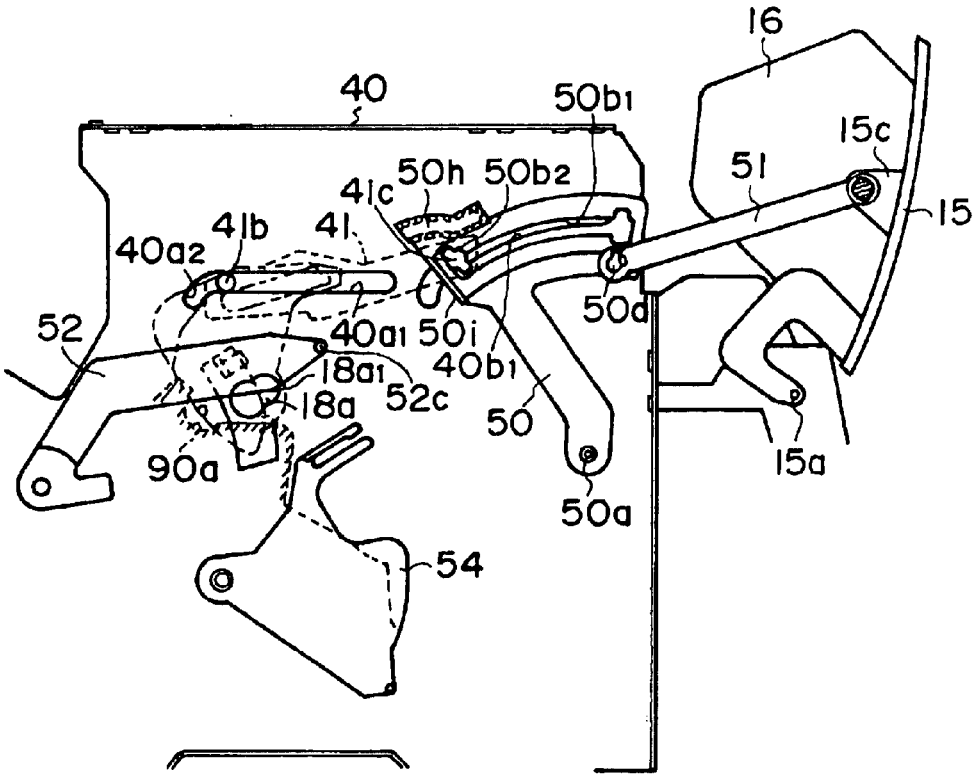
FIG. 40 is an illustration of a process cartridge inserting operation into the process cartridge mounting-and-demounting mechanism, at the left hand side inner plate in the image forming apparatus, as seen at the same timing as with FIG. 38.
Figure 41:
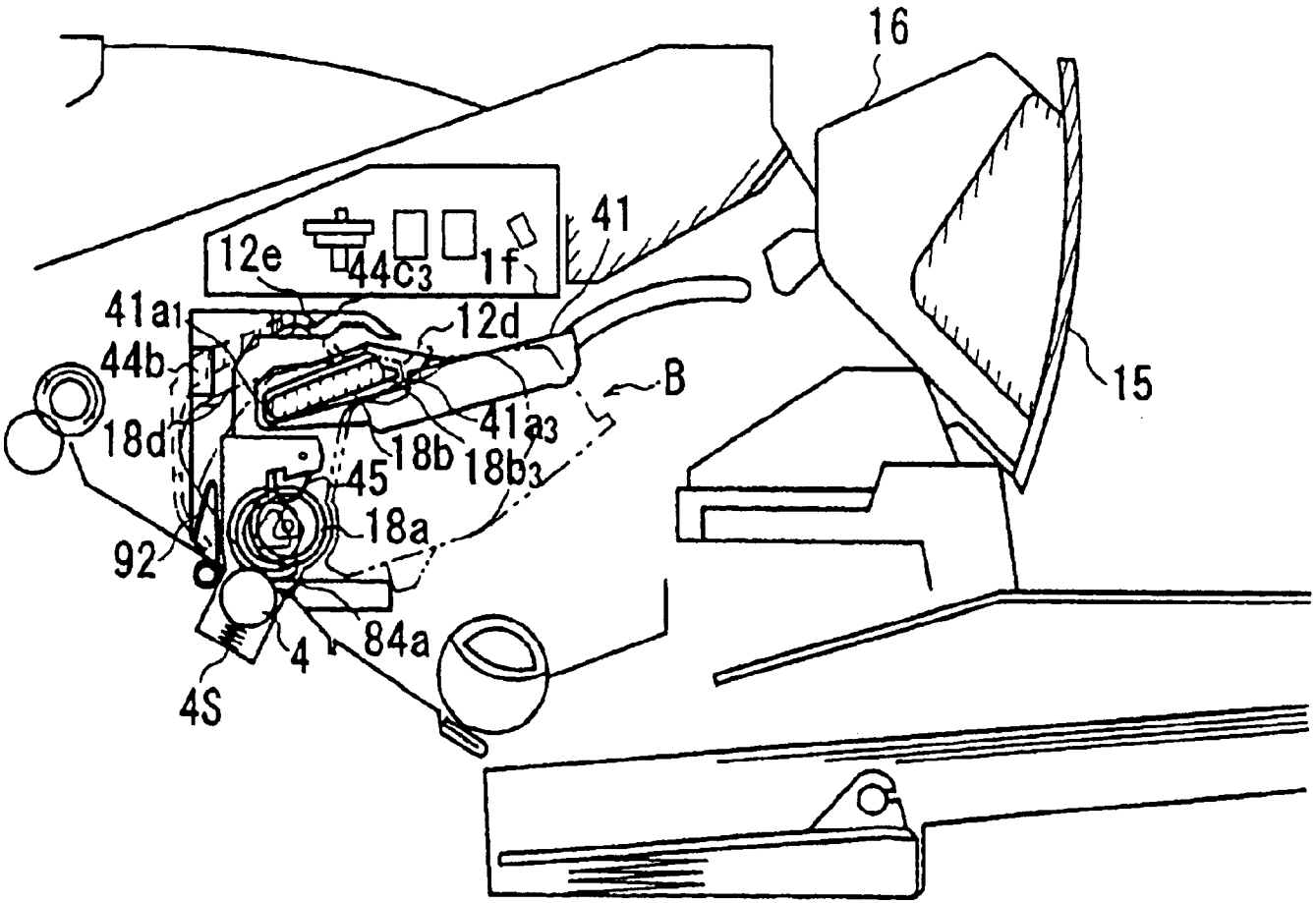
FIG. 41 is an illustration of a process cartridge inserting operation into the mounting-and-demounting mechanism of the process cartridge, and more particularly an illustration of the motion of the process cartridge, at the righthand side inner plate in the image forming apparatus.
Figure 42:
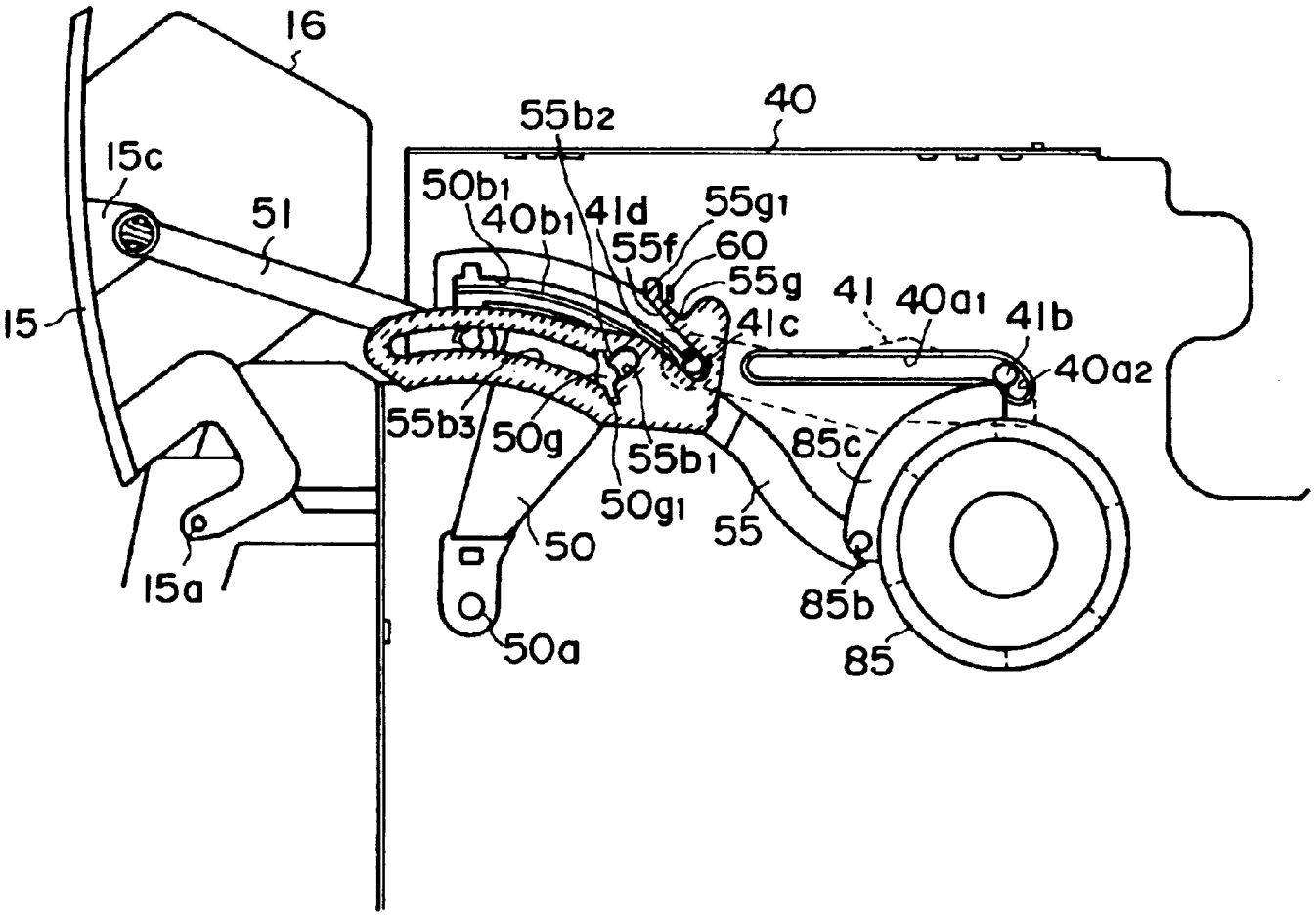
FIG. 42 is an illustration of a process cartridge inserting operation into the process cartridge mounting-and-demounting mechanism, at the righthand side inner plate in the image forming apparatus, as seen at the same timing as with FIG. 41.
Figure 43:
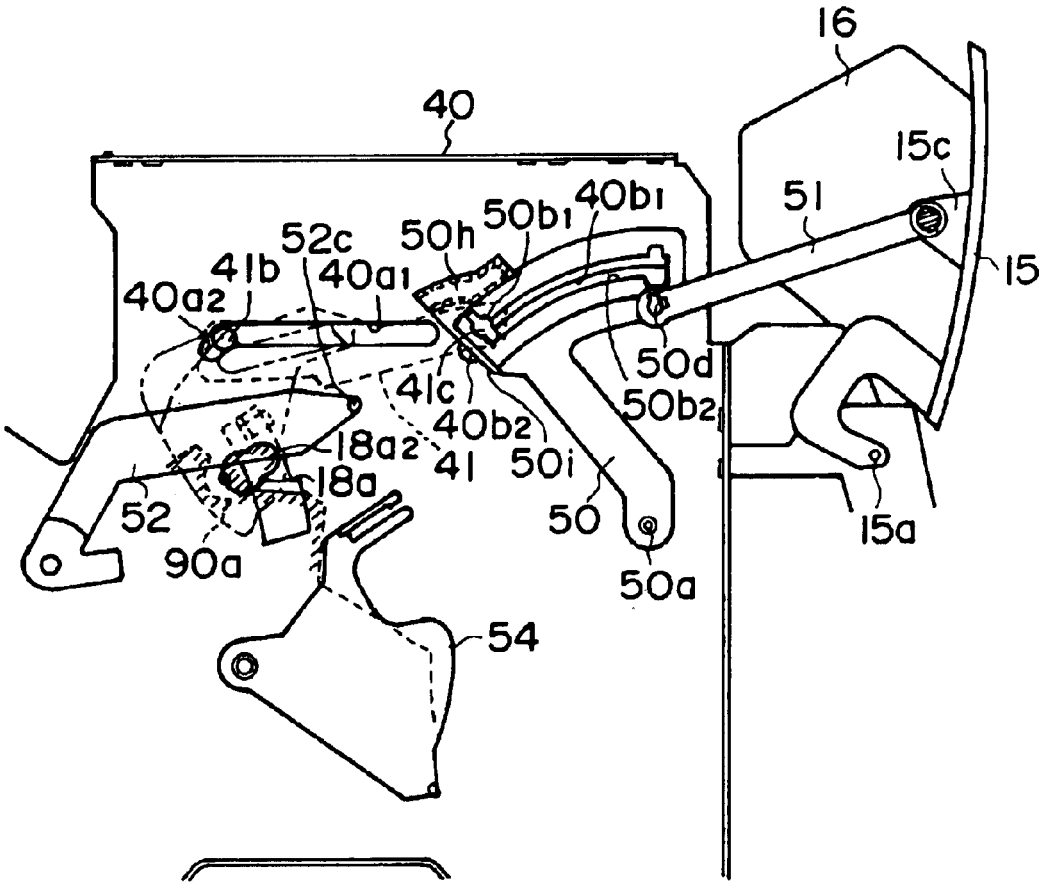
FIG. 43 is an illustration of a process cartridge inserting operation into the process cartridge mounting-and-demounting mechanism, at the left hand side inner plate in the image forming apparatus, as seen at the same timing as with FIG. 41.
Figure 44:
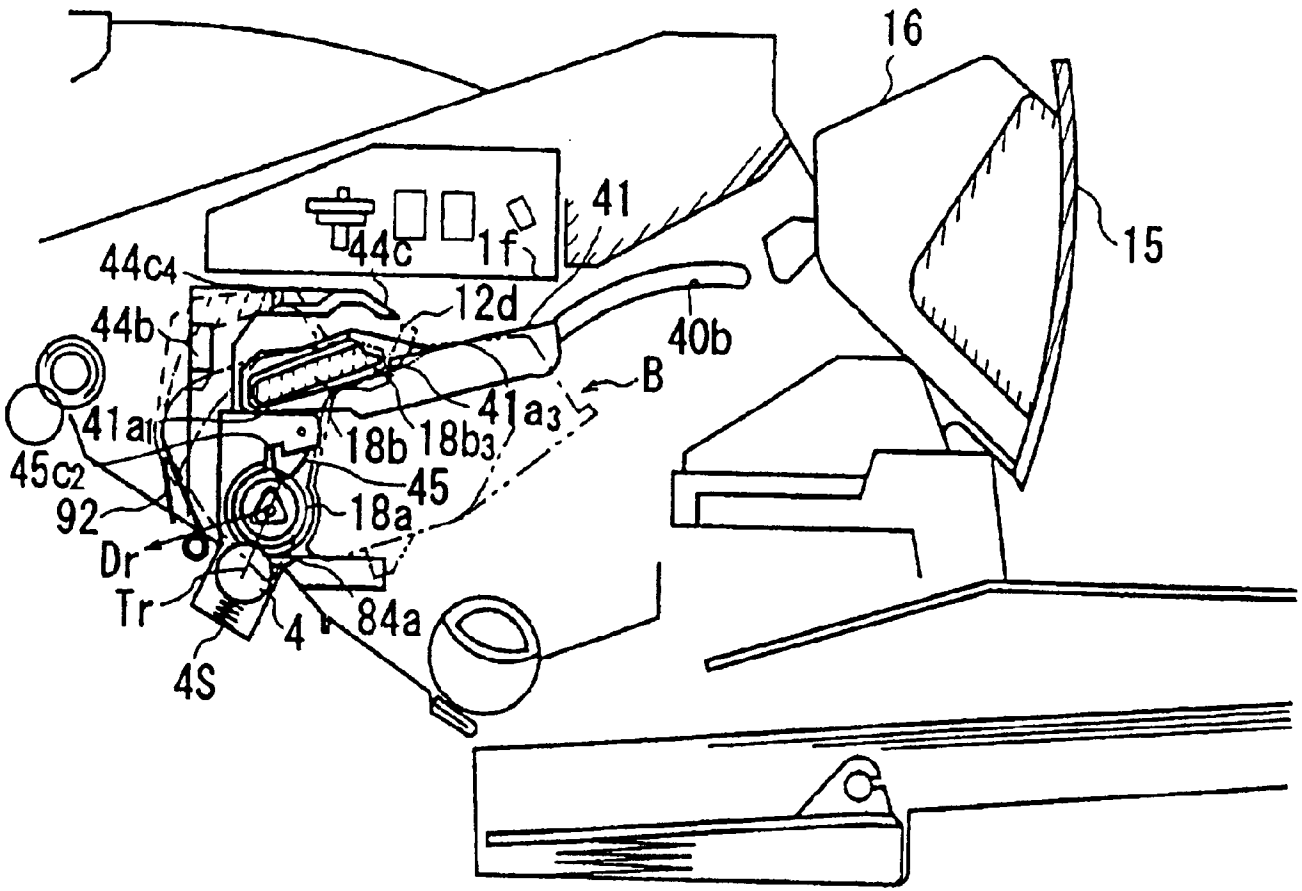
FIG. 44 is an illustration of a process cartridge inserting operation into the mounting-and-demounting mechanism of the process cartridge, and more particularly an illustration of the motion of the process cartridge, at the righthand side inner plate in the image forming apparatus.
Figure 45:
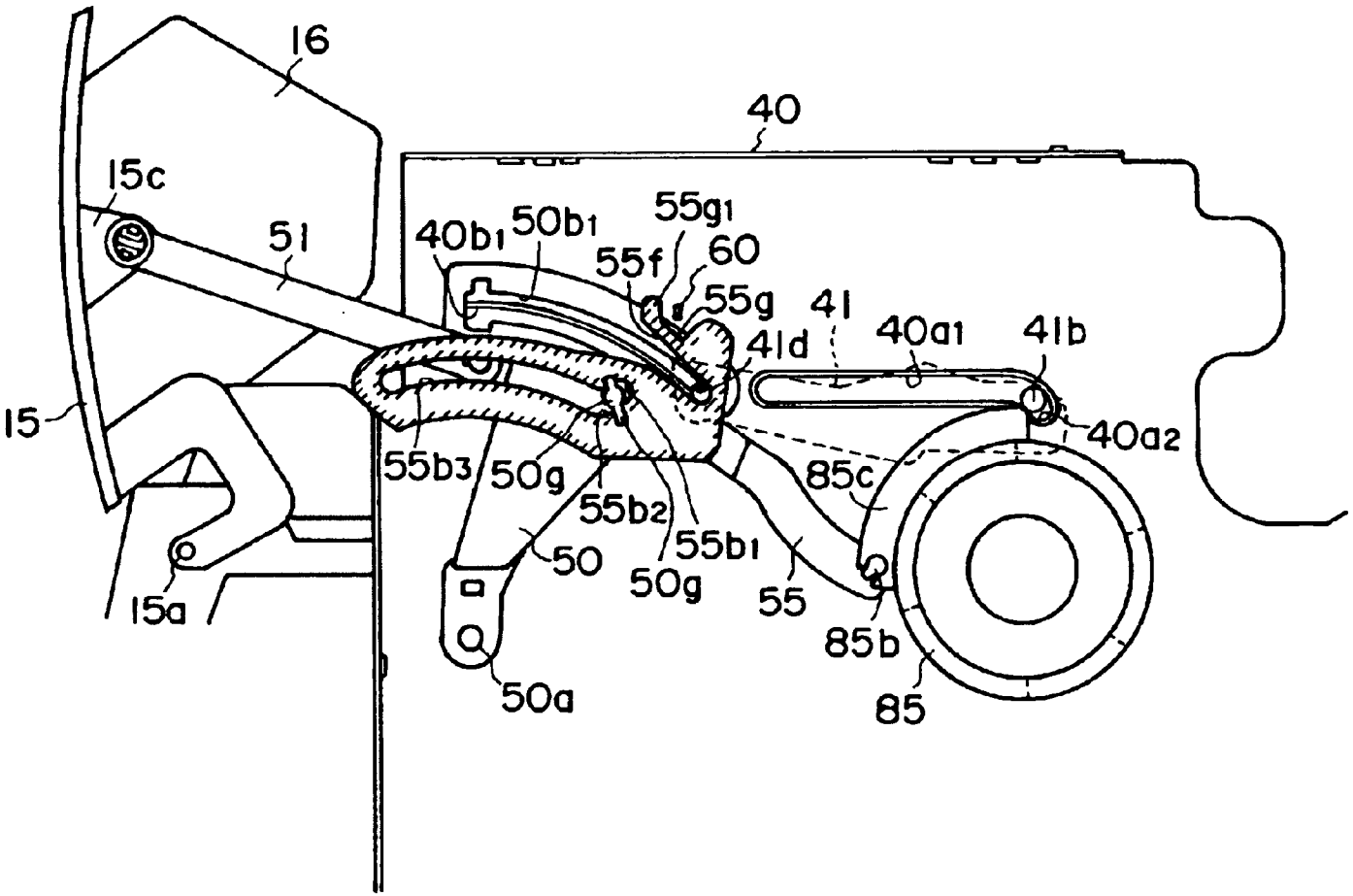
FIG. 45 is an illustration of a process cartridge inserting operation into the process cartridge mounting-and-demounting mechanism, at the righthand side inner plate in the image forming apparatus, as seen at the same timing as with FIG. 44.
Figure 46:
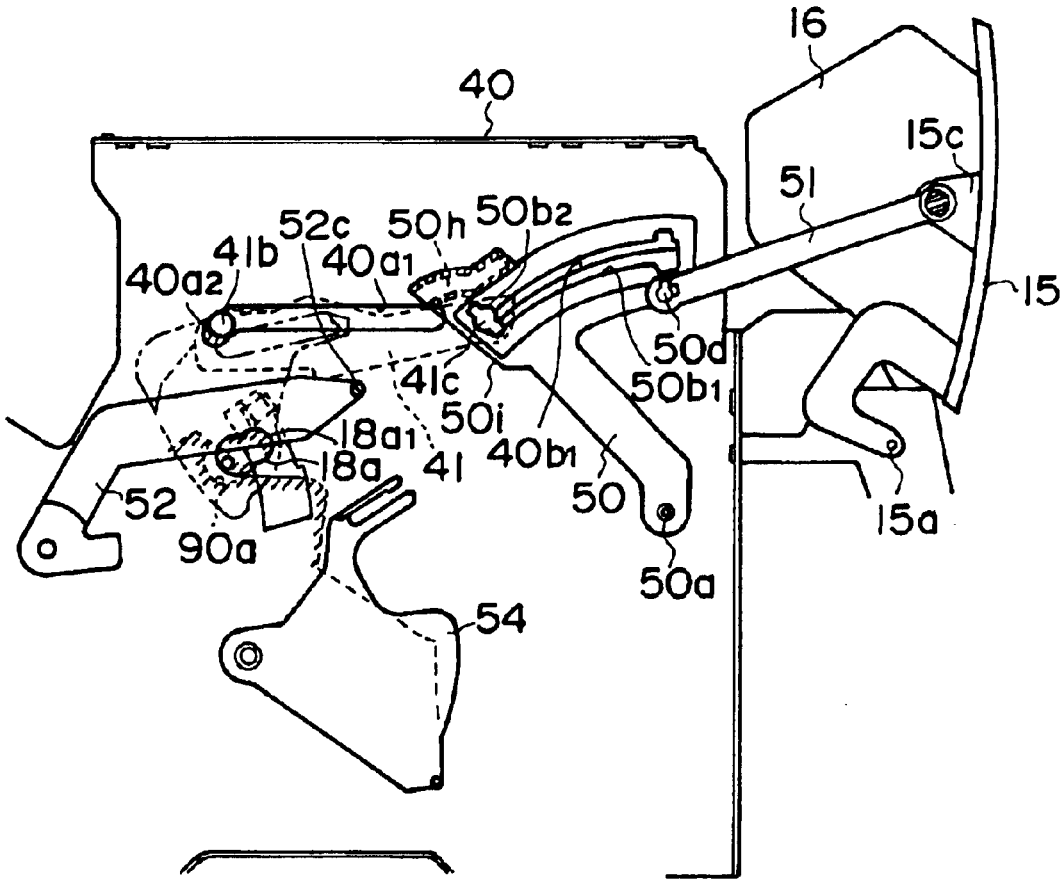
FIG. 46 is an illustration of a process cartridge inserting operation into the process cartridge mounting-and-demounting mechanism, at the left hand side inner plate in the image forming apparatus, as seen at the same timing as with FIG. 44.

Next, referring to FIGS. 26–49, the manner in which the moving guide 41, on which the process cartridge B has rested, moves during the first half of the closing movement of the opening/closing cover 15, will be described. FIGS. 26, 27, and 28 are the same in terms of the timing of the movement of the moving guide 41, and so are FIGS. 29, 30, and 31; FIGS. 32, 33, and 34; FIGS. 35, 36, and 37; FIGS. 38, 39, and 40; FIGS. 41, 42, and 43; FIGS. 44, 45, and 46; and FIGS. 47, 48, and 49. FIGS. 26, 29, 32, 35, 38, 41, 44, and 47 show the movement of the process cartridge B in relation to the right inner plate as seen from the inward side of the image forming apparatus. FIGS. 27, 30, 33, 36, 39, 42, 45, and 48 show the movement of the process cartridge B in relation to the right inner plate, as seen from the outward side of the image forming apparatus. FIGS. 28, 31, 34, 37, 40, 43, 46, and 49 show the movement of the process cartridge B in relation to the left inner plate, as seen from the outward side of the image forming apparatus.

As the opening/closing cover 15 is closed by rotating it about the center boss 15*a*, the cam plate 50, which is connected to the opening/closing cover 15 by the connecting plate 51, and constitutes the follower of the four-joint linkage, also rotates, as shown in FIGS. 28–49. As a result, the second boss 41*c* of the moving guide 41 is moved by the top end of the straight portion (straight groove hole) 50*b*2 of the cam hole 50*b* or the cam plate 50, along the first arcuate portion 40*b*1 of the second guide rail 40*b*.

As described before, the center of the curvature of the first arcuate portion 40*b*1 coincides with the rotational axis 50*a* of the cam plate 50, and the radius of the first arcuate portion 40*b*1 is slightly smaller than the distance from the rotational axis 50*a* of the cam plate 50 to the top and of the straight portion (straight groove hole) 50*b*2 of the cam hole 50*b* of the cam plate 50. Therefore, the second boss 41*c* of the moving guide 41 is retained in the space surrounded by the first arcuate portion 40*b*1 of the second guide rail 40*b* and the straight portion (straight groove hole) 50*b*2 of the cam hole 50*b*, and is moved by the rotation of the cam plate 50. Consequently, the first boss 41*b* of the moving guide 41 also moves inward, in terms of the direction X in which the process cartridge B is mounted, along the horizontal portion 40*a*1 of the first guide rail 40*a*.

The process cartridge B is in the apparatus main assembly, with its mounting guide 18*b* being in contact with the deeper end of the guiding groove 41*a* of the moving guide 41, and the bottom surface of the toner/developing means holding frame 10*f* is in contact with the contact rib 43*c* of the front guide 43 (FIG. 21).

Figure 29:
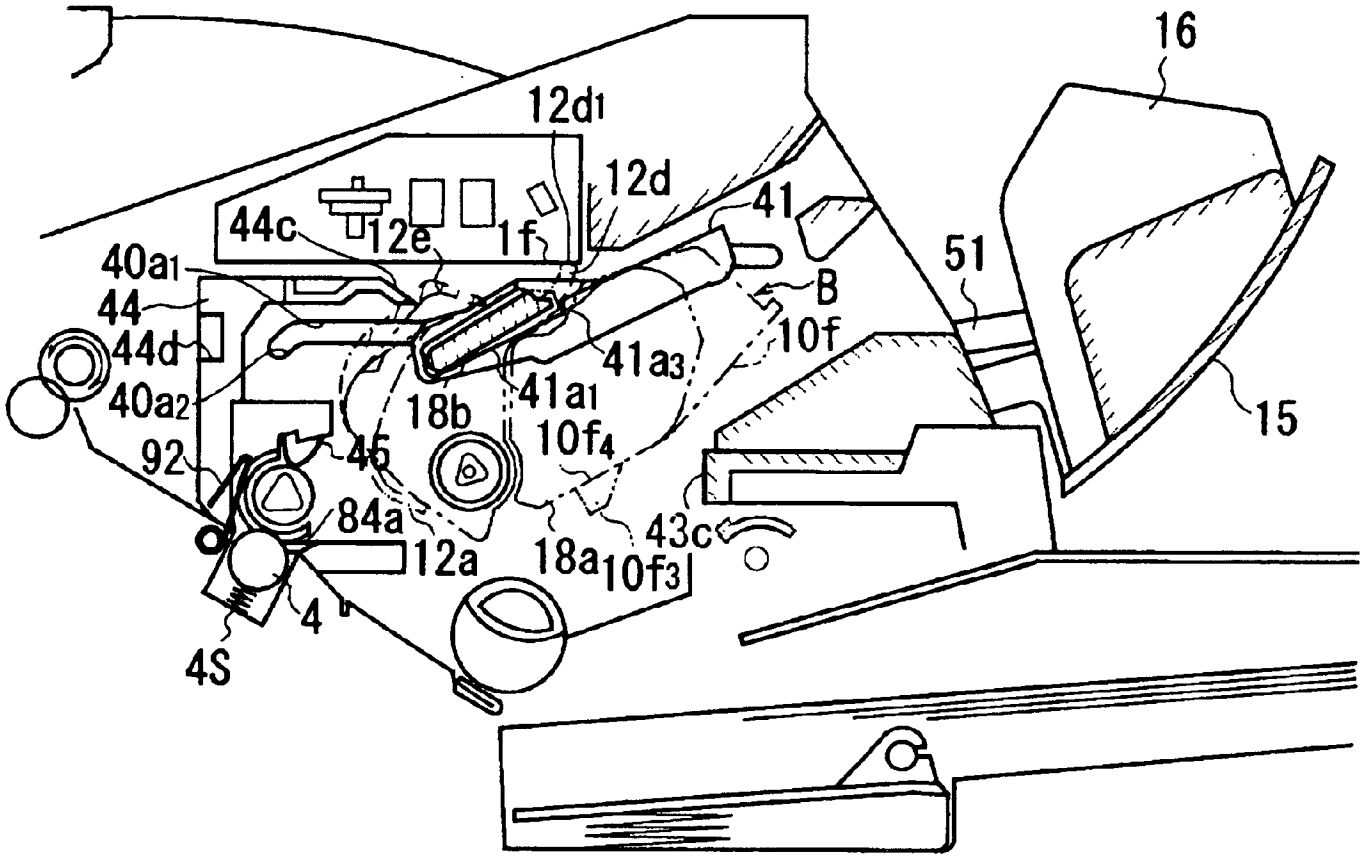
FIG. 29 is an illustration of a process cartridge inserting operation into the mounting-and-demounting mechanism of the process cartridge, more particularly an illustration of the motion of the process cartridge, at the righthand side inner plate in the image forming apparatus.
Figure 30:
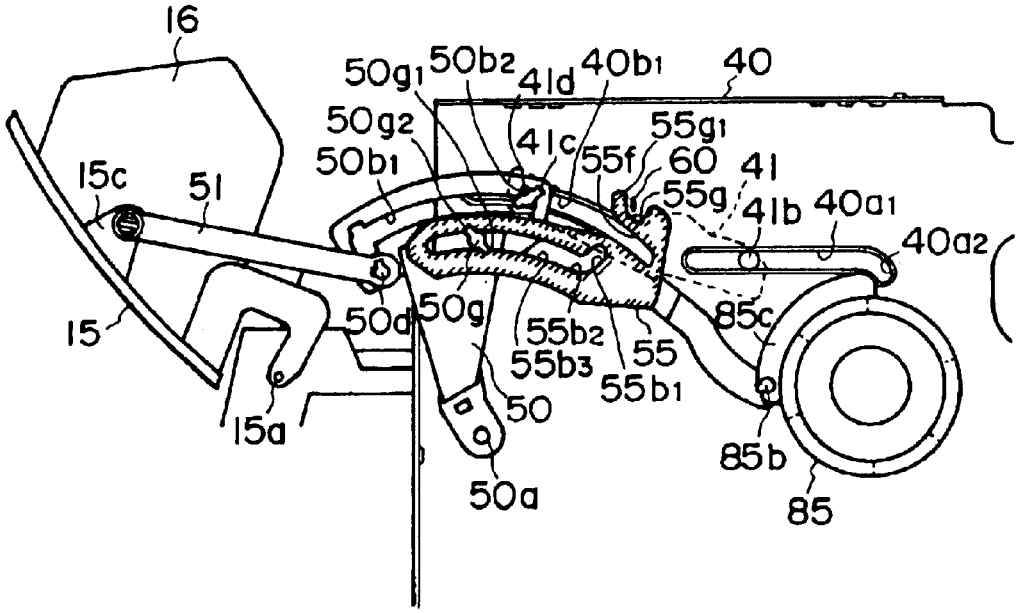
FIG. 30 is an illustration of a process cartridge inserting operation into the process cartridge mounting-and-demounting mechanism, at the righthand side inner plate in the image forming apparatus, as seen at the same timing as with FIG. 29.
Figure 31:
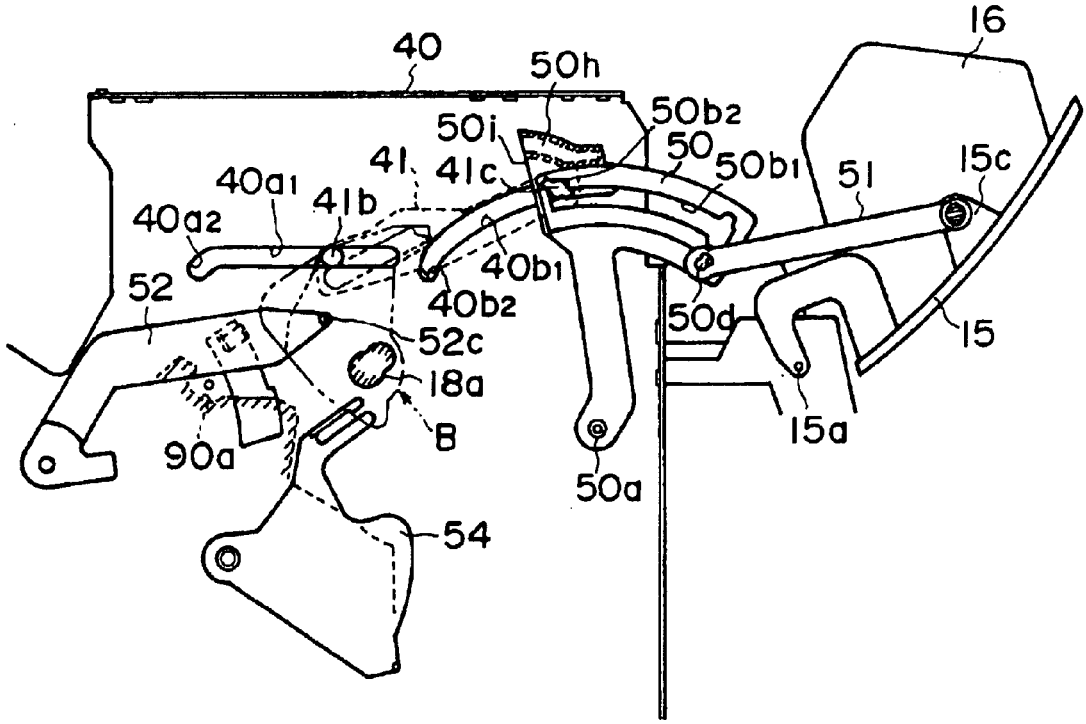
FIG. 31 is an illustration of a process cartridge inserting operation into the process cartridge mounting-and-demounting mechanism, at the left-hand side inner plate in the image forming apparatus, as seen at the same timing as with FIG. 29.

As the moving guide 41 is moved further inward of the image forming apparatus, the process cartridge B moves inward of the image forming apparatus, along with the moving guide 41. As a result, the bottom surface 10*f*4 of the toner/developing means holding frame 10*f* becomes separated from the contact rib 43*c*, and the process cartridge B begins to be supported by the retaining surface 41*a*1 of the moving guide 41, by the bottom surface 18*b*1 of the mounting guide 18*b* (FIG. 29).

The moving guide 41 supports the mounting guide 18*b* by the retaining surface 41*a*1, and moves inward while changing its attitude in the clockwise direction as shown in FIGS. 29–47. During this movement of the moving guide 41, the process cartridge B is conveyed in the image forming apparatus while changing its attitude in the clockwise direction, with the photoconductive drum 7 moving virtually horizontally. As the moving guide 41 moves while changing its attitude, the guide stopper 46 fitted around the first boss 41*b* follows the moving guide 41 while rotating, with the inward surface of the side wall 46*c* remaining in contact with the outward side of the lip of the first guide rail 40*a* formed by burring.

On the right side where the driving means is located, the helical torsion coil spring 45, for holding the process cartridge B in the position at which the driving force receiving portion of the process cartridge B can be connected to the driving force transmission mechanism of the apparatus main assembly, by the aforementioned coupling means, is disposed. This helical torsion coil spring 45 keeps the positioning guide 18*a* pressed upon the cartridge catching/retaining portion 84*a*, by its resiliency, to prevent the positioning guide 18*a* of the process cartridge B from being dislodged from the position, in which the driving force receiving portion of the process cartridge B can be engaged with the corresponding portion of the apparatus main assembly by the coupling portion, by the pressure generated by the spring 4S to keep the transfer roller 4 pressed upon the photoconductive drum 7.

Thus, as the opening/closing cover 15 is further closed, the process cartridge B moves closer to the image formation location located further inward of the image forming apparatus main assembly 14, while gradually becoming horizontal, as shown in FIG. 38. On the right side of the apparatus, the peripheral surface of the positioning guide 18*a* comes into contact with the contact portion of the functional arm 45*c* of the helical torsion coil spring 45 disposed in the recess 44*d* of the stationary guide 44, in such a manner as to intrude into the upstream side of the path of the process cartridge B to the image formation location.

As described previously, the length of the retaining surface 41*a*1 of the moving guide 41 is greater than that of the bottom surface 18*b*1 of the mounting guide 18*b*. Thus, when the opening/closing cover 15 is further closed from the above described position, the process cartridge B is prevented by the resiliency of the helical torsion coil spring 45, from moving further inward, as shown in FIG. 38. As a result, the mounting guide 18*b* slides on the retaining surface 41*a*1, within the guiding groove of the moving guide 41, and the bottom corner 18*b*3 of the mounting guide 18*b*, on the trailing side, comes into contact with the perpendicular surface 41*a*3 of the guiding groove 41*a*.

Thereafter, as the opening/closing cover 15 is further closed, the bottom corner 18*b*3 of the trailing end of the mounting guide 18*b* is pressed by the perpendicular surface 41*a*3 of the guiding groove 41*a*. As a result, the functional arm 45*c* of the helical torsion coil spring 45 is bent upward, being forced out of the path of the positioning guide 18*a*, against the resiliency of the helical torsion coil spring 45. Consequently, it becomes possible for the process cartridge B to be pushed further into the apparatus main assembly (FIG. 41).

Then, as soon as the positioning guide 18*a* passes the bent portion 45*c*2 of the helical torsion coil spring 45, the latent resiliency of the helical torsion coil spring 45 acts upon the positioning guide 18*a* in the direction to push the positioning guide 18*a* into the cartridge catching/retaining portion 84*a* of the inward bearing 84 (FIG. 44).

Referring to FIG. 44, the helical torsion coil spring 45 in this embodiment contacts the peripheral surface of the positioning guide 18*a* by the bent portion 45*c*2 of the functional arm 45*c*. In order to prevent this bent portion 45*c*2 from deforming in a manner to become permanently bent when the peripheral surface of the positioning guide 18*a* passes the bent portion 45*c*2 during the mounting or dismounting of the process cartridge B, the radius of the curvature of the bent portion 45*c*2 is rendered relatively large (approximately 3 mm–4 mm).

Further, in order to prevent the functional arm 45*c* from dislodging from the intended position, in terms of the lengthwise direction of the process cartridge B, when the functional arm 45*c* of the helical torsion coil spring 45 is bent upward by the positioning guide 18*a*, the recess 44*d* of the stationary guide 44 is provided with a regulating claw 44*d*3 and a regulating rib 44*d*4, which regulate the movement of the functional arm 45*c*, in terms of the lengthwise direction of the process cartridge B, by the portion of the functional arm 45*c* beyond the bend portion 45*c*2. With the provision of this arrangement, the functional arm 45*c* deforms within the gap defined by the bottom surface of the recess 44*d*, the regulating claw 44*d*3, and the regulating rib 44*d*4, being regulated in its position in terms of the lengthwise direction of the process cartridge B. The functional arm 45*c* of the helical torsion coil spring 45 keeps the positioning boss 18*a* pressed upon the cartridge catching/retaining portion 84*a* with the application of a predetermined pressure (approximately 0.98 N to 4.9 N).

Near the point which the positioning guide 18*a* passes while deforming the helical torsion coil spring 45, the first boss 41*b* of the moving guide 41 moves from the horizontal portion 40*a*1 of the first guide rail 40*a* to the inclined portion 40*a*2 of the first guide rail 40*a* (FIGS. 38–44).

While the first boss 41*b* moves along the horizontal portion 40*a*1 of the first guide rail 40*a*, the photoconductive drum 7 moves nearly horizontally. Then, as the first boss 41*b* transfers to the inclined portion 40*a*2 of the first guide rail 40*a*, the photoconductive drum 7 is moved to the Dr portion (FIG. 44) of its path, where the path points diagonally downward in terms of the process cartridge mounting direction. Therefore, the photoconductive drum 7 moves toward the transfer roller 4.

With the provision of the above described structural arrangement, such a component of the force applied in the direction to move the process cartridge B inward of the apparatus main assembly that acts in the direction to press the transfer roller 4 can be increased by increasing the angle between the direction Tr (FIG. 44) in which the transfer roller 4 is pressed by the spring 4S, and the direction of the path of the photoconductive drum 7 after the photoconductive drum 7 comes into contact with the transfer roller 4 and begins to press the transfer roller 4 downward.

As is evident from the above description, constructing the first guide rail 40*a* so that its front end, in terms of the process cartridge mounting direction, tilts downward as described above makes it possible to efficiently press down the transfer roller 4 by the movement of the process cartridge linked to the rotation of the opening/closing cover 15.

At this time, the relationship between the guiding groove 41*a* of the moving guide 41 and the mounting guide 18*b* when the photoconductive drum 7 of the process cartridge B presses down the transfer roller 4 will be described.

As described previously, while the process cartridge B is moved by the rotation of the opening/closing cover 15, the mounting guide 18*b* is supported by the retaining surface 41*a*1 of the guiding groove 41*a* of the moving guide 41. During this movement of the process cartridge B, as the process cartridge B is subjected to the forces (resistance) generated by the helical torsion coil spring 45, as well as an electrical contact 92, in the direction to push back the process cartridge B, the perpendicular surface 41*a*3 of the moving guide 41 moves the process cartridge B by coming into contact with the bottom corner 18*b*3 of the trailing end of the mounting guide 18*b*.

Toward the end of the conveyance of the process cartridge B, the photoconductive drum 7 comes into contact with the transfer roller 4 and presses down the transfer roller 4 against the spring 4S. The pressure which the spring 4S applies to the transfer roller 4 acts on the photoconductive drum 7 in the direction to lift the mounting guide 18*b* of the process cartridge B from the retaining surface 41*a*1 of the moving guide 41. Being subjected to such a pressure, the mounting guide 18*b* tends to go over the stepped portion between the retaining surface 41*a*1 and guiding surface 41*a*2. If the mounting guide 18*b* goes over the stepped portion between the retaining surface 41*a*1 and guiding surface 41*a*2, it becomes impossible for the moving guide 41 to insert the process cartridge B against the resistive load in terms of the process cartridge insertion direction; in other words, it becomes impossible to send the process cartridge B to the location at which image formation is possible.

As has been described with reference to FIG. 6, in this embodiment, the guiding groove 41*a* of the moving guide 41 is provided with the perpendicular surface 41*a*3, which is located at the trailing end of the retaining surface 41*a*1 and is perpendicular to the retaining surface 41*a*1, and the inclined portion 41*a*4, which extends diagonally upward from the top end of the perpendicular surface 41*a*3 and connects to the guiding surface 41*a*2 in a manner to form an acute angle relative to the guiding surface 41*a*2. Thus, as the process cartridge B is resisted by the force generated by the helical torsion coil spring 45 and electrical contact 92 in the direction opposite to the process cartridge mounting direction, during the inward conveyance of the process cartridge B, the perpendicular surface 41*a*3 of the moving guide 41 moves the process cartridge B by coming into contact with the bottom corner 18*b*3 of the trailing end of the mounting guide 18*b*. Then, the photoconductive drum 7 comes into contact with the transfer roller 4 due to the movement of the process cartridge B caused by the perpendicular surface 41*a*3 of the moving guide 41, and is subjected to the force reactive to the force applied to the transfer roller 4 by the photoconductive drum 7. As a result, the mounting guide 18*b* tends to go over the stepped portion of the guiding groove 41*a*. In this embodiment, however, the inclined surface portion 18*b*4 of the mounting guide 18*b*, which connects to the bottom corner 18*b*3 of the trailing end of the mounting guide 18*b* and forms an acute angle relative to the bottom surface 18*b*1, comes into contact with the inclined portion 41*a*4, which extends diagonally upward from the top end of the perpendicular surface 41*a*3, as shown in FIG. 6(B). Therefore, even if the mounting guide 18*b* is moved in the direction to go over the stepped portion of the guiding groove 41*a*, the inclined portion 41*a*4 catches the inclined surface portion 18*b*4, making it possible for the moving guide 41 to push the process cartridge B inward against the force applied to the transfer roller 4 by the spring 4S.

In the descriptions given above regarding the conveyance of the process cartridge B by the movement of the moving guide 41 linked to the rotation of the opening/closing cover 15, it was stated that the right positioning guide 18*a* is kept pressed upon the cartridge catching/retaining portion 84*a* by the helical torsion coil spring 45.

Figure 49:
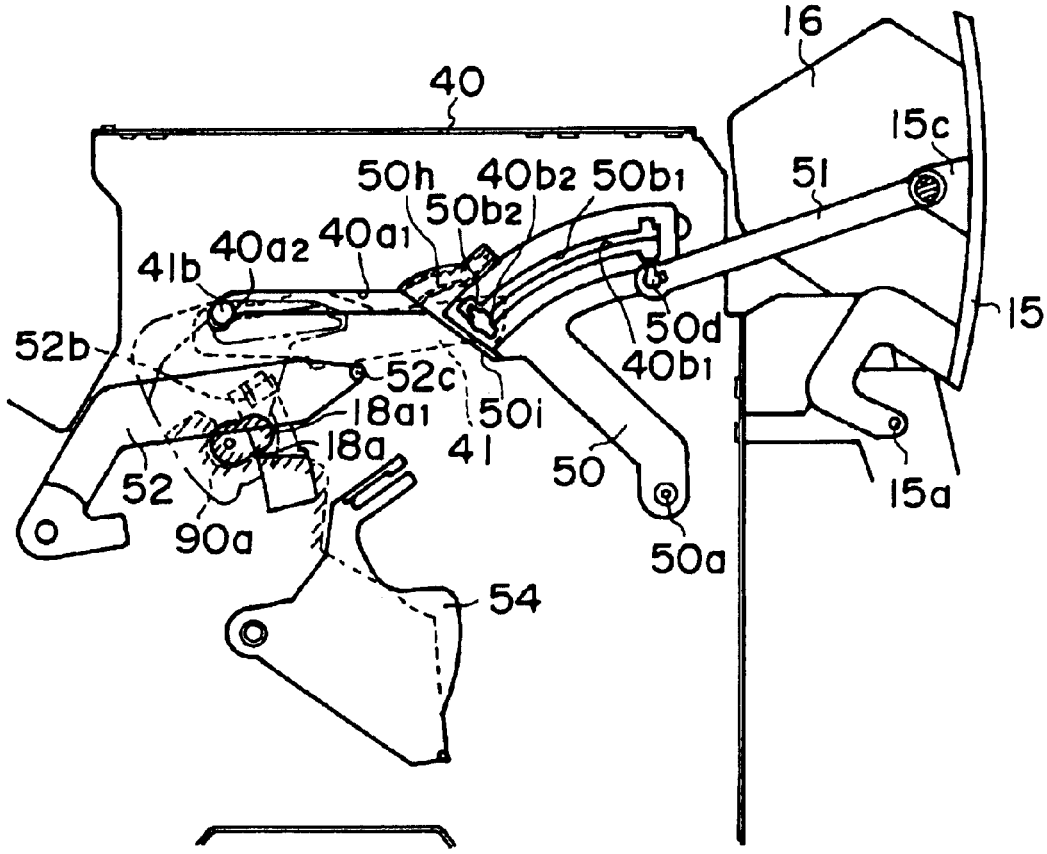
FIG. 49 is an illustration of a process cartridge inserting operation into the process cartridge mounting-and-demounting mechanism, at the left hand side inner plate in the image forming apparatus, as seen at the same timing as with FIG. 47.

However, on the left side of the apparatus, a resilient pressing means which intrudes into the path of the positioning guide 18*a* is not provided. Further, a certain amount of play is provided between the mounting guide 18*b* and the retaining surface 41*a*1 of the moving guide 41. Therefore, even after the left positioning guide 18*a* reaches near the positioning portion 90*a* of the conveying means frame 90, it is not immediately caught by the positioning portion 90*a* due to the presence of the contact pressure between the transfer roller 4 and photoconductive drum 7, and the contact pressure generated by various electrical contacts (FIG. 49).

The left positioning guide 18*a* is guided to the positioning portion 90*a* of the frame 90, being thereby accurately positioned, by the movement of the pusher arm 52, which will be described later.

Although the right positioning guide 18*a* is kept pressed upon the cartridge catching/retaining portion 84*a* by the helical torsion coil spring 45, it eventually is separated from the cartridge catching/retaining portion 84*a* against the resiliency of the helical torsion coil spring 45, and as the rotational axes of the large gear coupling 83*a* and drum coupling 7*a*1 are made to coincide with each other by the engagement between the two couplings caused by the coupling means, the position of the process cartridge B relative to the image forming apparatus, within the image forming apparatus, on the right side, becomes fixed.

After the right positioning guide 18*a* passes by the helical torsion coil spring 45, the first boss 41*b* of the moving guide 41 transfers to the inclined portion 40*a*2 of the first guide rail 40*a*, and causes the photoconductive drum 7 to press down the transfer roller 4. This virtually concludes the process cartridge conveyance.

Next, the movements of the cam plate 50 and moving guide 41 linked to the rotation of the opening/closing cover 15, which occur during above described process cartridge conveyance, will be described.

Near the area where the distance by which the positioning guide 18*a* pushes up the helical torsion coil spring 45 becomes a maximum, the second boss 41*c* of the moving guide 41 is at the portion of the second guide rail 40*b* where the arcuate portion 40*b*1 and the vertical straight portion 40*b*2 of the second guide rail 40*b* of the inner plate 40 connect to each other in a smooth curvature, and the first boss 41*b* of the moving guide 41 is at the point where it is about to move into the inclined portion of the first guide rail 40*a* of the inner plate 40 (FIGS. 41, 42, and 43).

Figure 47:
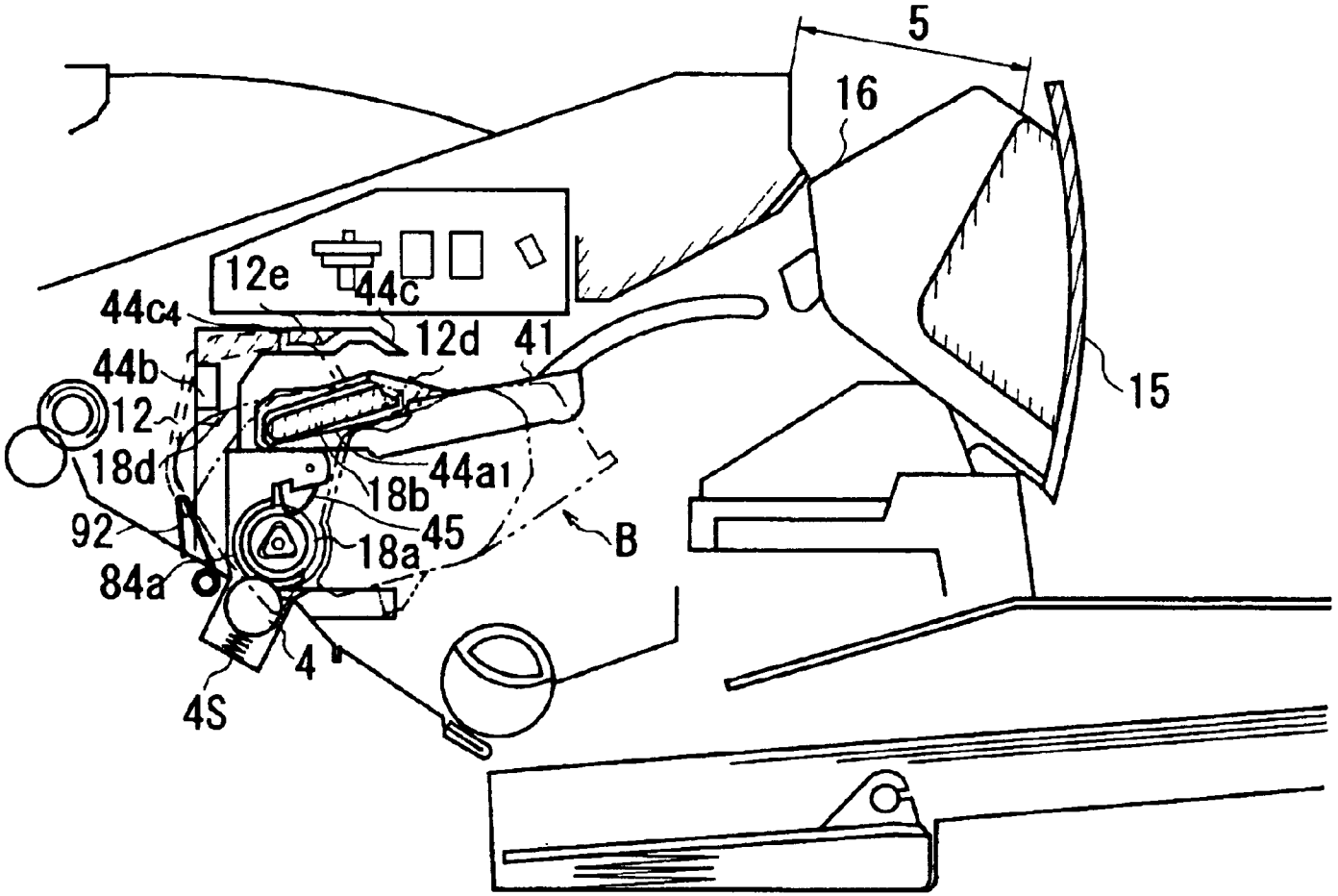
FIG. 47 is an illustration of a process cartridge inserting operation into the mounting-and-demounting mechanism of the process cartridge, and more particularly an illustration of the motion of the process cartridge, at the righthand side inner plate in the image forming apparatus.
Figure 48:
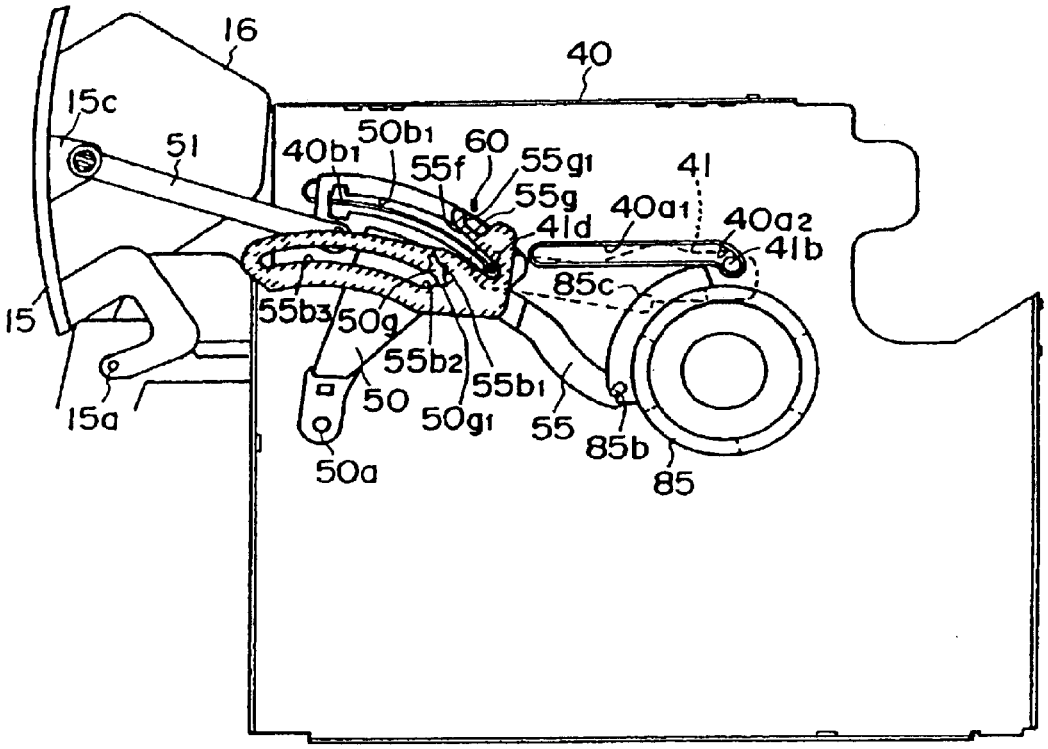
FIG. 48 is an illustration of a process cartridge inserting operation into the process cartridge mounting-and-demounting mechanism, at the righthand side inner plate in the image forming apparatus, as seen at the same timing as with FIG. 47.

As the opening/closing cover 15 is further closed from the above described point, the range of the area surrounded by the cam hole 50*b* of the cam plate 50 and the second guide rail 40*b* of the inner plate 40 changes to the area between the inward side of the straight portion (straight groove hole) 50*b*2 of the cam hole 50*b* of the cam plate 50, in terms of the radius direction of the cam hole 50*b*, and the straight portion 40*b*2 of the second guide rail 40*b*, and the second boss 41*c* of the moving guide 41 is moved within this area. Therefore, the first boss 41*b* of the moving guide 41 is moved downward along the inclined portion 40*a*2 while the second boss 41*c* of the moving guide 41 is moved to the bottom end of the straight portion 40*b*2. Then, as the second boss 41*c* comes into contact with the bottom end of the straight portion 40*b*2, the movement of the moving guide 41 concludes (FIGS. 47, 48, and 49).

As a result, the moving guide 41 becomes virtually horizontal as the process cartridge B reaches the image formation location. In other words, at the second location, the moving guide 41 assumes an attitude different from the attitude it assumes at the first location. The first guide rail 40*a* is slightly longer than the moving distance of the first boss 41*b* of the moving guide 41 as described before. Therefore, at the completion of the movement of the moving guide 41, there is a gap between the first boss 41*b* and the end of the inclined portion 40*a*2 of the first guide rail 40*a*. Thus, it does not occur that the compression deformation occurs to the moving guide 41 due to the contact between the first boss 41*b* and the end of the inclined portion 40*a*2.

(Mechanism for Opening or Closing Drum Shutter)

Up to this point, the manner in which the process cartridge moves in connection to the rotation of the opening/closing cover 15 has been described. Next, the opening and closing movements of a drum shutter 12 linked to the movement of the process cartridge B will be described.

According to the present invention, the drum shutter 12 is not opened or closed during the stage in which the process cartridge B is mounted into the moving guide 41 (FIGS. 17–21). Instead, it is opened or closed in the stage in which the process cartridge B is moved within the apparatus main assembly by the rotation of the opening/closing cover 15 (FIGS. 26–47).

This arrangement is made to prevent a problem that as the drum shutter 12 is opened in the stage in which the process cartridge B is mounted into the apparatus main assembly (moving guide 41), the resistance generated by the opening of the drum shutter 12 adds to the load to which the process cartridge B is subjected when the process cartridge B is mounted into the moving guide 41, and therefore, the inward movement of the process cartridge B is stopped before the mounting guide 18*b* is caught by the retaining surface or portion 41*a*1 in the inward portion of the guiding groove 41*a*. For this reason, the structural design that caused a conventional apparatus to generate a negative load in terms of the process cartridge inserting direction when the process cartridge B is mounted into the apparatus main assembly by a user has been eliminated; in other words, the drum shutter 12 is opened or closed in the stage in which the process cartridge B is moved within the apparatus, by the closing movement of the opening/closing cover 15.

As the process cartridge B is moved by the closing movement of the opening/closing cover 15, the drum shutter 12 rotationally supported by the process cartridge B is rotated and exposes the transfer opening 9*a* and exposure opening 9*b* for the photoconductive drum 7, readying the process cartridge B for image formation.

Referring to FIG. 3, the rib 12*e* for keeping the drum shutter 12 open is on top of the cleaning means holding frame 11*d*. However, when it is seen from the direction parallel to the lengthwise direction of the process cartridge B, it is within the contour of the cleaning means holding frame 11*d*, and when it is seen from the direction perpendicular to the lengthwise direction of the process cartridge B, it is on the inward side of the contour of the surface of the cleaning means holding frame lid facing the moving guide 41.

The surface of the rib 12*e*, which contacts the shutter guide 44*c* (second contact portion) of the stationary guide 44, faces the cleaning means holding frame lid, and is exposed as the drum shutter 12 is opened.

As is evident from the above description, when the process cartridge B is outside the apparatus main assembly, that is, when the drum shutter 12 is closed, the rib 12*e* (second projection) for controlling the attitude of the drum shutter 12, which is open when the process cartridge B is within the image forming apparatus main assembly, is within the contour of the cleaning means holding frame lid as seen from either the lengthwise direction of the process cartridge B or the direction perpendicular thereto. Therefore, the rib 12*e* is not damaged by the impacts which occur while the process cartridge B is transported, or the manner in which the process cartridge B is handled while the process cartridge B is mounted or dismounted.

Referring to FIG. 26, as the process cartridge B is moved by the closing movement of the opening/closing cover 15, the cam portion 12*d* (first projection) of the drum shutter 12 comes into contact with an optical system plate if (first contact portion), which is between the left and right inner plates within the image forming apparatus main assembly, and supports an optical system 1. As a result, the drum shutter 12 is rotated in the clockwise direction, while resisting the resiliency of a shutter spring, by the movement of the process cartridge B, and begins to expose the transfer opening 9*a* and exposure opening 9*b*.

As the drum shutter 12 is rotated in the clockwise direction, the rib 12*e*, which is attached to the connecting portion 12*c* (supporting portion), is moved away from the top surface of the cleaning means holding frame lid, and therefore, the surface of the rib 2*e* which was in contact with the shutter guide 44*c* is exposed. As the process cartridge B is moved deeper into the apparatus main assembly, the cam portion 12*d* of the drum shutter 12, which has come into contact with the corner of the optical system plate if, keeps moving, with the highest point 12*d*1 located at the end of the cam portion 12*d* remaining in contact with the bottom surface of the optical system plate if, as shown in FIG. 29. Thus, as the process cartridge B is moved inward, the rib 12*e* comes into contact with the shutter guide 44*c* of the stationary guide 44, causing the drum shutter 12 to be opened further. As a result, the highest point 12*d*1 (contact point) of the cam portion 12*d* is moved away from the bottom surface of the optical system plate 1*f* (FIG. 32).

The shutter guide 44*c* is disposed above the cleaning means holding frame lid, overlapping therewith, and is wide enough to catch the rib 12*e*. Referring to FIG. 26, listing from the upstream side in terms of the direction in which the process cartridge B is inserted, the shutter guide 44*c* has a first inclined surface 44*c*1, which is higher on the downstream side, a raised surface 44*c*2, a second inclined surface 44*c*3, which is lower on the downstream side, a horizontal surface 44c4, and a vertical surface 44c5, which is the most downstream surface in terms of the process cartridge mounting direction.

As described above, the shutter guide 44c rotates the drum shutter 12 by keeping the cam portion 12d in contact with the optical system plate 1f, and catches the rib 12e, which has moved away from the cleaning means holding frame 11d. For this purpose, the shutter guide 44c is located on the downstream side of the stationary guide 44, being outside the path through which the rib 12e comes up. Referring to FIG. 32, the shutter guide 44c catches the first inclined surface 44c1, which is rendered lower on the upstream side so that it can easily scoop up the rib 12e as the rib 12e is moved toward the shutter guide 44c by the movement of the process cartridge B. After being caught by the first inclined surface 44c1, the rib is slid up the first inclined surface 44c1 by the movement of the process cartridge B, increasing the angle at which the drum shutter 12 is open.

As the opening/closing cover 15 is closed further, and the process cartridge B is moved thereby further inward of the image forming apparatus main assembly 14, the rib 12e of the drum shutter 12 comes into contact with the raised portion 44c2, or the highest portion, of the shutter guide 44c, opening the drum shutter 12 wider. During this movement of the drum shutter 12, the presence of a square notch 12f (FIG. 4) at the left front corner of the drum shutter 12 prevents the drum shutter 12 from colliding with the electrical contact 92 of the image forming apparatus (FIG. 35).

Thereafter, the rib 12e is moved onto the second inclined surface 44c3 of the shutter guide 44c, which is lower on the downstream side in terms of the process cartridge mounting direction, and therefore, the drum shutter 12 temporarily moves a short distance in the closing direction. This second slanted surface 44c3 connects the raised surface 44c2, which is rendered long to enable the drum shutter 12 to avoid the electrical contact 92, and the horizontal surface 44c4, which is lower than the raised surface 44c2, and onto which the rib 12e finally moves.

Thereafter, as the first boss 41b of the moving guide 41 moves onto the inclined portion 40a2 of the first guide rail 40a, the rib 12e of the drum shutter 12 is supported by the horizontal portion 44c4, remaining therefore at the same level, as shown in FIG. 41. However, the process cartridge B moves downward toward the transfer roller 4, increasing the angle at which the drum shutter 12 is open.

Eventually, the movement of the moving guide 41 linked to the rotation of the opening/closing cover 15 stops, ending the conveyance of the process cartridge B. In this stage, the rib 12e of the drum shutter 12 is supported by the horizontal surface 44c4 of the shutter guide 44c, keeping the drum shutter 12 open at a predetermined angle, and the transfer opening 9a and exposure opening 9b are exposed, with the process cartridge B being properly positioned in the image forming apparatus and ready for image formation, as shown in FIG. 44.

Immediately after the movement of moving guide 41 linked to the closing movement of the opening/closing cover 15 ends in the first half of the entirety of the closing movement of the opening/closing cover 15, the second boss 41c of the moving guide 41 is at the bottom end of the straight portion 40b2 of the second guide rail 40b of the inner plate 40, and then, it moves to the arcuate portion 50b1 of the cam hole 50b of the cam plate 50 (FIG. 49). As described above, the arcuate portion 50b1 of the cam hole 50b is such a portion of the cam hole 50b that the center of its curvature coincides with the rotational axis of the rotational shaft 50a; the radius of its outward edge is equal to the distance from the rotational shaft 50a to the bottom end of the straight portion 40b2 of the second guide rail 40b; and its width (dimension in terms of its radius direction) is slightly greater than the external diameter of the second boss 41c of the moving guide 41. Therefore, as the opening/closing cover 15 is further closed after the completion of the movement of the moving guide 41, the cam plate 50 is allowed to rotate, with the edge of the arcuate portion 50b1 of the cam hole 50b of the cam plate 50 being guided by the second boss 41c of the moving guide 41, and therefore, the opening/closing cover 15 can be completely closed.

Hereinafter, various mechanisms, the movements of which are linked to the latter half of the entirety of the closing movement of the opening/closing cover 15, will be described.

(Movement of Means for Connecting Driving Force Transmitting Means Linked to Opening/Closing Cover Movement)

As described previously, the right inner plate 40 is provided with a driving means, which comprises a coupling means for transmitting a driving force to the process cartridge B, and a coupling means controlling means for engaging or disengaging the coupling means. Also as described above, the coupling means becomes engaged or disengaged as it is moved by the coupling means controlling means in the lengthwise direction of the process cartridge B, which is approximately perpendicular to the direction in which the process cartridge B is mounted into the apparatus main assembly.

The coupling means has the inward bearing 84, outward bearing 86, and large gear 83. The inward bearing 84 rotationally supports the large gear 83 by the large gear coupling 83a, and is fixed to the inner plate 40. The outward bearing 86 is attached to a gear cover (unshown) fixed to the inner plate 40, and rotationally supports the other end of the large gear. The large gear 83 is rotationally supported by the inward and outward bearings 84 and 86 (FIG. 11).

The large gear coupling 83a is provided with a twisted hole, the cross section of which is in the form of a virtually equilateral triangle. The rotational axis of the large gear coupling 83a coincides with that of the large gear 83. A gear flange (unshown) fixed to one of the lengthwise ends of the photoconductive drum 7 of the process cartridge B is provided with a drum coupling 7a1, the rotational axis of which coincides with that of the photoconductive drum 7, and is in the form of a twisted equilateral triangular pillar. The drum coupling 7a1 is within the hollow of the right positioning guide 18a, and the rotational axis of the drum coupling 7a1 also coincides with the axial line of the right positioning guide 18a (FIG. 3).

Referring to FIGS. 11, 50(A), 50(B), and 50(C), the coupling means controlling means comprises: the cam surface (84c1 and 84c2) of the inward bearing 84; a coupling cam 85 positioned between the inward bearing 84 and large gear 83; and a spring, which is disposed between the large gear 83 and outward bearing 86, and keeps the large gear 83 pressed toward the inward bearing 84.

The coupling cam 85 is rotatably supported by the cylindrical portion 84b of the inward bearing 84, and is provided with the cam surface (85a1, 85a2, and 85a3). The cam surface of the inward bearing 84 has two portions symmetrically positioned with respect to the axial line of the cylindrical portion 84b: portion 84c1 and portion 84c2 which are contiguous with each other. The portion 84c1 of the cam surface of inward bearing 84 is parallel to the inward surface of the inner plate 40, and is raised a predetermined height toward coupling cam 85 in the direction parallel to the rotational axis of the large gear 83, from the inward surface of the inner plate 40 (inward surface of inward bearing 84). The portion 84*c*2 of the cam surface of the inward bearing 84 is an inclined surface, which connects a predetermined point on the peripheral surface of the cylindrical portion 84*b* to the raised parallel portion 84*c*1. The cam surface of the coupling cam 85 also has two portions: portion 85*a*1 and 85*a*2. The portion 85*a*1 of the cam surface of the coupling cam 85 is parallel to the inward surface of the inner plate 40, and is raised toward the inward surface of the inner plate 40, from the base or bottom portion 85*a*3, by the height equal to the height of the raised parallel portion 84*c*1 of the cam surface of the inward bearing 84 from the inward surface of the inner plate 40. The portion 85*a*2 of the cam surface of the coupling cam 85 is an inclined surface and connects the raised parallel portion 85*a*1 and the base portion 85*a*3 of the cam surface of the coupling cam 85.

Figure 50:
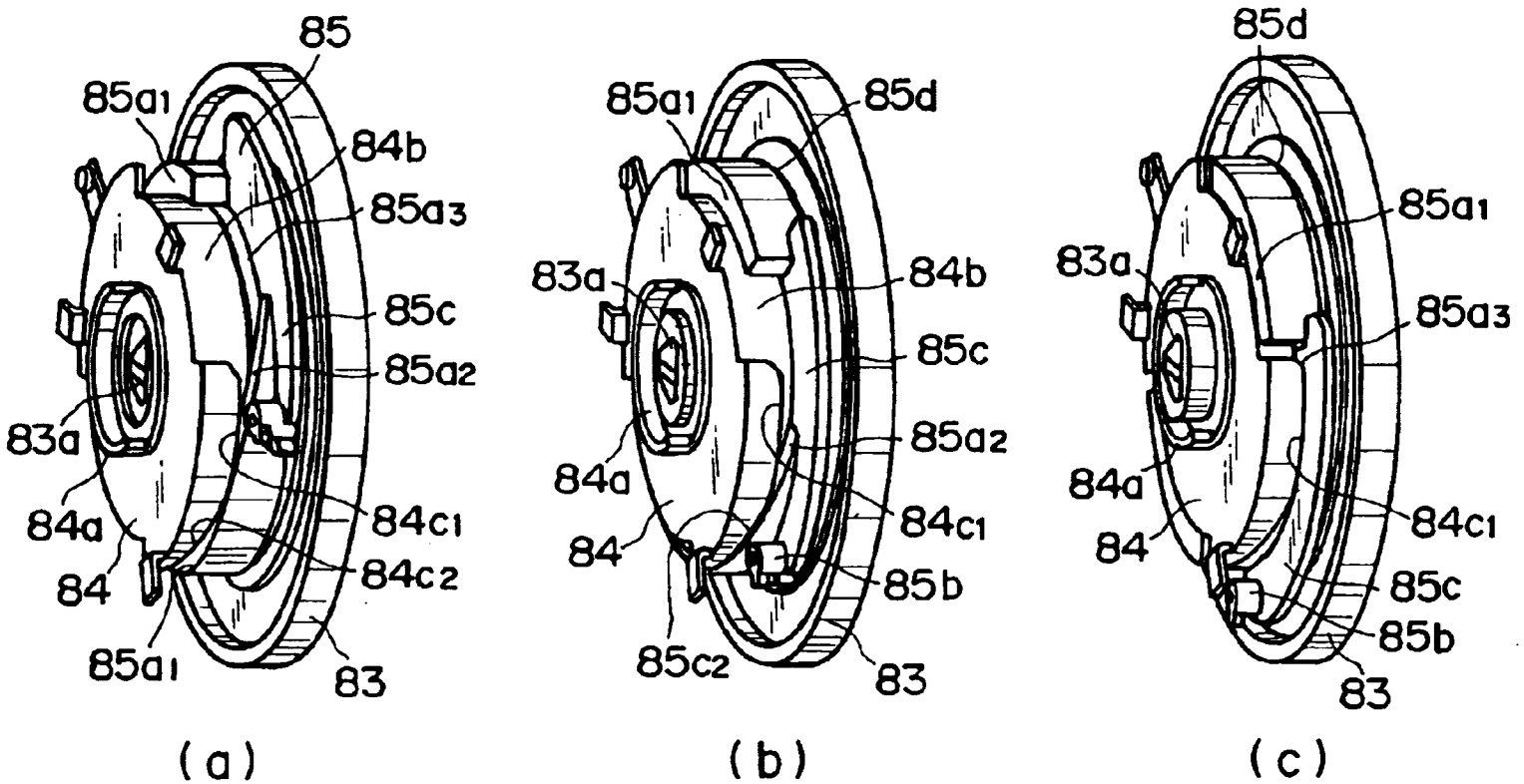
FIGS. 50(*a*), (*b*), and (*c*) are perspective views illustrating advancement and retraction of a large gear by rotation of a coupling cam.

Referring to FIG. 50(C), as the coupling cam 85 is fitted around the cylindrical portion 84*b* of the inward bearing 84 in such a manner than the raised surface 84*c*1 contacts the bottom portion 85*a*3, it approaches the inner plate 40, with the presence of a small amount of play relative to the inward bearing 84 in terms of their rotational direction, and the coupling 83*a* of the large gear 83 is made to intrude into the image forming apparatus by the resiliency of the spring disposed between the large gear 83 and the outward bearing 86, becoming ready to be engaged with the drum coupling 7*a*1 of the process cartridge B.

Referring to FIG. 50(B), as the coupling cam 85 is rotated, the inclined surfaces 84*c*2 and 85*a*2 come into contact with each other, and begin to slide against each other. As a result, the coupling cam 85 begins to be moved in the direction to move away from the inner plate 40. Consequently, the back surface 85*d* of the coupling cam 85 begins to push out the large gear 83 in the direction to move away from the inner plate 40 against the resiliency of the spring disposed between the large gear 83 and the outward bearing 86, making the large gear coupling 83*a* begin to disengage from the drum coupling 7*a*. Further, as the raised surface 85*a*1 of the coupling cam 85 comes into contact with the raised surface 84*c*1 as the result of the rotation of the coupling cam 85, the coupling cam 85 moves away from the inner plate 40 by a distance equal to the height of the raised portion 85*a*1 and base portion 85*a*3, which in turn moves the large gear 83 into a retreat position where the coupling 83*a* of the large gear 83 is completely free from the drum coupling 7*a*. When the large gear 83 is at its retreat position, the end surface of the large gear coupling 83*a* is recessed from the inward surface of the inner plate 40, and also has retreated from the moving path of the positioning guide 18*a* of the process cartridge B.

As has been described up to this point, the coupling means of the image forming apparatus in this embodiment is engaged or disengaged, that is, enabled or disabled to transmit a driving force, by being moved in the direction parallel to the rotational axis of the photoconductive drum 7, that is, the direction perpendicular to the direction in which the process cartridge B is moved, by the coupling means controlling means. Thus, each step of the movements of the process cartridge B and coupling means controlling means must be always carried out in the proper sequence. When the large gear coupling 83*a* as the coupling means is ready to be engaged, it is partially in the path of the positioning guide 18*a*, within the hollow of which the drum coupling 7*a*, which engages with the large gear coupling 83*a*, is located. Therefore, if the large gear coupling 83*a* becomes ready for engagement prior to the mounting of the process cartridge B, the positioning guide 18*a* collides with the large gear coupling 83*a* during the mounting of the process cartridge B, preventing the process cartridge B from being inserted further.

Incidentally, when an attempt is made to take the process cartridge B out of the apparatus main assembly before the disengagement of the coupling means, the driven-side of the process cartridge B cannot be moved because of the engagement between the coupling on the process cartridge B side and the coupling on the apparatus main assembly side.

In a case that the two processes of conveying the process cartridge B and driving the coupling means controlling means are carried out by the rotational movement of the opening/closing cover 15, it is necessary to provide a mechanism which guarantees that during the closing movement of the opening/closing cover 15, the coupling means is readied for engagement by the coupling means controlling means, after the completion of the movement of the process cartridge B, whereas during the opening of the opening/closing cover 15, the process cartridge B becomes ready for removal, after the disengagement of the coupling means by the coupling means controlling means.

Next, the mechanism for guaranteeing that the above described two processes will be carried out in the proper sequence, will be described.

When the opening/closing cover 15 is completely open (FIG. 27), the cam surfaces of the coupling cam 85 and inward bearing 84 are in contact with each other by the raised surface 84*c*1 and raised surface 85*a*1, and the large gear 83 is in the retreat position, being away from the inner plate 40. The contact surfaces of the raised surfaces of the coupling cam 85 and inward bearing 84 are inclined at a predetermined angle, and in order for the two raised surfaces to come into contact with each other, it is necessary for the coupling cam 85 to rotate through a certain angle. The thruster rod 55 is engaged with the boss 85*b* of the coupling cam 85, the boss 85*b* being fitted in the keyhole-like hole 55*a* of the thruster rod 55, and is in contact with the second boss 50*g* of the right cam plate 50 near the end of the arcuate portion 55*b*3 of the elongated hole 55*b*. A stopper rib 60 extending in the lengthwise direction of the process cartridge B from the surface of the inner plate 40 is within the recess of the backup portion 55*g*. The arcuate portion 55*b*3 of the elongated hole 55*b* is configured so that when the thruster rod 55 is in the above described state, the center of the curvature of the arcuate portion 55*b*3 virtually coincides with the axial line of the rotational shaft 50*a*. The claws 50*g*1 and 50*g*2 located at the end of the second boss 50*g* of the cam plate 50 remain outside the elongated hole 55*b*, always functioning to prevent the disengagement between the second boss 50*g* and thruster rod 55 during the movement of the thruster rod 55. A tension spring is stretched between the boss located below the arcuate portion 55*b*3 of the elongated hole 55*b*, and the inner plate 40. The second boss 50*g* is kept in contact with the top wall of the arcuate portion 55*b*3 of the elongated hole 55*b*.

Up to this point, the process, in which the moving guide 41 is moved by the rotational closing movement of the opening/closing cover 15, and the process cartridge B is moved by the movement of the moving guide 41, has been described. Next, the structure which prevents the coupling cam 85 as the coupling means controlling means from rotating will be described.

While the second boss 41*c* of the moving guide 41 is moving in the arcuate portion 40*b*1 of the second guide rail 40*b*, the second boss 50*g* of the cam plate 50 moves in the arcuate portion 55*b*3 of the elongated hole 55*b* of the thruster rod 55. The center of the curvature of the arcuate portion 55*b*3 practically coincides with the axial line of the rotational shaft 50*a*. Therefore, during this movement of the second boss 50*g*, the thruster rod 55 maintains the attitude which it assumes when the opening/closing cover 15 is completely open. Thus, the coupling cam 85 is not rotated to move the large gear 83 (FIGS. 27–42).

Figure 51:
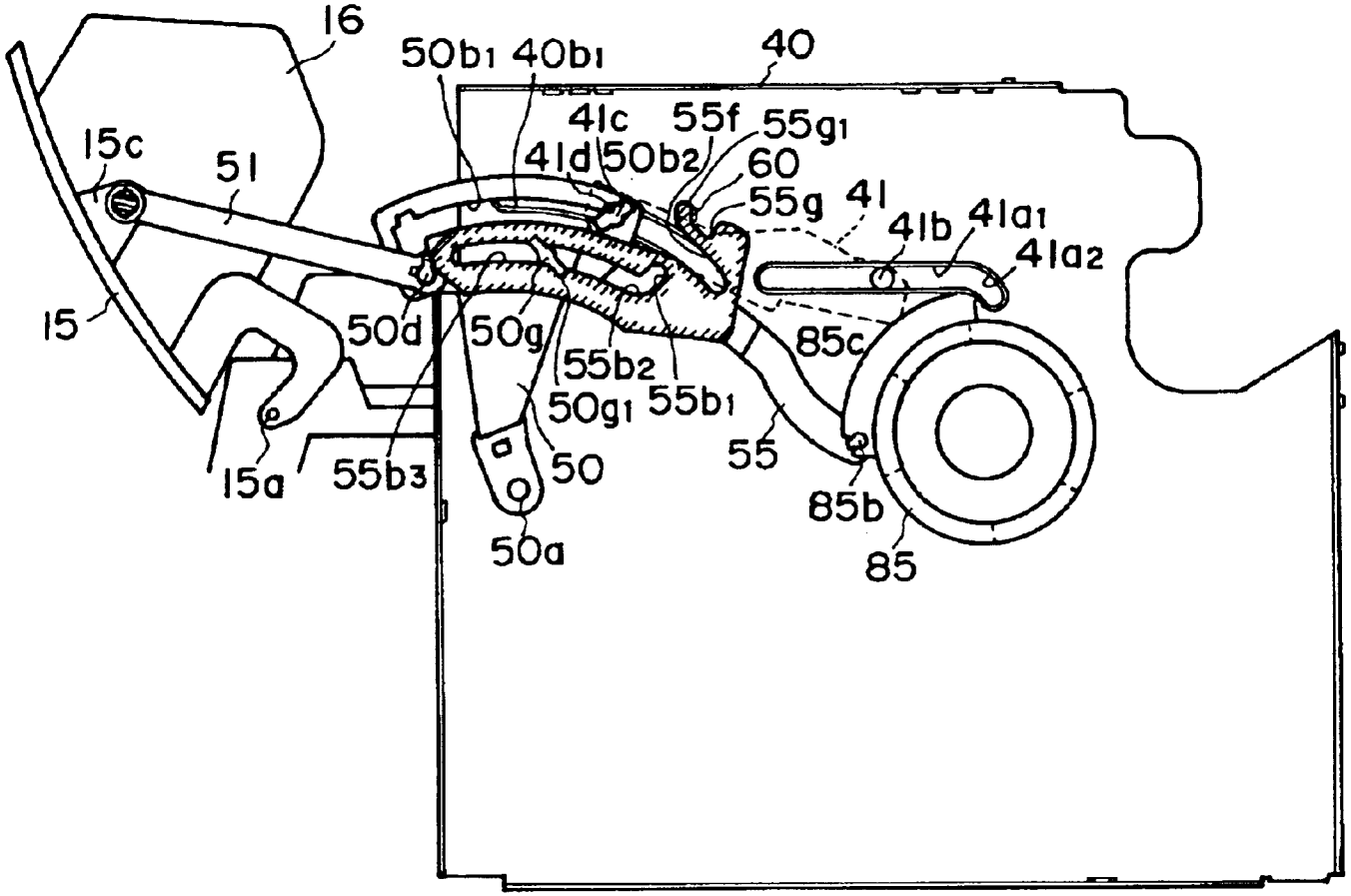
FIG. 51 is an illustration of an obstruction against the thruster rod during transportation of the process cartridge.

Even if an unexpected external force acts upon the thruster rod 55 in the direction to make the thruster rod 55 advance, while the second boss 50*g* is moving in the arcuate portion 55*b*3 of the elongated hole 53*b*, the backup surface 55*g*1 of the backup portion 55*g* comes into contact with the stopper rib 60, as shown in FIG. 51, ensuring that the thruster rod 55 is prevented from advancing, in order to prevent the coupling cam 85 from being rotated. In order for the backup surface 55*g*1 of the backup portion 55*g* to pass the stopper rib 60, the thruster rod 55, which is in the position shown in FIG. 27, must rotate about the axial line of the keyhole-like hole 55*a*, in which the boss 85*b* of the coupling cam 85 is fitted to connect the thruster rod 55 and coupling cam 85, so that the top end of the backup surface 55*g*1 moves below the bottom end of the stopper rib 60. However, such rotation of the thruster rod 55 is impossible while the second boss 50*g* of the cam plate 50 is in the arcuate portion 55*b*3 or inclined portion 55*b*2 of the elongated hole 55*b*. Therefore, the backup surface 55*g*1 and stopper rib 60 are made to remain in contact with each other, preventing the coupling cam 85 from beginning to rotate while the moving guide 41 is moving.

Referring to FIG. 36, as the second boss 41*c* of the moving guide 41 comes close to the border between the arcuate portion 40*b*1 and straight portion of the second guide rail 40*b*, a timing boss 41*d*, with which only the right moving guide 41 is provided, enters the U-shaped groove, which is located under the lifting portion 55*f* and is open toward the opening/closing cover 15, and then, the second boss 50*g* of the cam plate 50 moves into the inclined portion 55*b*2 of the elongated hole 55*b* (FIG. 42). While the second boss 50*g* of the cam plate 50 is in the inclined portion 55*b*2 of the elongated hole 55*b*, the thruster rod 55 is prevented by the stopper rib 60 from advancing. Therefore, the rotation of the coupling cam 85 has yet to begin.

As the second boss 50*g* of the cam plate 50 reaches the border between the inclined portion 55*b*2 and straight portion 55*b*1 of the thruster rod 55, the thruster rod 55 is rotated by the resiliency of the tension spring 56 about the axial line of the keyhole-like hole 55*a* in the counterclockwise direction, guiding the second boss 50*g* of the cam plate 50 into the straight portion 55*b*1 of the elongated hole 55*b*. As a result, the thruster rod 55 begins to move in the direction to allow the backup portion 55*g* to pass the stopper rib 60. However, when the second boss 41*c* of the moving guide 41 is above the straight portion 40*b*2 of the second guide rail 40*b* as shown in FIG. 45, the timing boss 41*d* located at the end of the second boss 41*c* of the moving guide 41 is in contact with the lifting surface 55*f* of thruster rod 55. Therefore, it is impossible for the backup portion 55*g* of the thruster rod 55 to pass the stopper rib 60.

Referring to FIG. 48, the cam plate 50 is rotated by the closing movement of the opening/closing cover 15 until the second boss 41*c* of the moving guide 41 moves downward in the straight portion 40*b*2 of the second guide rail 40*b*, and the timing boss 41*d* at the end of second boss 41*c* of the moving guide 41 also moves down and separates from the lifting portion 55*f*. As a result, the backup portion 55*g* of the thruster rod 55 is allowed to pass the stopper rib 60, and is pulled down by the resiliency of the tension spring until the top end of the straight portion 55*b*1 of the thruster rod 55 butts against the second boss 50*g* of the cam plate 50.

During the period between when the timing boss 50*d* comes into contact with the lifting surface 55*f* and when they separate from each other, the thruster rod 55 begins to rotate the coupling cam 85. However, the angle by which the coupling cam 85 is rotated during this period is set in a range in which the coupling cam 85 and inward bearing 84 remain in contact with each other by their raised surfaces 85*a*1 and 84*c*1, respectively. Therefore, the large gear coupling 83*a* does not begin to move.

As has been described above, while the moving guide 41 is moved by the rotation of the opening/closing cover 15, the second boss 50*g* of the cam plate 50, which drives the thruster rod 55, moves in the arcuate portion 55*b*3 and inclined portion 55*b*2 of the elongated hole 55*b* of the thruster rod 55. Therefore, the thruster rod 55 does not move. In addition, the movement of the thruster rod 55 is regulated by the condition that the stopper rib 60 is in the backup portion 55*g*. Thus, while the process cartridge B is conveyed by the movement of the moving guide 41 linked to the rotation of the opening/closing cover 15, the large gear 83 as the coupling means does not become ready to be engaged for driving force transmission, and therefore, does not interfere with the process cartridge conveyance.

Figure 52:
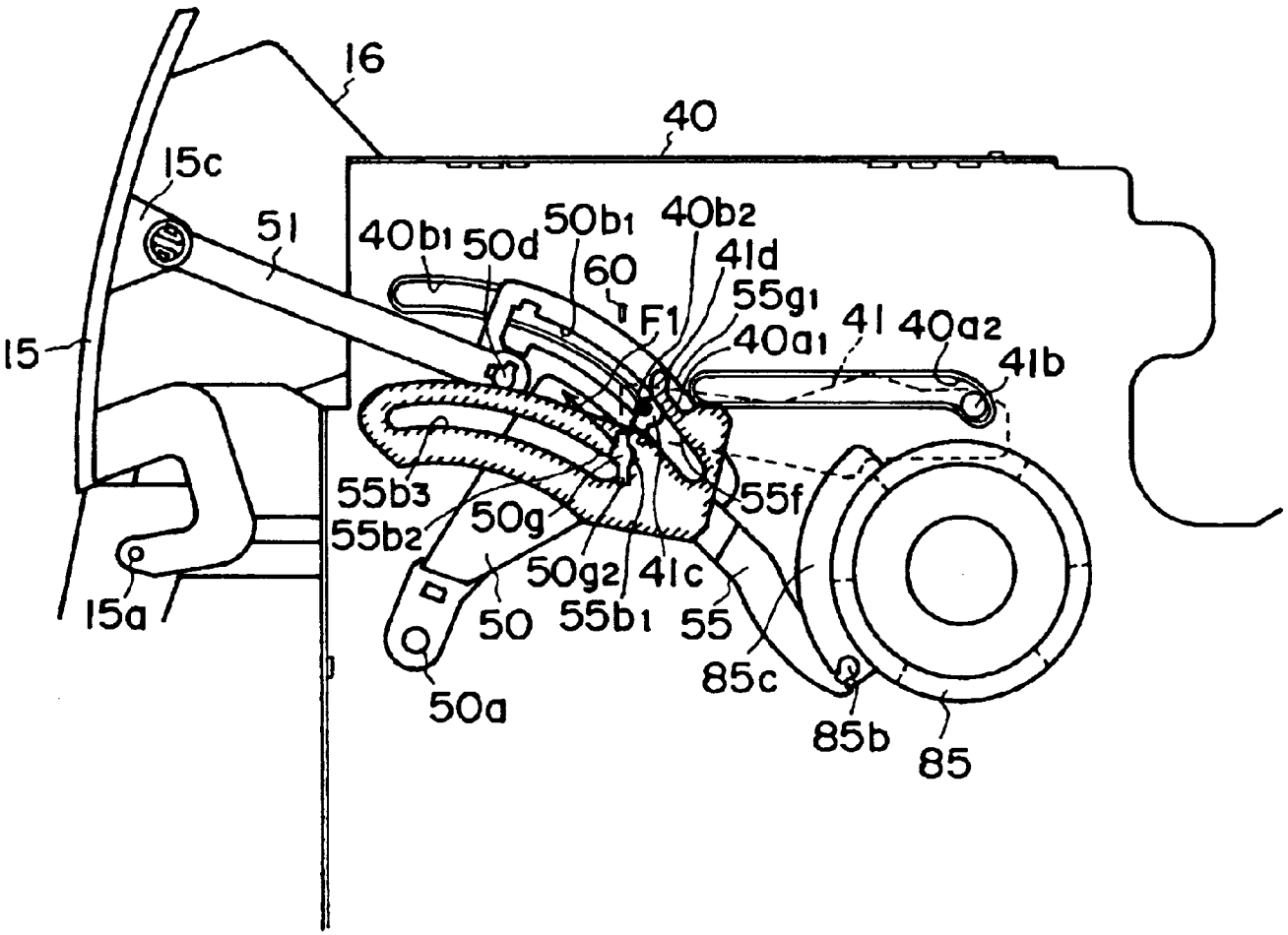
FIG. 52 is an illustration of the rotation of the coupling cam by the process cartridge mounting-and-demounting mechanism.

Referring to FIG. 52, as the opening/closing cover 15 is further closed after the completion of the movement of the moving guide 41, the arcuate portion 50*b*1 of the cam hole 50*b* of the cam plate 50 rotates along the second boss 41*c* of the moving guide 41. Thus, the moving guide 41 remains in the second location in the image forming apparatus, and the end of the straight portion 55*b*1 of the elongated hole 55*b* of the thruster rod 55 is made to contact the second boss 50*g* of the cam plate 50, by the resiliency of the tension spring, establishing the four-joint linkage comprising the thruster rod 55 and coupling cam 85.

As a result, after the completion of the movement of the moving guide 41, the coupling cam 85 is rotationally driven by the rotation of the cam plate 50, causing the boss 85*b* of the coupling cam 85, by which the coupling cam 85 is connected to the thruster rod 55, to move downward.

Then, as the opening/closing cover 15 is further rotated, the state of the contact between the coupling cam 85 and inward bearing 84 shifts to the contact between their inclined surfaces 85*a*2 and 84*c*2, and the large gear 83 comes under the pressure from the spring between the large gear 83 and outward bearing 86. As a result, the large gear coupling 83*a* is forced to intrude into the hole of the inner plate 40. When the twisted hole at the intruding end of the large gear coupling 83*a* is not coincidental in rotational phase with the twisted projection located at the end of the drum coupling 7*a*1 located in the hollow of the positioning guide 18*a* and coaxial with the positioning guide 18*a*, the intrusion of the large gear coupling 83*a* into the hole of the inner plate 40 stops as the intruding end of the large gear coupling 83*a* comes into contact with the end of the drum coupling 7*a*1.

Figure 53:
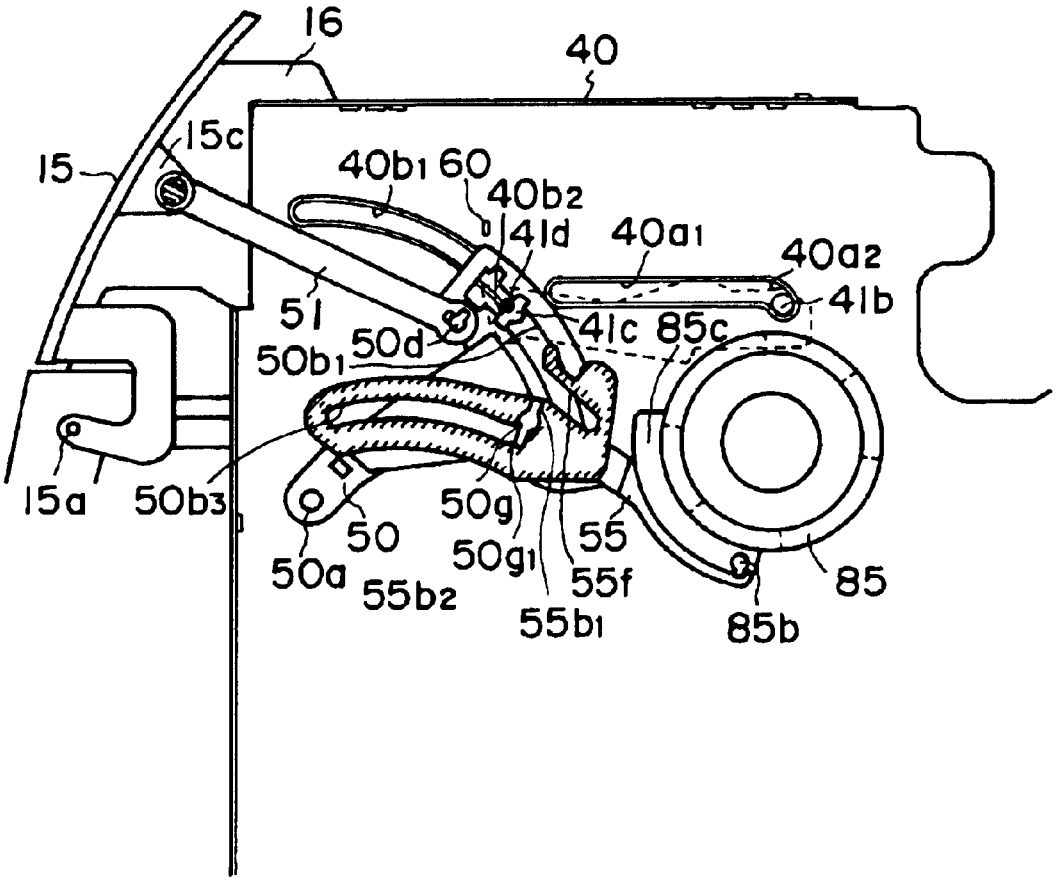
FIG. 53 is an illustration of rotation of the coupling cam by the process cartridge mounting-and-demounting mechanism.

Then, before the opening/closing cover 15 completely closes, the coupling cam 85 rotates through a certain angle until it becomes possible for the base portion 85*a*3 of the cam surface 85*a* of the coupling cam 85 to contact the raised surface 84*c*1 of the cam surface of the inward bearing 84. By the time the opening/closing cover 15 completely closes, the inclined surfaces 84*c*2 and 85*a*2 of the inward bearing 84 and coupling cam 85 separate from each other, and remain separated, as shown in FIG. 53.

In the preceding description of the present invention, it was stated that the end of large gear coupling 83*a* stops intruding into the hole of the inner plate 40 as it comes into contact with the end of the drum coupling 7*a*1. However, when the opening/closing cover 15 is closed without mounting the process cartridge B, the large gear 83 moves until it comes into contact with the inward bearing 84. Therefore, the large gear coupling 83*a* protrudes a substantial distance into the inward side of the inner plate 40.

This concludes the description of the mechanism for ensuring that the process of conveying the process cartridge B by the movement of the moving guide 41 during the first half of the closing movement of the opening/closing cover 15, and the process of readying the coupling means by the coupling means controlling means to be engaged for driving force transmission during the latter half of the closing movement of the opening/closing cover 15, are carried out in the correct order.

(Driving of Process Cartridge Positioning Means on Left Side)

As described before, during the process cartridge conveyance by the movement of the moving guide 41 linked by the rotation of the opening/closing cover 15, the left positioning guide 18*a* is not in the positioning portion 90*a* of the conveyance frame 90. This is for the following reason. For the purpose of reducing the load which acts upon the process cartridge B during its conveyance, the left positioning guide 18*a* is not provided with a spring for keeping the left positioning guide 18*a* pressed upon the positioning portion 90*a*. Therefore, the process cartridge conveyance by the moving guide 41 alone cannot engage the left positioning guide 18*a* into the positioning portion 90*a* against the contact pressure generated by the transfer roller 4 and various electrical contacts 92.

On the outward side of the left inner plate 40, the pusher arm 52 is provided, which functions as a process cartridge positioning means, and is driven by the cam plate 50. The pusher arm 52 is provided with the resilient pressing portion 52*b*, which protrudes into the inward side of the inner plate 40 through the fan-shaped hole 40*h* of the left inner plate 40, and is supported at a position away from the positioning portion 90*a*, that allows it to oscillate.

On the other hand, the left positioning guide 18*a* of the process cartridge B is provided with a mounting assistance auxiliary guide 18*a*1, which extends backward in terms of the process cartridge mounting direction. The rear end of this mounting assistance guide 18*a*1 constitutes a contact portion 18*a*2, which comes into contact with the resilient pressing portion 52*b* of the pusher arm 52. In this embodiment, the contact portion 18*a*2 is made arcuate so that the center of its curvature coincides with the axial line of the positioning guide 18*a*. With this structural arrangement, the variance in the positional relationship of the contact portion 18*a*2 relative to the resilient pressing portion 52*b* is minimized, when the positioning guide 18*a* settles into the positioning portion 90*a*.

During the conveyance of the process cartridge B, the pushing arm 52 remains in the retreat position, in which the resilient pressing portion 52*b* of the pusher arm 52 is outside the paths of the positioning guide 18*a* and portion 18*a*1. In this state, as the pushing arm 52 is driven by the cam plate 50, the resilient pressing portion 52*b* pushes the positioning guide 18*a* into the positioning portion 90*a* after the completion of the cartridge conveyance, and comes to a retaining position because the positioning guide 18*a* must be prevented from being moved out of the positioning portion 90*a* by the external force which acts on the process cartridge B, for example, the force generated by the recording medium in the direction to lift the photoconductive drum 7 during image formation, in addition to the contact pressure from the transfer roller 4 and electrical contacts 92.

In order to minimize the angle which the pusher arm 52 must rotate to move the resilient pressing portion 52*b* from the retaining portion to retreat position, the mounting assistance auxiliary guide 18*a*1, which is behind the positioning guide 18*a* in terms of the process cartridge mounting direction, is provided with the pressure catching portion 18*a*2, which is located on the peripheral surface, keeping the resilient pressing portion 52*b* of the pusher arm 52 away from the rotational shaft 52*a*. If the angle, by which the pusher arm 52 must rotate to place the resilient pressing portion 52*b* of the pusher arm 52 in contact with the peripheral surface of the positioning guide 18*a*, is increased to keep the resilient pressing portion 52*b* away from the paths of the positioning guide 18*a* and mounting assistance auxiliary guide 18*a*1, the distance between the retreat position of the boss 52*c*, which is driven by the cam plate 50 located ahead of the resilient pressing portion 52*b* in terms of the process cartridge mounting direction, and the rotational shaft 50*a* of the cam plate 50, increases. Consequently, the end of the arm driving portion 50*h*1 must be extended in the outward direction in terms of the radius direction of the cam plate 50, requiring a larger space for the rotation of the cam plate 50, which is a problem.

The top surface of the mounting assistance auxiliary guide 18*a*1 is an inclined surface, tilting toward the peripheral surface of the positioning guide 18*a*. This inclined surface assures that the pressure catching surface 18*a*2 contacts the resilient pressing portion 52*b* to minimize the protrusion of the mounting assistance auxiliary guide 18*a*1 from the path of the positioning guide 18*a*, within the area on the inward side of the rotational radius of the resilient pressing portion 52*b*. With this arrangement, the clearance between the resilient pressing portion 52*b* in its retreat position, and the path of the mounting assistance auxiliary guide 18*a*1, is secured.

In other words, the pressure catching portion 18*a*2 is such a pressure catching portion that is located on the upstream side of the cartridge positioning portion 18*a*, in terms of the direction in which the process cartridge B is mounted into the apparatus main assembly 14, and also is located away from the cartridge positioning portion 18*a*. It comes under the pressure from resilient pressing portion 52*b* of the apparatus main assembly 14, as the process cartridge B is moved into the proper cartridge position S in the apparatus main assembly 14. Further, the pressure catching portion 18*a*2 is in the form of an arc, the center of which coincides with the axial line of the photoconductive drum 7. The cartridge frame CF, the cartridge positioning portion 18*a*, and the pressure catching portion 18*a*2, are integrally formed of plastic.

The pressure catching portion 18*a*2 is located on the upstream side of the cartridge positioning portion 18*a*, in terms of the direction in which the process cartridge B is mounted into the apparatus main assembly 14, and also is located away from the cartridge positioning portion 18*a*. It comes under the pressure from the resilient pressing portion 52*b* of the apparatus main assembly 14, as the opening/closing cover 15 is closed.

The movement of the pusher arm 52 is similar to that of the coupling means controlling means in that it must be carried out in the proper order. In other words, it is necessary that during the closing movement of the opening/closing cover 15, the pusher arm 52 begins to rotate after the completion of the conveyance of the process cartridge B, and during the opening movement of the opening/closing cover 15, the process cartridge B begins to move after the completion of the rotation of the pusher arm 52. More specifically, during the closing movement of the opening/closing cover 15, the pusher arm 52 rotates, moving the process cartridge B to a predetermined location, after the completion of the movement of the moving guide 41, and then, it retains the process cartridge B in the positioning portion. These functions of the pusher arm 52 will be described next.

When the pusher arm 52 is in the retreat position, in which it is holding up the resilient pressing portion 52*b*, by being pressured by the resiliency of the helical torsion coil spring 53, the boss 52*c* is at a point at which it is about to cross the path of the open end of the arm driving portion 50*h*1 of the second cam portion 50*h*, after the cam plate 50 has moved the moving guide 41 to the second location.

Thus, as the opening/closing cover 15 is closed further after the completion of the movement of the moving guide 41, the arm driving portion 50*h*1 of the second cam portion 50*h* of the cam plate 50 takes in the boss 52*c* of the pusher arm 52. During the closing movement of the opening/closing cover 15, the boss 52*c* contacts the outward wall of the second cam portion 50*h*, and rotates the pusher arm 52 in the clockwise direction about the arm driving portion 50*h*1 of the second cam portion 50*h* against the resiliency of the helical torsion coil spring 53. Therefore, as the cam plate 50 rotates, the boss 52*c* moves deeper into the arm driving portion 50*h*1. By this rotation of the pusher arm 52, the resilient pressing portion 52*b* of the pusher arm 52 is moved closer to the mounting assistance guide 18*a*1 of the process cartridge B.

At this point, the positioning guide 18*a* of the process cartridge B has yet to fit into the positioning portion 90*a* of the conveyance frame 90. Therefore, the mounting assistance auxiliary guide 18*a*1 on the peripheral surface of the positioning guide 18*a* is outside the rotational path of the pressure application or contact surface 52*b*1 of the resilient pressing portion 52*b* of the pusher arm 52.

Figure 55:
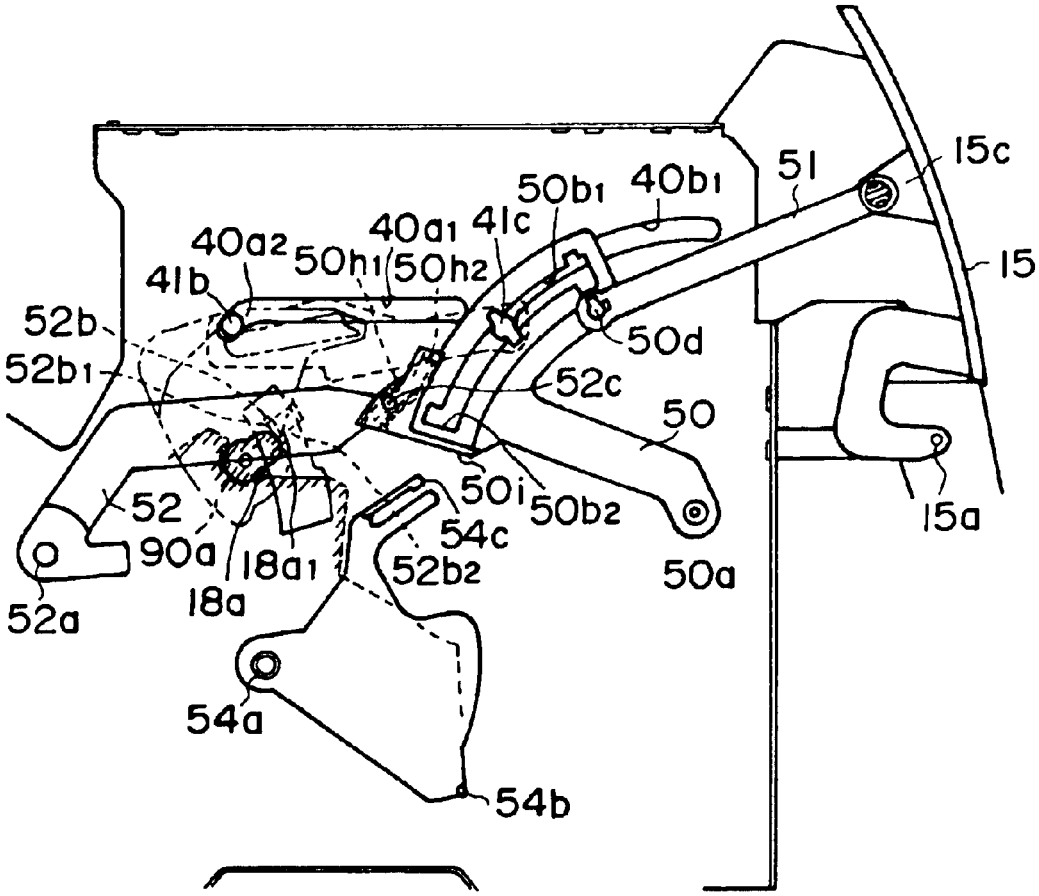
FIG. 55 is an illustration of an operation of an interrelating switch and a swing action of a pushing arm by the process cartridge mounting-and-demounting mechanism.

As the pusher arm 52 rotates about the rotational shaft 52*a* due to further rotation of the cam plate 50, the pulling surface 52*b*2, which is on the upstream side of the resilient pressing portion 52*b* in terms of the rotational direction of the pusher arm 52 and is tilted more in the outward direction, in terms of the radius direction of the rotation of the pusher arm 52, comes into contact with the mounting assistance auxiliary guide 18*a*1 on the upstream side of the peripheral surface of the positioning guide 18*a*, in terms of the process cartridge mounting direction with respect to a predetermined position (FIG. 55).

Figure 56:
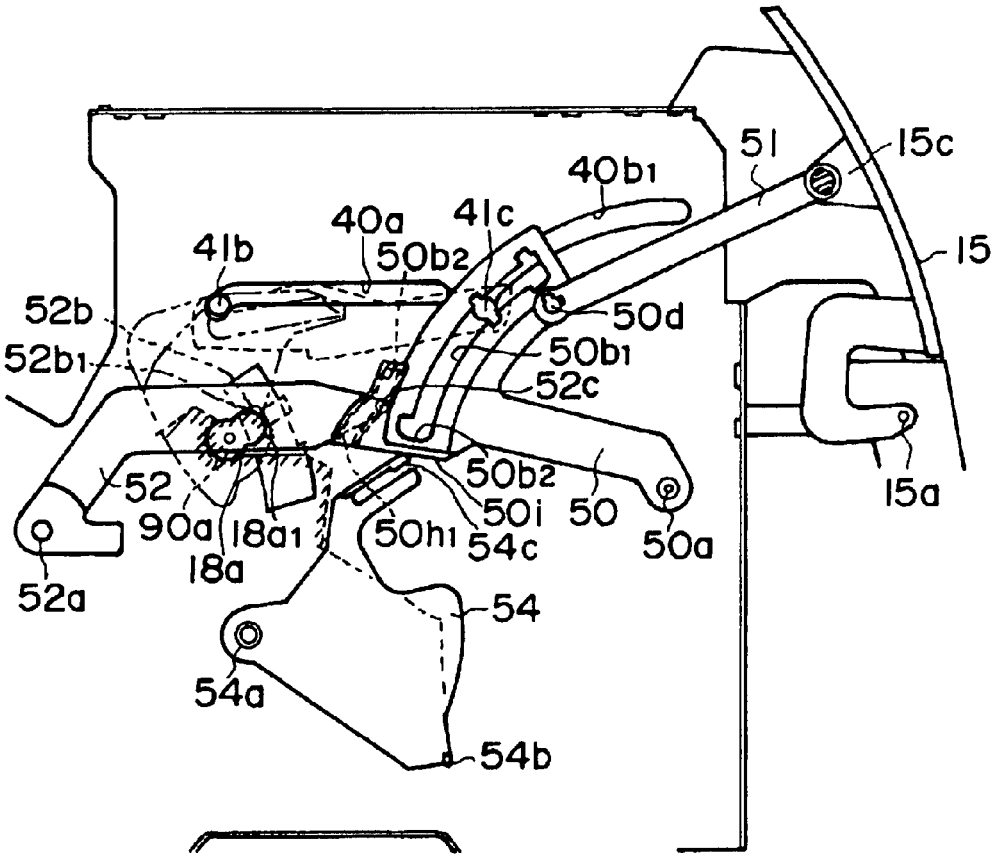
FIG. 56 is an illustration of an operation of an interrelating switch and a swing action of a pushing arm by the process cartridge mounting-and-demounting mechanism.

As the resilient pressing portion 52*b* is further rotated after the pulling surface 52*b*2 comes into contact with the round corner 18*a*4 of the mounting assistance auxiliary guide 18*a*1, which connects the inclined surface and the pressure catching portion 18*a*2 of the mounting assistance auxiliary guide 18*a*1, the process cartridge B begins to be pressured by the slanted pulling surface 52*b*2 in the direction to fit the positioning guide 18*a* into the positioning portion 90*a*, and the round corner of the mounting assistance auxiliary guide 18*a*1 comes into contact with the contact surface 52*b*1 of the resilient pressing portion 52*b*, on the rotational shaft 52*a* side. Then, as this contact surface 52*b*1 comes into contact with the pressure catching portion 18*a*2, which is on the peripheral surface of the mounting assistance auxiliary guide 18*a*1, the positioning guide 18*a* fits into the positioning portion 90*a*, as shown in FIG. 56, ending the positioning of the process cartridge B in the apparatus main assembly.

Figure 57:
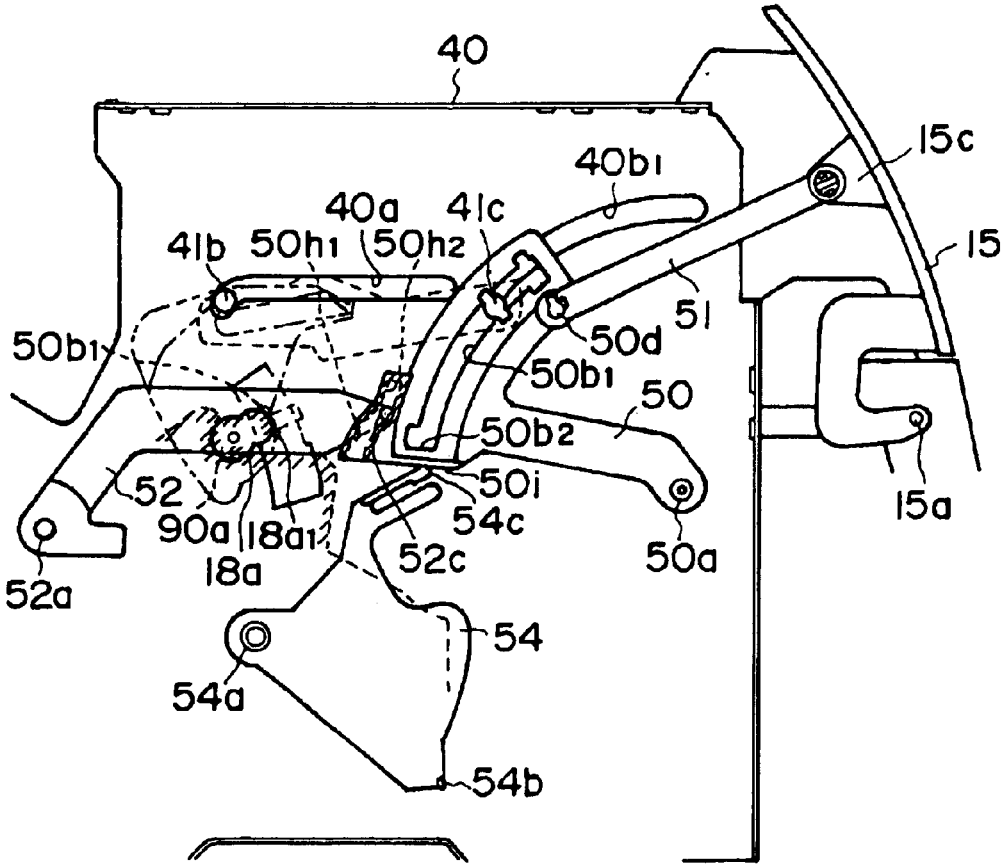
FIG. 57 is an illustration of an operation of an interrelating switch and a swing action of a pushing arm by the process cartridge mounting-and-demounting mechanism.

Even after pusher the positioning guide 18*a* into the positioning portion 90*a* by the resilient pressing portion 52*b*, the pusher arm 52 continues to rotate until the resilient pressing portion 52*b* entirely enters the path of the pressure catching portion 18*a*2 to begin to properly support and retain the process cartridge B (FIG. 57).

Thereafter, as the cam plate 50 rotates further, the boss 52*c* moves past the arm driving portion 50*h*1 and moves into the arm retaining portion 50*h*2, the center of the curvature of which coincides with the rotational axis of the cam plate 50. As the result, the rotation of the pusher arm 52 stops.

Figure 58:
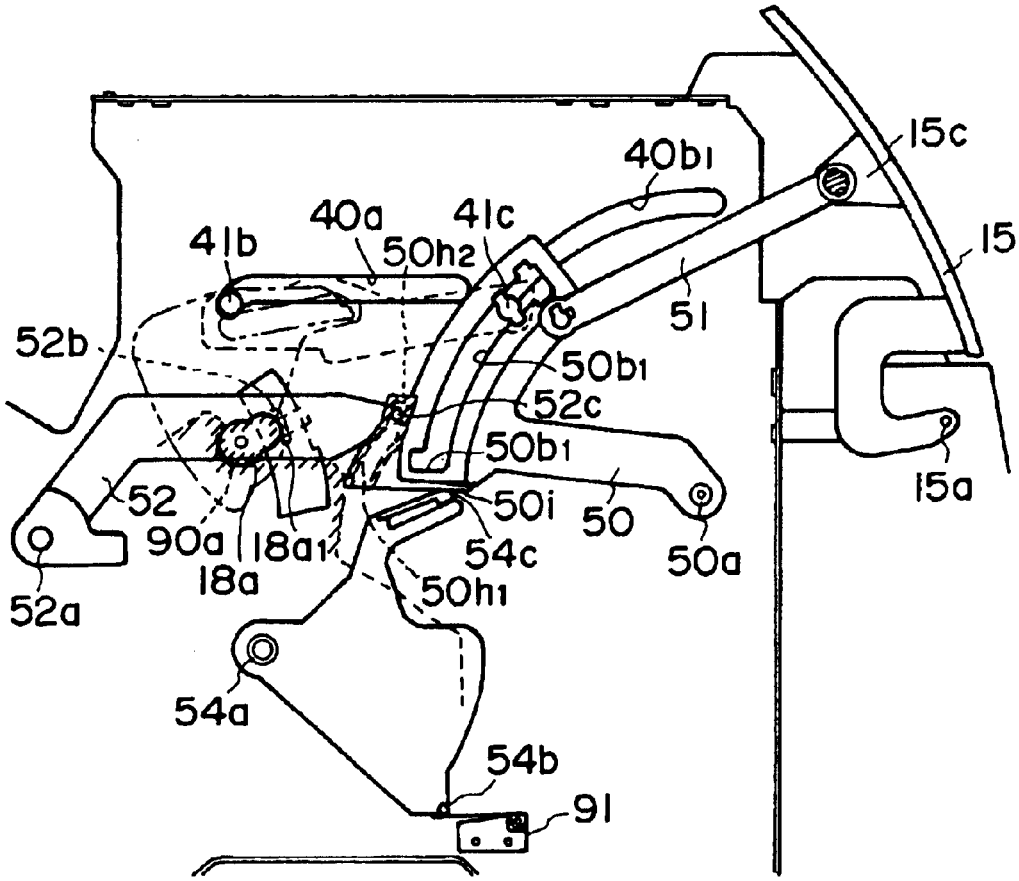
FIG. 58 is an illustration of an operation of an interrelating switch and a swing action of a pushing arm by the process cartridge mounting-and-demounting mechanism.

Thereafter, the cam plate 50 rotates further to a point at which it will ensure that the boss 52*c* of the pusher arm 52 has come into contact with the cam surface of the arm retaining portion 50*h*2, and which corresponds to the completely closed position of the opening/closing cover 15 (FIG. 58).

At this point, the resilient pressing portion 52*b* of the pusher arm 52 is in contact with the pressure catching portion 18*a*2 of the process cartridge B, and also, is completely in the path of the positioning guide 18*a*. Therefore, the process cartridge B is regulated in movement; in other words, it is retained in the positioning portion 90*a*.

In this state, the only direction in which the positioning guide 18*a* is allowed to move is the direction of the line connecting the resilient pressing portion 52*b* and rotational shaft 52*a*. Therefore, as an attempt is made to dislodge the process cartridge B from the positioning portion 90*a*, the reactive force which acts on the resilient pressing portion 52*b* is directed approximately toward the rotational shaft 52*a*, failing to rotate the pusher arm 52. Without the rotation of the pusher arm 52, the resilient pressing portion 52*b* does not unlatch from the pressure catching portion 18*a*2. Therefore, the process cartridge B remains retained in the positioning portion 90*a*, being properly positioned.

Regarding the relationship between the boss 52*c* of the pusher arm 52 and the second cam portion 50*h* of the cam plate 50 while they are in contact with each other, when the image forming apparatus is ready for image formation, that is, after the complete closing of the opening/closing cover 15, the boss 52*c* is in the arm retaining portion 50*h*2 of the second cam portion 50*h*, the center of the curvature of which coincides with the axial line of the rotational shaft 50*a* of the cam plate 50, being supported thereby. Therefore, even if an attempt is made to rotate the pusher arm 52, it is impossible for the pusher arm 52 to rotate the cam plate 50. Thus, neither does the opening/closing cover 15 open, nor is the image forming apparatus adversely affected.

(Activation of Interlocking Switch)

Up to this point, the placement of the process cartridge B in the apparatus main assembly linked to the closing movement of the opening/closing cover 15, the readying of the coupling means by the movement of the coupling means controlling means, for engagement, and the positioning and retaining of the left positioning guide of the process cartridge B by the pusher arm 52, in the positioning portion, have been described.

These processes completely end before the opening/closing cover 15 is completely closed. Thus, as the opening/closing cover 15 is completely closed, the interlocking switch 54 is activated, allowing electrical current to flow to ready the image forming apparatus for image formation. More specifically, as the microswitch 91 (FIG. 58) on the power source circuit board is pressed by an oscillatory lever, the image forming apparatus is turned on. Referring to FIGS. 54–58, the interlocking switch 54 is rotationally attached to the left inner plate 40. It makes contact with the oscillatory lever of the microswitch 91 (unshown in FIGS. 54–57), by the lever 54*b*, and is kept pressed upward by the resiliency of the microswitch 91.

The left cam plate 50 is provided with a contact surface 50*i*, which is located on the inward side, in terms of the radius direction of the curvature of the second cam portion 50*h*, of the second cam portion 50*h* located at the leading end of the left cam plate 50 in terms of the rotational direction of the cam plate 50. The contact surface 50*i* contacts the elastic portion 54*c* of the interlocking switch 54.

As the opening/closing cover 15 is closed, and the left cam plate 50 guides the boss 52*c* of the pusher arm 52 to the arm retaining portion 50*h*2 of the second cam portion 50*h*, the contact surface 50*i* comes into contact with the elastic portion 54*c* of the interlocking switch 54. Thereafter, while the cam plate 50 is moving the boss 52*c* of the pusher arm 52 to the outward wall of the arm retaining portion 50*h*2, the interlocking switch 54 rotates about the shaft 54*a* against the resiliency of the microswitch 91, causing the lever 54*b* to press the lever of the microswitch 91 downward to engage the microswitch 91. As a result, the image forming apparatus is turned on.

In order to ensure that the interlocking switch 54 is activated during the last stage of the rotational movement of the cam plate 50, the contact surface 50*i* of the cam plate 50 must be positioned as if it is partially in the contact portion of the interlocking switch 54 (FIG. 58), in consideration of the variance in the angle by which the cam plate 50 is rotated by the closing of the opening/closing cover 15. Therefore, the contact portion 54*c* of the interlocking switch 54 is rendered elastic so that the contact portion 54*c*, also called the elastic portion, elastically deforms to tolerate the hypothetical intrusion of cam plate 50.

(Method for Positioning Process Cartridge)

The turning on of the image forming apparatus concludes the last movement of the various mechanisms linked to the closing of the opening/closing cover 15; in other words, the complete closing of the opening/closing cover 15 readies the image forming apparatus for image formation. Thereafter, as the motor of the driving means rotates, the driving force is transmitted to the large gear 83, rotating the large gear 83. As the large gear 83 rotates, the twisted hole of the large gear coupling 83*a* becomes coincidental in rotational phase with the twisted projection of the drum coupling 7*a*1. As the twisted hole and projection coincide in rotational phase, the large gear coupling 83*a* is advanced by the spring located between the large gear 83 and outward bearing 86. Then, force is generated by the twist of both the couplings in the direction to cause the two couplings to pull each other. As a result, the end of the twisted projection of the drum coupling 7*a*1 comes into contact with the bottom surface of the twisted hole of the large gear coupling 83*a*, and is kept in contact therewith, by the force which is acting upon both the couplings in the direction to cause the couplings to pull each other, fixing thereby the positions of both couplings in terms of the lengthwise direction of the process cartridge B. Since the cross section of the twisted hole of the large gear coupling 83*a* and the cross section of the twisted projection of the drum coupling 7*a*1 are both in the form of a virtually equilateral triangle, and the axial lines of the twisted hole and twisted projection coincide with the large gear coupling 83*a* and drum coupling 7*a*1, respectively, the rotational axes of the large gear coupling 83*a* and drum coupling 7*a*1 become aligned with each other as the three lateral walls of the twisted hole come into contact with the corresponding three lateral edges of the twisted projection, allowing driving force to be smoothly transmitted.

Figure 59:
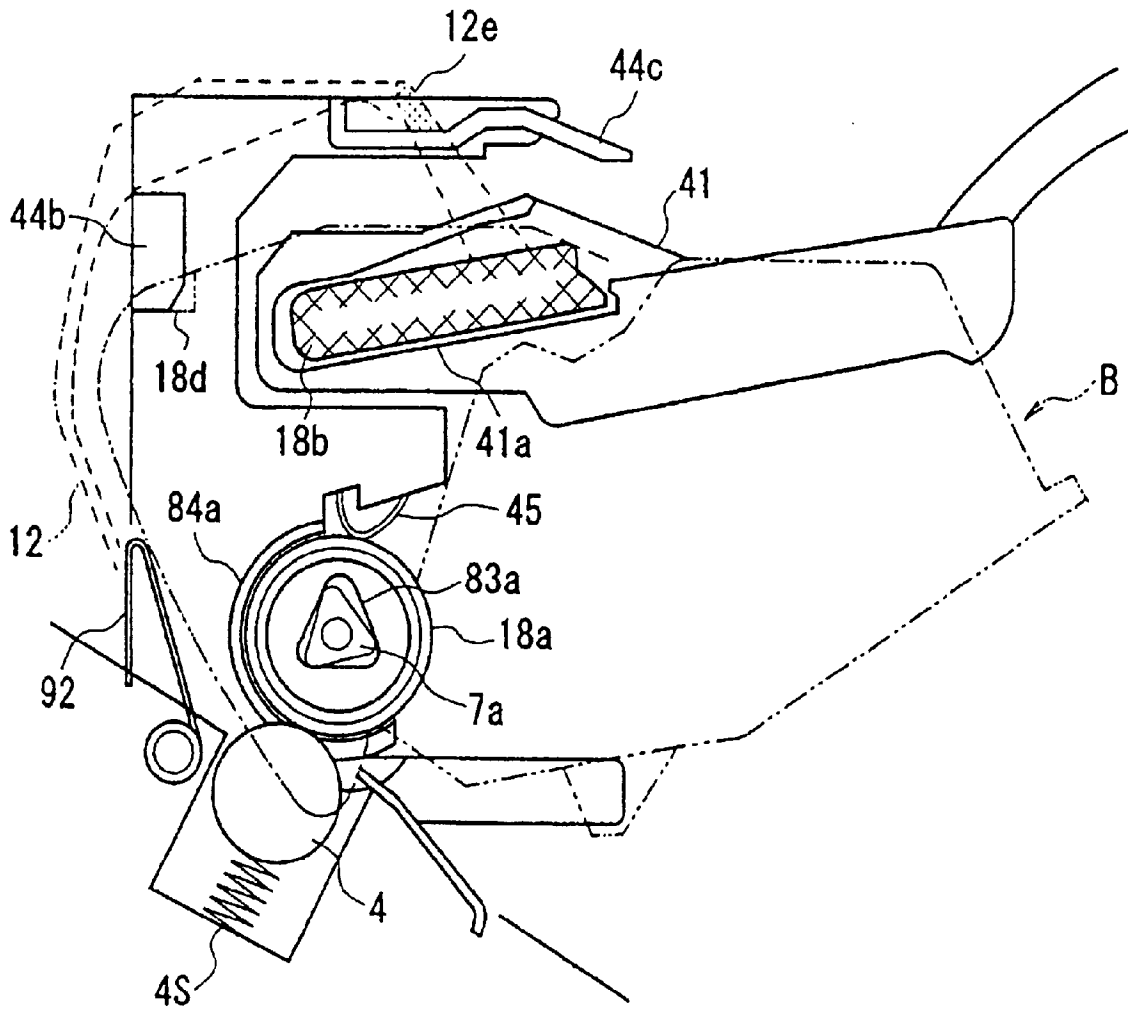
FIG. 59 is an illustration of the supporting of the process cartridge in an operative state with the cover closed.
Figure 60:
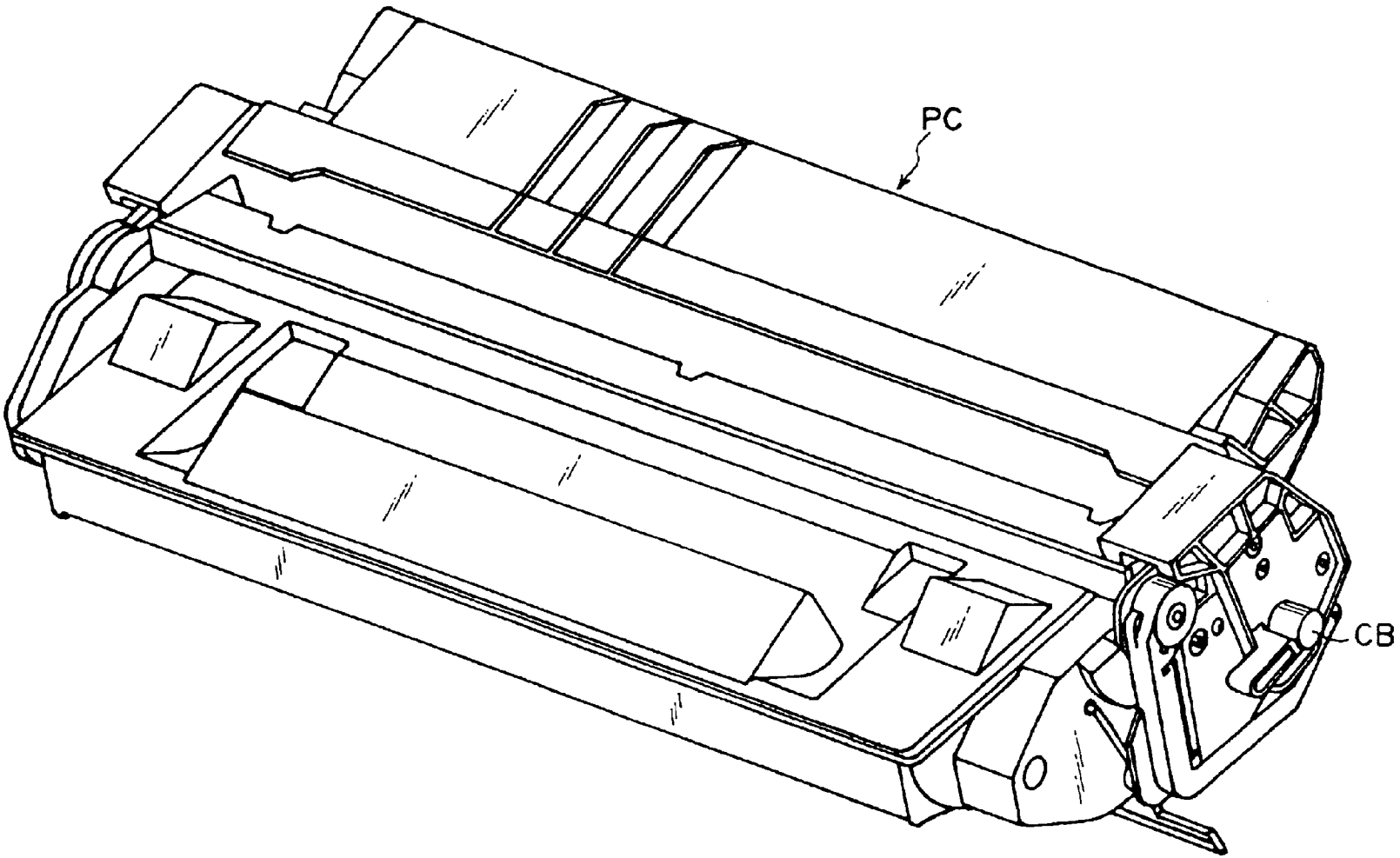
FIG. 60 is a perspective view of a process cartridge which is detachably mountable to a cartridge mounting guide provided in the main assembly of a conventional electrophotographic image forming apparatus.
Figure 61:
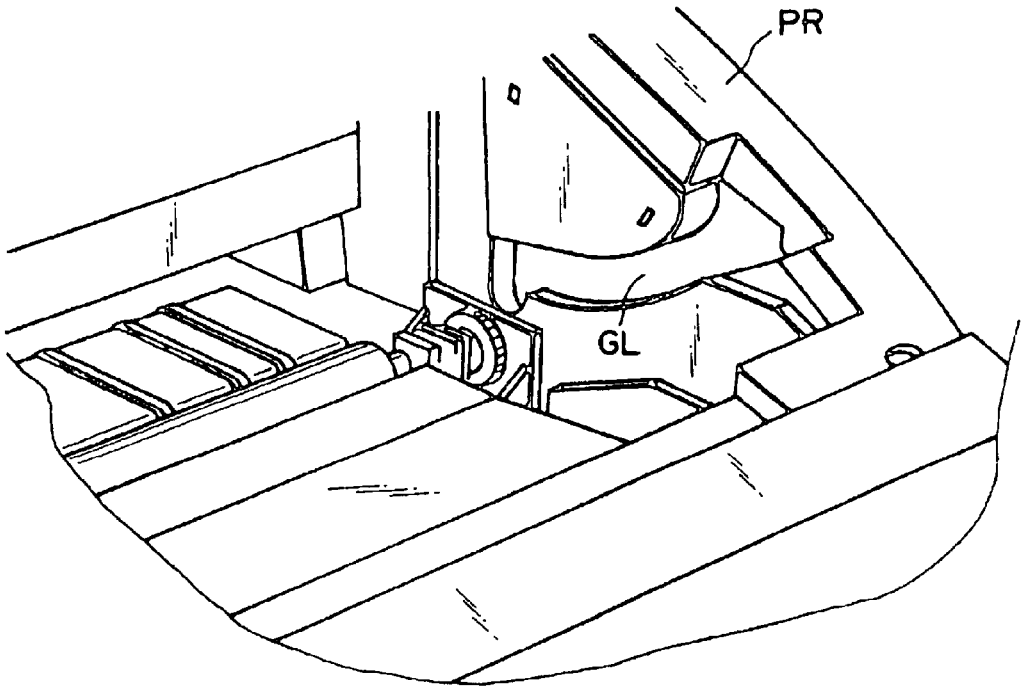
FIG. 61 is an illustration of a cartridge mounting guide provided in the main assembly of the conventional electrophotographic image forming apparatus.
Figure 62:
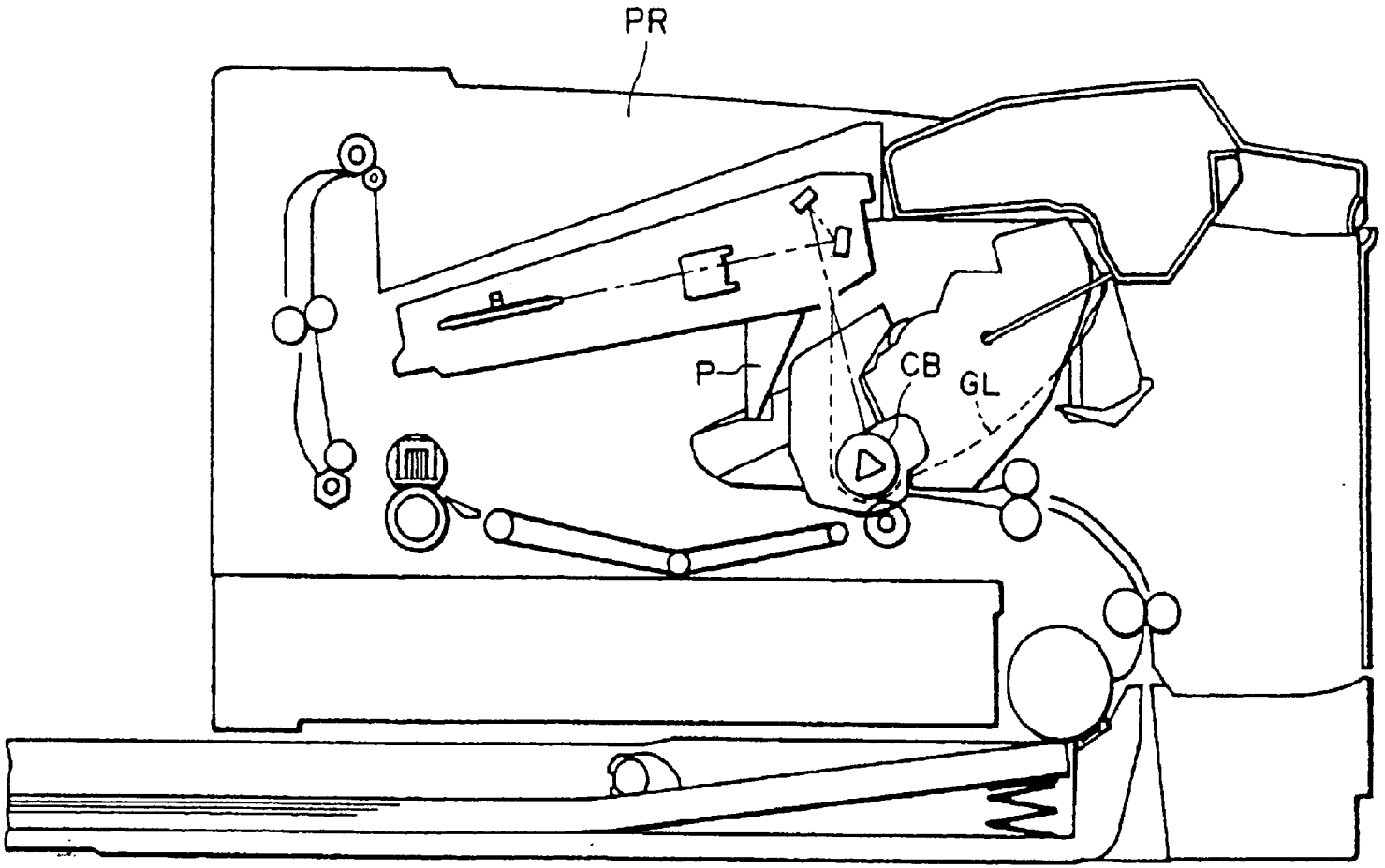
FIG. 62 is an illustration of a back cover and a cartridge mounting guide provided in the main assembly of the conventional electrophotographic image forming apparatus.

After the driving force begins to be transmitted by the engagement of the coupling means, and the rotational axes of the large gear coupling 83*a* and drum coupling 7*a*1 are aligned, the position of the right end of the process cartridge B, where the coupling means controlling means is located, is fixed by the coupling means. Referring to FIG. 59, the positioning guide 18*a*, which has been supported by the cartridge catching/retaining portion 84*a* until the coupling means is engaged, is separated from the cartridge catching/retaining portion 84*a* against the resiliency of the helical torsion coil spring 45, and also, the mounting guide 18*b* is separated from the guiding groove 41*a* of the moving guide 41. Further, as the process cartridge B begins to be driven as the result of the engagement of the coupling means, in other words, as the process cartridge B begins to be subjected to rotational force, the butting surface 18*d*, which is on the right end of the cartridge frame, as seen from the trailing side in terms of the process cartridge mounting direction, and on the leading end of the cartridge frame in terms of the process cartridge mounting direction, and faces forward in terms of the rotational direction of the process cartridge B, comes into contact with the rotation controlling portion 44*b* of the stationary guide 44.

As described above, in this embodiment, the image forming apparatus is structured so that the position of the process cartridge B within the image forming apparatus is fixed only after the driving force begins to be transmitted to the process cartridge B by the engagement of the coupling means.

After the driving force begins to be transmitted to the process cartridge B, the process cartridge B is retained in the proper position by the drum coupling 7*a*1, which is coaxially attached to the right end of the photoconductive drum 7, and the large gear coupling 83*a* rotationally supported by the right inner plate 40 of the image forming apparatus. The left end of the process cartridge B is properly positioned as the positioning guide 18*a* of the cartridge frame, the axial line of which coincides with the rotational axis of the photoconductive drum 7, is fitted in the positioning portion 90*a* of the conveyance frame 90, and is retained therein as the pressure catching portion 18*a*2 on the peripheral surface of the positioning guide 18*a* is kept pressed by the resilient pressing portion 52*b* of the pusher arm 52. Further, the butting surface 18*d* of the cartridge frame, which is at the leading end, in terms of the process cartridge mounting direction, and at the right end, as seen from the trailing side in terms of the process cartridge mounting direction, remains in contact with the rotation controlling portion 44*b* of the stationary guide 44. In other words, the process cartridge B is properly retained in the proper position in the image forming apparatus, by three points.

In order to place the process cartridge B in the above described proper position, the mounting guide 18*b* of the process cartridge B, which has been supported by the moving guide 41 while being conveyed by the movement of moving guide 41, leaves the retaining surface 41*a*1 of the moving guide 41, as the positioning portions (positioning guide 18*a*, and drum coupling 7*a*1), which are coaxial with the photoconductive drum 7, begin to be supported by the positioning means (positioning portion 90*a* of the conveyance frame, and large gear coupling 83*a*) on the image forming apparatus side.

As is evident from the above description, by supporting the positioning portions on the process cartridge B side, which are coaxial, with the photo-conductive drum 7, by the positioning means of the image forming apparatus main assembly, the process cartridge B is placed and retained in the proper position in the image forming apparatus, and therefore, the process cartridge B is highly accurately positioned relative to such components as the optical system 1 and transfer roller 4, the positional relationship of which relative to the photoconductive drum 7 must be guaranteed in accuracy.

(Movements of Process Cartridge Mounting/Dismounting Mechanism During Opening of Opening/Closing Cover 15)

Next, the sequence of turning off the image forming apparatus by deactivating interlocking switch 54 by opening the opening/closing cover 15; disengaging the pusher arm 52 and coupling means by further opening the opening/closing cover 15; moving the moving guide 41 by further opening the opening/closing cover 15; and taking out the process cartridge B from the moving guide 41, will be described. In this sequence, the steps described above are carried out in the reverse order.

The opening/closing cover 15, which is in the position shown in FIGS. 53, 58, and 59, is opened. On the left side of the image forming apparatus, as the opening/closing cover 15 is opened, the cam plate 50 rotates in the direction to move away from the interlocking switch 54. As a result, the interlocking switch 54 is lifted by the resiliency of the microswitch 91, and therefore, the current to various operational units of the image forming apparatus is cut off. Further, the elastic portion 54*c* is disengaged from the contact portion 50*i* of the cam plate 50 (FIGS. 55–58).

Next, the pusher arm 52 is disengaged from the coupling means. First, the disengagement of the left pusher arm 52 will be described.

As the cam plate 50 is rotated until the elastic portion 54*c* of the interlocking switch 54 becomes disengaged from the contact portion 50*i*, the boss 52*c* of the pusher arm 52 becomes disengaged from the arcuate surface of the arm retaining portion 50*h*2 of the second cam portion 50*h* (FIG. 56). Since the resiliency of the helical torsion coil spring 53 attached to the base of the pusher arm 52 is not strong enough to disengage the pusher arm 52 by lifting the pusher arm 52 by overcoming the friction between the resilient pressing portion 52*b* and pressure catching portion 18*a*2, the cam plate 50 simply contacts the boss 52*c* by the inward wall of the arm driving portion 50*h*1 of the second cam portion 50*h*, in terms of the radius direction. Then, the pusher arm 52 is forced by the rotation of the cam plate 50 to move upward.

Figure 54:
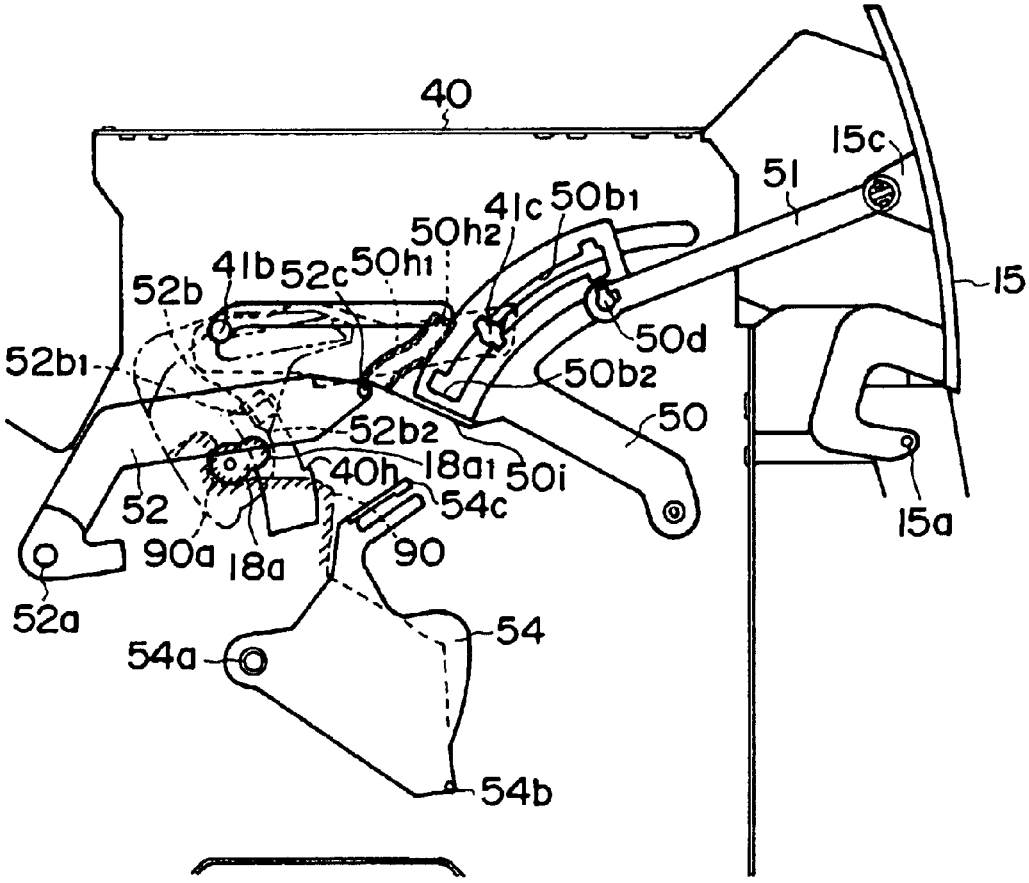
FIG. 54 is an illustration of an operation of an interrelating switch and a swing action of a pushing arm by the process cartridge mounting-and-demounting mechanism.

After this disengagement of the boss 52*c* and the inward wall of the arm driving portion 50*h*1 of the second cam portion 50*h*, the resilient pressing portion 52*b* of the pusher arm 52 is disengaged from the pressure catching portion 18*a*2 of the process cartridge B. The pusher arm 52 is placed in contact with the top end 40*h*2 of the fan-shaped hole 40*h* of the inner plate 40, by the function of the helical torsion coil spring 53, by the butting portion 52*b*3 at the top end of the resilient pressing portion 52*b*, and the resilient pressing portion 52*b* is moved to its retreat position where it will be out of the paths of the positioning guide 18*a* and pressure catching portion 18*a*2 of the process cartridge B (FIGS. 54–55).

As a result, the left positioning guide 18*a* of the process cartridge B is moved out of the positioning portion 90*a* by the contact pressure between the photoconductive drum 7 and transfer roller 4, which acts in the direction to lift the photoconductive drum 7.

At the same time as the disengagement of the pusher arm 52 on the left side, the coupling means is disengaged.

As the opening/closing cover 15 is opened, the coupling cam 85 connected to the right cam plate 50 by the thrust rod 55 rotates (FIG. 52) in the direction to cause the large gear coupling 83*a* to move away from the process cartridge B in terms of the direction of the rotational axis of the photoconductive drum 7.

As described before, one end of the thruster rod 55 is connected to the second boss 50*g* of the right cam plate 50, by the end of the elongated arcuate hole 55*b*, and the other end is connected to the boss 85*b* of the coupling cam 85, by the keyhole-like hole 55*a*. The end of the elongated hole 55*b* is kept pressed upon the second boss 50*g* by the tension spring 56. It is as described above that the direction of the straight portion 55*b*1 of the elongated hole 55*b* of the thruster rod 55 is virtually perpendicular to the line connecting the top end of the straight portion 55*b*1 and keyhole-like hole 55*a*.

The coupling means is constituted of a combination of the twisted projection and the twisted hole, the cross sections of which are in the form of a virtual equilateral triangle. Therefore, in order to disengage the coupling means by moving the large gear coupling 83*a* in its axial direction, either the drum coupling 7*a*1 with the twisted projection or the large gear coupling 83*a* with the twisted hole must be rotated by such an angle that is necessary to dissolve the engagement between the twisted edges of the twisted projection and the twisted walls of the twisted hole. Therefore, a relatively large amount of force is necessary for the disengagement.

The thruster rod 55 transmits a driving force of the cam plate 50 to the coupling cam 85, rotating the coupling cam 85, and the rotation of the coupling cam 85 disengages the coupling means. Therefore, as the driving force is transmitted from the cam plate 50 to the coupling cam 85 to disengage the coupling means, the thruster rod 55 is subjected to a coupling means disengagement load Ff which acts in the direction of the line connecting the keyhole-like hole 55*a*, in which the boss 85*b* of the coupling cam 85 is fitted, and the top end of the straight portion 55*b*1 of the elongated hole 55*b*, which is in contact with the second boss 50*g* of the cam plate 50, as shown in FIG. 52. In order to prevent the second boss 50*g* from dislodging from the end of the elongated hole 55*b* when this coupling means disengagement load Ff is caught by the end of the elongated hole 55*b*, the wall surface of the end of the elongated hole 55*b* must be rendered either perpendicular to the direction of the coupling means disengagement load, or inclined in such a manner that the coupling means disengagement load, the major component of which is caught by the straight portion 55*b*1 of the elongated hole 55*b*, is directed toward the top end of the straight portion 55*b*1. In this embodiment, the straight portion 55*b*1, which constitutes the end portion of the elongated hole 55*b* is rendered virtually perpendicular to the line connecting the top end of the straight portion 55*b*1 and the keyhole-like hole 55*a*, and the tension spring is mounted so that the end of the straight portion 55*b*1 is kept pressed upon the second boss 50*g*.

As the cam surfaces of the inward bearing 84 and the corresponding inclined surfaces 85*a*2 and 84*c*2 are placed in contact with each other by the rotation of the coupling cam 85, the coupling cam 85 is moved by the function of the inclined surfaces, outward of the apparatus in terms of its axial direction, dissolving the engagement between the large gear coupling 83*a* and drum coupling 7*a*1. Thereafter, the further rotation of the coupling cam 85 causes the raised surfaces 85*a*1 and 84*c*1 of the cam surfaces of the coupling cam 85 and inward bearing 84, respectively, to contact each other. As the raised surfaces 85*a*1 and 84*c*1 contact each other, the inward end of the large gear coupling 83*a* is moved outward of the apparatus beyond the inward surface of the inner plate 40, ending the disengagement of the coupling means.

In the description given above regarding the internal movements of the image forming apparatus linked to the opening of the opening/closing cover 15, it was stated that the movement or the cam plate 50 was linked to the movement of the opening/closing cover 15, and the various mechanisms were driven by the rotation of the cam plate 50. However, the moving guide 41, which had conveyed the process cartridge B, remains stationary during the opening of the opening/closing cover 15 to the above described point. This is due to that fact that during the rotation of the cam plate 50 up to the above described point, all that happens is for the top and bottom walls of the arcuate portion 50*b*1 of the elongated hole 50*b* to pass by the peripheral surface of the second boss 41*c* of the moving guide 41 located below the bottom end of the straight portion 40*b*2 of the second guide rail 40*b* of the inner plate 40. In other words, until the pusher arm 52 and coupling means, which are the means for properly positioning and supporting the process cartridge B within the image forming apparatus, are completely disengaged, the process cartridge B is not conveyed by the moving guide 41.

Thus, as the opening/closing cover 15 is further opened from the point corresponding to the end of the above described cover opening stage, the moving guide 41 begins to be moved by the cam plate 50.

As the rotation of the cam plate continues, the moving guide 41 comes into contact with the second boss 41*c* at the intersection of the arcuate portion 50*b*1 and straight portion (straight groove hole) 50*b*2 of the elongated hole 50*b* of the cam plate 50. As a result, the further rotation of the cam plate 50 begins to cause the straight portion (straight groove hole) 50*b*2 to make the second boss 41*c* of the moving guide 41 move upward into the straight portion 40*b*2 of the second guide rail 40*b* of the inner plate 40. At this point, the moving guide 41 begins to be moved by the opening movement of the opening/closing cover 15, for the first time.

At this time, the aforementioned disengagement of the thruster rod 55 will be described.

Referring to FIG. 52, while the coupling means is disengaged by the rotation of the cam plate 50, the timing boss 41*d* of the moving guide 41 enters the space under the lifting surface 55*f* of the thruster rod 55. The cam plate 50 begins to lift the moving guide 41 as the coupling cam 85 further rotates from the point at which the raised surfaces 85*a*1 and 84*c*1 of the cam surfaces of the coupling cam 85 and inward bearing 84, respectively, come into contact with each other. At this point, the stopper rib 60, which perpendicularly extends from the surface of the inner plate 40 has arrived above the recessed backup portion 55*g*, which is above the lifting surface 55*f*, and is open upward (FIG. 48).

As the timing boss 41*d* at the end or the second boss 41*c* of the moving guide 41 moves upward the lifting surface 55*f* or the thruster rod 55, the thruster rod 55 rotates about the axial line of the keyhole-like hole 55*a*. This rotation causes the corner of the elongated hole 55*b* of the thruster rod 55, where the straight portion 55*b*1 and inclined portion 55*b*2 of the elongated hole 55*b* meet, to move beyond the second boss 50*g* of the cam plate 50, ending the driving of the thruster rod 55 by the cam plate 50. Also, this rotation of the thruster rod 55 causes the stopper rib 60 to settle in the recessed backup portion 55*g*, beginning to regulate the movement of the thruster rod 55 (FIG. 45).

Then, the second boss 41*c* of the moving guide 41 is lifted by the cam plate 50, and the first boss 41*b* of the moving guide 41 begins to move along the inclined portion 40*a*2 of the first guide rail 40*a*. As a result, the moving guide 41 is moved upward. Therefore, the bottom surface 18*b*1 of the mounting guide 18*b* of the process cartridge B, which was not in contact with the moving guide 41 up to this point, comes into contact with the retaining surface 41*a*1 of the moving guide 41. Consequently, the process cartridge B will be supported by the moving guide 41 instead of the positioning means of the image forming apparatus main assembly.

The moving guide 41 makes contact with the end portion 18*b*2 of the mounting guide 18*b*, by the inward end of the guiding surface 41*a*2 also called the catching surface, and begins to pull the process cartridge B outward of the apparatus main assembly. During this movement of the moving guide 41, on the right side of the apparatus main assembly, the process cartridge B is pulled outward of the apparatus main assembly in the diagonally upward direction, while the right positioning guide 18*a* pushes up the helical torsion coil spring 45 attached to the right stationary guide 44 (FIG. 44).

As the opening/closing cover 15 is further opened, the second boss 41*c* of the moving guide 41 is sandwiched by the first arcuate portion 40*b*1 of the second guide rail 40*b* of the inner plate 40, and the leading end of the straight portion (straight groove hole) 50*b*2 of the elongated hole 50*b* (cam groove) of the cam plate 50, and is moved toward the opening W, through which the process cartridge B is mounted or dismounted. At the same time, the first boss 41*b* is moved outward from the inclined portion 40*a*2 of the first guide rail 40*a* along the horizontal portion 40*a*1. Consequently, the process cartridge B is conveyed to the location (cartridge removal location) at which the process cartridge B can be grasped by a user, with the photoconductive drum 7 being horizontally conveyed (FIGS. 26–44).

At the same time as this conveyance of the process cartridge B, the drum shutter 12, rotationally supported by the cartridge frame of the process cartridge B, is moved following in reverse the steps it follows during the mounting of the process cartridge B.

As the first boss 41*b* of the moving guide 41 is made to climb the inclined portion 40*a*2 of the first guide rail 40*a* while moving the process cartridge B upward, the angle, at which the drum shutter 12 is open, temporarily narrows slightly. Then, as the process cartridge B begins to be conveyed toward the opening W, the rib 12*e* comes into contact with the second inclined surface 44*c*3 of the shutter guide 44*c* of the stationary guide 44, increasing the angle at which the drum shutter is open. Then, the rib 12*e* is moved onto the raised surface 44*c*2, drum shutter 12 avoiding the electrical contact 92. Then, the rib 12*e* is moved onto the first inclined surface 44*c*1, and is conveyed on the first inclined surface 44*c*1 toward the opening W, together with the process cartridge B, while allowing the angle, at which the drum shutter 12 is open, to be reduced by the force of the shutter spring (unshown). As the angle, at which the drum shutter 12 is open, decreases, the highest point 12*d*1 of the cam portion 12*d* comes into contact with the bottom surface of the optical system plate if, and the rib 12*e* leaves the first inclined surface 44*c*1. Then, as the highest point 12*d*1 of the cam portion 12*d* comes out of the bent portion of the optical system plate 1*f*, the cam portion 12*d* is rotated by a large angle by the force of the torsional coil spring. The drum shutter 12 continues to close until the cam portion 12*d* leaves the optical system plate 1*f*, when the transfer opening 9*a* and exposure opening 9*b* are completely covered by the drum shutter 12.

When the highest portion 12*d*1 of the cam portion 12*d* of the drum shutter 12 is made to pass the bent portion of the optical system plate if, by the conveyance of the process cartridge B carried out by the movement of the moving guide 41 linked to the rotation of the opening/closing cover 15, the bottom surface 10*f*4 of the toner/developing means holding frame 10*f* of the process cartridge B comes into contact with the contact rib 43*c* of the front guide 43 which constitutes the bottom wall of the opening W (FIG. 26).

When the process cartridge B is assuming such an attitude that it contacts the contact rib 43*c*, the center of gravity of the process cartridge B is on the photoconductive drum 7 side with respect to the contact surface between the process cartridge B and contact rib 43*c*. Therefore, as the opening/closing cover 15 is further opened when the process cartridge B is assuming the above described attitude, the moving guide 41 moves closer to the opening W, moving the process cartridge B toward the opening W, or toward an operator. While the process cartridge B is moved toward the opening W, it is rotated by the inclination of the contact rib 43*c* and bottom surface 10*f*4 of the toner/developing means holding frame 10*f*, in such a manner that the toner/developing means holding frame 10*f* side of the process cartridge B is lifted as if the inward end portion 18*b*2 (also called the leading end portion 18*b*2) of the mounting guide 18*b* is functioning as a fulcrum. The contact rib 43*c* is shaped so that as the opening/closing cover 15 continues to be opened until it becomes fully open as shown in FIG. 21, the process cartridge B is rotated until the outward bottom corner portion 18*b*3 of the mounting guide 18*b* moves beyond the inclined surface 41*a*4 located at the stepped portion of the guiding groove 41*a* of the moving guide 41.

Therefore, as the guiding surface 41*a*2 of the guiding groove 41*a* of the moving guide 41 is made contiguous and level with the front guiding surface 42*a*1 of the auxiliary guide 42 (first location) by the final stage of the rotational movement of the opening/closing cover 15 before it becomes fully open, the process cartridge is enabled to be smoothly taken out of the apparatus main assembly, through the opening W, without such an occurrence that the outward bottom corner portion 18*b*3 of the mounting guide 18*b* hangs up on the inclined surface 41*a*1, by being simply pulled toward the operator.

When the opening/closing cover 15 is in the fully open position, the second boss 41*c* of the moving guide 41 is placed in contact with the inward wall of the straight portion (straight groove hole) 50*b*2 (straight groove hole) of the elongated hole 50*b* of the cam plate 50, and the end of the arcuate portion 40*b*1 of the second guide rail 40*b*, on the opening W side, is used as a stopper for preventing the opening/closing cover 15 from being further rotated.

As described above, during the first half of the entire rotational range of the opening/closing cover 15 for completely closing the fully open opening/closing cover 15, the process cartridge mounting/dismounting mechanism in this embodiment moves the moving guide 41 from the first location, at which the process cartridge B can be mounted into, or dismounted from, the apparatus main assembly, to the second location, from which the process cartridge B is conveyed close to the location at which the process cartridge B functions for image formation. Then, the drum shutter 12 is opened by the conveyance of the process cartridge B by the movement of the moving guide 41. Next, the process cartridge B is readied for an image forming operation, and is kept on standby near the location at which process cartridge B functions for image formation. During the latter half of the entire rotational range of the opening/closing cover 15 for closing the fully open opening/closing cover 15, the process cartridge mounting/dismounting mechanism readies the coupling means for transmitting the driving force to the process cartridge B for engagement, and activates the positioning means for placing and supporting the process cartridge B in the location at which the process cartridge B can function for image formation. Then, it turns on the image forming apparatus. On the other hand, during the first half of the entire rotational range of the opening/closing cover 15 for fully opening the completely closed opening/closing cover 15, first, the image forming apparatus is turned off by the initial opening movement of the opening/closing cover 15. Then, the positioning means which has been retaining the process cartridge B in the position at which the process cartridge B can function for image formation, and the coupling means, are disengaged. Then, during the latter half of the entire rotational range of the opening/closing cover 15 for fully opening the completely closed opening/closing cover 15, the process cartridge B is conveyed by moving the moving guide 41 from the aforementioned second location to the first location, while closing the drum shutter 12 by the conveyance of the process cartridge B.

With the provision of the above described mechanism, it becomes possible to move the process cartridge B by the opening or closing movement of the opening/closing cover 15. Therefore, even if the design of an image forming apparatus is such that the process cartridge B is mounted into the deeper end of the image forming apparatus main assembly 14, the operation for mounting or dismounting the process cartridge B can be easily carried out.

The description given above regarding one of the embodiments of the present invention can be summarized as follows.

The process cartridge B removably mountable in the electrophotographic image forming apparatus main assembly 14 having the process cartridge entrance opening/closing cover 15, which can be opened or closed, and the first and second guides 41, the movements of which are linked to the opening and closing movement of the opening/closing cover 15, comprises:

the electrophotographic photoconductive drum 7;

processing means (charging means 8, developing means 10, and cleaning means 11) which act on the photoconductive drum 7, the first cartridge frame CF, which is located at one end of the process cartridge B in terms of the axial direction of the photoconductive drum 7, and extends in the direction parallel to the direction in which the process cartridge B is mounted into the apparatus main assembly 14;

the first cartridge guide 18*b* which projects from the first cartridge frame CF, and rests on the first guide 41 of the apparatus main assembly so that the process cartridge B is conveyed toward the designated process cartridge position S in the apparatus main assembly 14 by the movement of the first guide 41, when the process cartridge B is mounted into the apparatus main assembly 14;

the second cartridge frame CF, which is located at the other end of the process cartridge B in terms of the axial direction of the photoconductive drum 7, and extends in the direction parallel to the direction in which the process cartridge B is mounted into the apparatus main assembly 14;

the second cartridge guide 18*b* which projects from the second cartridge frame CF, and rests on the second guide 41 of the apparatus main assembly so that the process cartridge B is conveyed toward the designated process cartridge position S in the apparatus main assembly 14 by the movement of the second guide 41, when the process cartridge 13 is mounted into the apparatus main assembly 14;

the first cartridge positioning portion 18*a*, which is on one end of the process cartridge B in terms of the axial direction of the photoconductive drum 7, projects outward from the first cartridge frame CF, and is coaxial with the photoconductive drum 7, and which engages with the first positioning portion 44*a* of the apparatus main assembly 14, in order to properly position the process cartridge B relative to the apparatus main assembly 14, toward the end of the mounting of the process cartridge B into the apparatus main assembly 14; and the second cartridge positioning portion 18*a*, which is on other end of the process cartridge B in terms of the axial direction of the photoconductive drum 7, projects outward from the second cartridge frame CF, and is coaxial with the photoconductive drum 7, and which engages with the second positioning portion 90*a* of the apparatus main assembly 14, in order to properly position the process cartridge B relative to the apparatus main assembly 14, toward the end of the mounting of the process cartridge B into the apparatus main assembly 14.

One end of the photoconductive drum 7 in terms of the axial direction of the photoconductive drum 7 is provided with the driving force receiving portion 7*a*1, which receives the driving force for rotating the photoconductive drum 7, from the apparatus main assembly 14 after the process cartridge B is mounted into the apparatus main assembly 14.

Further, the aforementioned driving force receiving portion 7*a*1 is a projection approximately in the form of a twisted triangular pillar. In order to receive the driving force, it engages into the hole in the form of a twisted pillar, the cross section of which is perpendicular to its axial line is approximately an equilateral triangle.

As seen in the lengthwise direction of the photoconductive drum 7 and also in terms of the process cartridge mounting direction, the rear end of the first cartridge guide 18*b* and the rear end of the second cartridge guide 18*b* are on the upstream side with respect to the center of gravity of the process cartridge B. Further, the front end of the first cartridge guide 18*b* and the front end of the second cartridge guide 18*b* are on the downstream side of the center of gravity of the process cartridge B.

When the process cartridge B is in the position, at which it is to function for image formation, in the apparatus main assembly 14, the front end of the first cartridge guide 18*b* and the front end of the second cartridge guide 18*b* are on the downstream side with respect to the vertical line intersecting the axial line of the photoconductive drum 7.

The rear end of the first cartridge guide 18*b* , has a flat portion 18*b*1, also called the lower surface or portion to be supported 18*b*1, by which the rear end of the first cartridge guide 18*b* rests on the first guide 41 of the apparatus main assembly 14, and an inclined surface 18*b*4, which extends upstream in terms of the process cartridge mounting direction, tilting diagonally downward. It is pressed by the first guide 41 of the apparatus main assembly 14 in the process cartridge mounting direction, by the point of the first cartridge guide 18*b*, at which the portion 18*b*1 and inclined portion 18*b*4 meet.

Further, the rear end of the second cartridge guide 18*b* has a flat portion by which the second cartridge guide 18*b* rests on the second guide 41 of the apparatus main assembly 14, and an inclined portion 18*b*4, which extends upstream in terms of the process cartridge mounting direction, tilting diagonally downward, and is pressed by the second guide 41 of the apparatus main assembly 14 in the process cartridge mounting direction by the point of the second cartridge guide 18*b*, at which the portion 18*b*1 and inclined portion 18*b*4 meet.

The first cartridge guide 18*b* and second cartridge guide 18*b* are moved in the process cartridge mounting direction, resting on the first and second guides 41 of the apparatus main assembly 14. Then, they are subjected to the resistance generated by the spring 45 as the process cartridge B is further inserted. As they are subjected to the resistance, the rear end of the first cartridge guide 18*b* is pressed by the first guide 41 of the apparatus main assembly 14, and the rear end of the second cartridge guide 18*b* is pressed by the second guide 41 of the apparatus main assembly 14. When the process cartridge B is placed in the image formation position in the apparatus main assembly 14, the first cartridge guide 18*b* and second cartridge guide 18*b* are apart from the first guide 41 and second guide 41, respectively, of the apparatus main assembly 14.

Further, the process cartridge B is provided with the regulating portion 18*d* (butting surface), which comes into contact with the rotation controlling portion 44*b* of the stationary guide 44 of the apparatus main assembly 14, and prevents the process cartridge B from being rotated about the first and second cartridge positioning portions 18*a* and 18*a* by the force, which is generated as the driving force receiving portion 7*a*1 receives the driving force from the apparatus main assembly 14, and which acts in the direction to rotate the process cartridge B about the first cartridge positioning portion 18*a* and second cartridge positioning portion 18*a*. The regulating portion 18*d* is on the external surface of the cartridge frame CF of the process cartridge B, which faces upward when the process cartridge B is in the image formation position in the apparatus main assembly 14. The first cartridge positioning portion 18*a* of the process cartridge B engages the butting portion 44*a*, also called the first positioning portion 44*a* of the apparatus main assembly 14, and the second cartridge positioning portion 18*a* engages into the second positioning portion 90*a* of the apparatus main assembly 14. When the regulating portion 18*d* is in contact with the rotation controlling portion 44*b* of the stationary guide 44 of the apparatus main assembly 14, the process cartridge B is in the position in which it is to function for image formation.

The first cartridge positioning portion 18*a* and second cartridge positioning portion 18*a* are cylindrical, and the former is greater in diameter than the latter.

The process cartridge B is conveyed by the opening movement of the opening/closing cover 15 to the location from which it can be taken out of the apparatus main assembly 14, with the first cartridge guide 18*b* and second cartridge guide 18*b* resting on the first and second guides 41, respectively, of the apparatus main assembly 14. While the process cartridge B is conveyed to the location from which it can be taken out of the apparatus main assembly 14, the bottom surface of the process cartridge B comes into contact with the projection 16*a* of the apparatus main assembly 14. As a result, the downstream side of the process cartridge B in terms of the direction in which the process cartridge B is taken out of the apparatus main assembly 14, lifts.

Furthermore, the cartridge B includes a shutter for protecting a portion of the photosensitive drum 7 exposed through the cartridge frame CF, the shutter being movable between a protection position in which it covers the photosensitive drum 7 and a retracted position in which it is retracted from the protection position; a cam portion 12*d*, also called a first projection 12*d* contactable with a first contact portion 1*f* provided in the main assembly 14 of the apparatus to move the shutter 12 from the protection position to the retracted position when the cartridge B is conveyed to the mounting position S by the movement of the first main assembly side guide 41 and the second main assembly side guide 41, the first projection 12*d* projecting upwardly from a surface which is a top surface when the cartridge B is conveyed; a rib 12*e*, called a second projection 12*e* contactable with a shutter guide portion 44*c*, called a second contact portion 44*c* provided in the main assembly 14 of the apparatus to maintain the shutter 12 at the retracted position when the cartridge B is conveyed, the second projection 12*e* projecting in the longitudinal direction of the cartridge frame CF, wherein the first cartridge guide 18*b*, the second projection 12*e* and the first projection 12*d* are arranged in this order in the longitudinal direction of the cartridge frame CF.

The shutter 12 is made of plastic resin material, and the first projection 12*d* and the second projection 12*e* are integrally molded.

The shutter 12 includes a drum protecting portion 12*a*, called a cover portion 12*a* covering the exposed portion of the photosensitive drum 7 and a connecting portion 12*c*, also called a supporting portion 12*c* for rotatably supporting the cover portion 12*a* on the cartridge frame CF. The second projection 12*e* is provided on the supporting portion 12*c*.

Thus, the usability is maintained or improved without making the main assembly 14 of the image forming apparatus bulky.

Additionally, the process cartridge B can be placed at a rear side of the main assembly 14 of the image forming apparatus, by which the latitude of the unit disposition of the electrophotographic image forming apparatus An is improved.

Furthermore, the latter part of the closing motion of the opening and closing cover 15 can be utilized for operating driving interconnection means for permitting establishment of the driving connection by the pusher arm 52 and/or coupling means which are positioning means for the process cartridge B in the main assembly 14 of the image forming apparatus. Therefore, the increase of the number of parts can be suppressed by assigning more than one function to the parts required by the mounting-and-demounting mechanism for the process cartridge and connecting with the peripheral parts.

The process cartridge B has the mounting guide 18*b* supported by the movement guide 41 and the positioning boss 18*a* supported by the cartridge catching/retaining portion 84*a*, also called a cartridge receiving portion 84*a* or the positioning portion 90*a*, which are separately provided at the respective side surfaces of the cartridge frame, and therefore, the left and right movement guides 41 and the positioning portions 90*a* or the cartridge receiving portions 84*a* may be disposed at the same position with respect to the longitudinal direction of the process cartridge B. This eliminates the necessity of increasing the length of the process cartridge B.

In the foregoing embodiments, the process cartridge is for forming monochromatic images, but the process cartridge according to this invention is applicable to a cartridge having a plurality of developing means for forming multicolor images, for example two-color images, three-color images and full-color images or the like.

The electrophotographic photosensitive member is not limited to the photosensitive drum. For example, the photosensitive member may be a photoconductor such as amorphous silicon, amorphous selenium, zinc oxide, oxide titanium, organic photoconductor (OPC) or the like. The photosensitive member may be in the form of a drum or belt. In the case of the drum type photosensitive member, the photoconductor is applied or evaporated on a cylinder made of aluminum alloy or the like.

Also, the present invention is preferably usable with various known developing methods such as the magnetic brush developing method using two component toner, the cascade developing method, the touch-down developing method, and the cloud developing method.

The structure of the charging means described in the foregoing is of a so-called contact type charging method, but a known charging means comprising a tungsten wire which is enclosed with a metal shield of aluminum or the like at three sides, wherein positive or negative ions generated by application of a high voltage to the tungsten wire are directed to the surface of the photosensitive drum to uniformly charged the surface, is usable.

The charging means may be a roller type as described in the foregoing, a blade type (charging blade), a pad type, a block type, a rod type, a wire type or the like.

The charging means may be a roller type as described in the foregoing, a blade type (charging blade), a pad type, a block type, a rod type, a wire type or the like.

The process cartridge, for example, comprises an electrophotographic photosensitive member and at least one process means. The process cartridge is detachably mountable as a unit to the main assembly of the apparatus, wherein the process cartridge contains an electrophotographic photosensitive member and charging means; contains an electrophotographic photosensitive member and developing means; contains an electrophotographic photosensitive member and cleaning means; or contains an electrophotographic photosensitive member and two or more process means.

In other words, the process cartridge contains an electrophotographic photosensitive member and charging means, developing means or cleaning means, the cartridge being detachably mountable as a unit to the main assembly of the apparatus. The process cartridge may contain an electrophotographic photosensitive member and at least one of a charging means, a developing means and a cleaning means in the form of a cartridge which is detachably mountable to a main assembly of an image forming apparatus. Or, it may be a cartridge containing integrally at least developing means and an electrophotographic photosensitive member, the cartridge being the detachably mountable to a main assembly of an image forming apparatus. The process cartridge is mounted to or demounted from the main assembly of the apparatus by the user. This means that maintenance of the apparatus is carried out, in effect, by the user.

In the foregoing embodiments, a laser beam printer has been taken as an exemplary embodiment of an electrophotographic image forming apparatus, but the present invention is not limited to this, but is applicable to another electrophotographic image forming apparatus such as an electrophotographic copying machine, a facsimile machine, a word processor or the like.

MODIFIED EXAMPLE 1

In the foregoing embodiment, the first guiding rail 40*a* includes a horizontal portion 40*a*1 and an inclined portion 40*a*2, and the inclined portion 40*a*2 is constituted by a portion bent downward. However, the inclined portion 40*a* may be inclined upward, which is effective when the transfer roller 4 is disposed at a rear side with respect to the mounting direction of the process cartridge B.

In this modified example, at the portion of the movement guide 41 approaching the image forming operation position, the boss 41*b* side of the movement guide 41 is directed upward along the inclined portion of the guiding rail 40*a* bent upward, and the boss 41*c* side of the movement guide 41 is directed to downward. Therefore, the process cartridge B rotates in the clockwise direction. When the positioning guide 18*a* is engaged with the positioning portion 90*a* of the frame 90, the process cartridge B in which the photosensitive drum 7 is disposed at a rear side with respect to the mounting direction of the process cartridge B is mounted in a direction crossing with (substantially perpendicular to) the nipping surface of the transfer roller 4.

The modified example also provides the advantageous effects similar to the case of the foregoing embodiment.

As described in the foregoing, according to the present invention, the process cartridge can be mounted to the mounting position in the main assembly of the apparatus in interrelation with the closing operation of the opening and closing member. In addition, the mounting operationality of the process cartridge relative to the main assembly of the apparatus can be improved.

Furthermore, mounting and demounting of the process cartridge and the connection and disconnection of the coupling driving system are carried out in interrelation with the opening and closing operation of the opening and closing member, so that operability is improved.

While the invention has been described with reference to the structures disclosed herein, it is not confined to the details set forth and this application is intended to cover such modifications or changes as may come within the purpose of the improvements or the scope of the following claims.

What is claimed is:

1. An electrophotographic image forming apparatus to which a process cartridge is detachably mountable, the process cartridge including an electrophotographic photosensitive drum; process means actable on the electrophotographic photosensitive drum; a cartridge frame supporting the electrophotographic photosensitive drum and the process means; a cartridge guide projecting from the cartridge frame; and a cartridge coupling member provided at one end of the electrophotographic photosensitive drum, said electrophotographic image forming apparatus comprising:

an opening through which the process cartridge is mounted and demounted;

an opening and closing member configured and positioned to open and close said opening;

a main assembly side guide configured and positioned to support the cartridge guide and movable in interrelation with opening and closing of said opening and closing member;

a main assembly coupling member, movable in a direction substantially perpendicular to a process cartridge mounting direction in which the process cartridge is mounted to a main assembly of said apparatus, configured and positioned to connect to the cartridge coupling member to transmit a driving force from a driving source in said electrophotographic image forming apparatus to the cartridge coupling member; and driving connection means for effecting connection and disconnection between said main assembly coupling member and the cartridge coupling member by moving said main assembly coupling member in the direction substantially perpendicular to the process cartridge mounting direction in interrelation with opening and closing of said opening and closing member, wherein in a closing operation of said opening and closing member, said main assembly side guide first moves, and said main assembly coupling member is connected with the cartridge coupling member only after start of operation of said driving connection means at the time when the movement of said main assembly side guide is ending, and wherein in a full opening operation of said opening and closing member, said driving connection means first disconnects said main assembly coupling member and the cartridge coupling member from each other, and only then, said main assembly side guide is moved.

2. An apparatus according to claim 1, further comprising retaining means for preventing operation of said driving connection means during movement of said main assembly side guide in interrelation with said opening and closing member.

3. An apparatus according to claim 1, further comprising:

a side plate constituting a side surface of said opening and including a groove, wherein said main assembly side guide is mounted to said side plate, wherein said main assembly side guide includes a boss slidable in said groove and provided on a side of said main assembly side guide opposite from a side of said main assembly side guide supporting the cartridge guide;

a cam plate configured and positioned to be contacted by said boss and rotatably supported on a side of said side plate that is opposite from a side of said side plate on which said main assembly side guide is mounted; and a connection member configured and positioned to connect said opening and closing member and said cam plate to constitute a quadric link mechanism, wherein said main assembly side guide effects movement and stopping responsive to opening and closing of said opening and closing member by cooperation between a cam surface of said cam plate and the groove of said side plate.

4. An apparatus according to claim 1, wherein said driving connection means includes:

an inner bearing member fixed on a side plate constituting a side surface of said opening to rotatably support one end of said main assembly coupling member and having a cam surface on the side opposite to said main assembly coupling member;

an outer bearing member configured and positioned to rotatably support the other end of said main assembly coupling member;

a coupling cam having a cam portion, provided rotatably between said inner bearing member and said main assembly coupling member and configured and positioned to move said main assembly coupling member in a direction of a rotational axis of said main assembly coupling member by rotation thereof and cooperation of said cam surface; and a spring configured and positioned to urge said main assembly coupling member toward said inner bearing member between said outer bearing member and said main assembly coupling member.

5. An apparatus according to according to claim 4, further comprising a timing member including:

an engaging portion configured and positioned to rotatably engage said coupling cam; and an elongated hole including:

a linear portion which is provided at an end portion adjacent to said engaging portion and to which a boss of a cam plate is slidably connected;

an arcuate portion having a radius substantially equal to a rotational radius of the boss of the cam plate; and an inclined portion connecting said linear portion and said arcuate portion, wherein during movement of said main assembly side guide with rotation of the cam plate, the boss of the cam plate moves in said elongated hole, and when said main assembly side guide is at rest, the boss of the cam plate is contacted to an end portion of said linear portion of said elongated hole to operate said coupling cam.

6. An apparatus according to claim 5, wherein said linear portion is substantially perpendicular to a line connecting said engaging portion and the end of said linear portion, and said inclined portion continues to a lower portion of said linear portion and inclines downwardly, wherein a center of said arcuate portion when the boss of the cam plate is at said arcuate portion, is substantially aligned with a center of rotation of the cam plate.

7. An apparatus according to claim 6, wherein said main assembly side guide is provided with a projection outwardly projected from a free end of a boss of said main assembly side guide, and said timing member is provided with a contact surface contactable with the projection, wherein the projection moves upwardly at an initial stage of an opening motion of said opening and closing member to contact the contact surface by which said timing member is rotated to move the boss of the cam plate from said linear portion to said inclined portion.

8. An apparatus according to claim 7, wherein said timing member is provided above the contact surface with a recess contactable to a rib extending in a direction substantially perpendicular to said side plate, wherein when the boss of the cam plate is in the arcuate portion or the inclined portion, a surface of said recess contacts the rib to prevent movement of said timing member.

9. An electrophotographic image forming apparatus to which a process cartridge is detachably mountable, the process cartridge including an electrophotographic photosensitive drum; process means actable on the electrophotographic photosensitive drum; a cartridge frame supporting the electrophotographic photosensitive drum and the process means; a cartridge guide projecting from the cartridge frame; and a cartridge coupling member provided at one end of the electrophotographic photosensitive drum, said electrophotographic image forming apparatus comprising:

an opening through which the process cartridge is mounted and demounted;

an opening and closing member configured and positioned to open and close said opening;

a main assembly side guide configured and positioned to support the cartridge guide and movable in interrelation with opening and closing of said opening and closing member;

a main assembly coupling member, movable in a direction substantially perpendicular to a process cartridge mounting direction in which the process cartridge is mounted to a main assembly of said apparatus, configured and positioned to connect with the cartridge coupling member to transmit a driving force from a driving source in said electrophotographic image forming apparatus to the cartridge coupling member;

driving connection means for effecting connection and disconnection between said main assembly coupling member and the cartridge coupling member by moving said main assembly coupling member in the direction substantially perpendicular to the process cartridge mounting direction in interrelation with opening and closing of said opening and closing member, wherein in a closing operation of said opening and closing member, said main assembly side guide first moves, and said main assembly coupling member is connected with the cartridge coupling member only after start of operation of said driving connection means at the time when the movement of said main assembly side guide is ending, and wherein in a full opening operation of said opening and closing member, said driving connection means first disconnects said main assembly coupling member and the cartridge coupling member from each other, and only then, said main assembly side guide is moved; and retaining means for preventing operation of said driving connection means during movement of said main assembly side guide in interrelation with said opening and closing member.

10. An apparatus according to claim 9, further comprising:

a side plate constituting a side surface of said opening and including a groove, wherein said main assembly side guide is mounted to said side plate, wherein said main assembly side guide includes a boss slidable in said groove and provided on a side of said main assembly side guide that is opposite from a side of said main assembly side guide supporting the cartridge guide;

a cam plate configured and positioned to be contacted by said boss and rotatably supported on a side of said side plate that is opposite from a side of said side plate on which said main assembly side guide is mounted; and a connection member configured and positioned to connect said opening and closing member and said cam plate to constitute a quadric link mechanism, wherein said main assembly side guide effects movement and stopping responsive to opening and closing of said opening and closing member by cooperation between a cam surface of said cam plate and the groove of said side plate.

11. An apparatus according to claim 9, wherein said driving connection means includes:

an inner bearing member fixed on a side plate constituting a side surface of said opening to rotatably support one end of said main assembly coupling member and having a cam surface on the side opposite to said main assembly coupling member;

an outer bearing member configured and positioned to rotatably support the other end of said main assembly coupling member;

a coupling cam having a cam portion, provided rotatably between said inner bearing member and said main assembly coupling member and configured and positioned to move said main assembly coupling member in a direction of a rotational axis of said main assembly coupling member by rotation thereof and cooperation of said cam surface; and a spring configured and positioned to urge said main assembly coupling member toward said inner bearing member between said outer bearing member and said main assembly coupling member.

12. An apparatus according to according to claim 11, further comprising a timing member including:

an engaging portion configured and positioned to rotatably engage said coupling cam; and an elongated hole including:

a linear portion which is provided at an end portion adjacent to said engaging portion and to which a boss provided in a cam plate is slidably connected;

an arcuate portion having a radius substantially equal to a rotational radius of the boss of the cam plate; and an inclined portion connecting said linear portion and said arcuate portion, wherein during movement of said main assembly side guide with rotation of the cam plate, the boss of the cam plate moves in said elongated hole, and when said main assembly side guide is at rest, said boss of the cam plate is contacted to an end portion of said linear portion of said elongated hole to operate said coupling cam.

13. An apparatus according to claim 12, wherein said linear portion is substantially perpendicular to a line connecting said engaging portion and the end of said linear portion, and said inclined portion continues to a lower portion of said linear portion and inclines downwardly, wherein a center of said arcuate portion when the boss of the cam plate is at said arcuate portion, is substantially aligned with a center of rotation of the cam plate.

14. An apparatus according to claim 13, wherein said main assembly side guide is provided with a projection outwardly projected from a free end of a boss of said main assembly side guide and said timing member is provided with a contact surface contactable with said projection, wherein said projection moves upwardly at an initial stage of an opening motion of said opening and closing member to contact to the contact surface by which said timing member is rotated to move said boss of the cam plate from said linear portion to said inclined portion.

15. An apparatus according to claim 14, wherein said timing member is provided above the contact surface with a recess contactable to a rib extending in a direction substantially perpendicular to said side plate, wherein when the boss of the cam plate is in said arcuate portion or said inclined portion, a surface of said recess contacts the rib to prevent movement of said timing member.

16. An electrophotographic image forming apparatus to which a process cartridge is detachably mountable, the process cartridge including an electrophotographic photosensitive drum; process means actable on the electrophotographic photosensitive drum; a cartridge frame supporting the electrophotographic photosensitive drum and the process means; a cartridge guide projecting from the cartridge frame; and a cartridge coupling member provided at one end of the electrophotographic photosensitive drum, said electrophotographic image forming apparatus comprising:

an opening through which the process cartridge is mounted and demounted;

an opening and closing member configured and positioned to open and close said opening;

a main assembly side guide configured and positioned to support the cartridge guide and movable in interrelation with opening and closing of said opening and closing member;

a main assembly coupling member, movable in a direction substantially perpendicular to a mounting direction in which the process cartridge is mounted to a main assembly of said apparatus, configured and positioned to connect with the cartridge coupling member to transmit a driving force from a driving source in said electrophotographic image forming apparatus to the cartridge coupling member;

driving connection means for effecting connection and disconnection between said main assembly coupling member and the cartridge coupling member by moving said main assembly coupling member in a direction substantially perpendicular to the process cartridge mounting direction in interrelation with opening and closing of said opening and closing member, wherein in a closing operation of said opening and closing member, said main assembly side guide first moves, and said main assembly coupling member is connected with the cartridge coupling member only after operation of said driving connection means at the time when the movement of said main assembly side guide is ending, and wherein in a full opening operation of said opening and closing member, said driving connection means first disconnects said main assembly coupling member and the cartridge coupling member from each other, and only then, said main assembly side guide is moved;

retaining means for preventing operation of said driving connection means during movement of said main assembly side guide in interrelation with said opening and closing member;

a side plate constituting a side surface of said opening and including a groove, wherein said main assembly side guide is mounted to said side plate, wherein said main assembly side guide includes a boss slidable in said groove and provided on a side of said main assembly side guide opposite from a side of said main assembly side guide supporting the cartridge guide;

a cam plate configured and positioned to be contacted by said boss and rotatably supported on a side of said side plate that is opposite from a side of said side plate on which said main assembly side guide is mounted;

a connection member configured and positioned to connect said opening and closing member and said cam plate to constitute a quadric link mechanism, wherein said main assembly side guide effects movement and stopping responsive to opening and closing of said opening and closing member by cooperation between a cam surface of said cam plate and the groove of said side plate.

17. An apparatus according to claim 16, wherein said driving connection means includes:

an inner bearing member fixed on said side plate to rotatably support one end of said main assembly coupling member and having a cam surface on the side opposite to said main assembly coupling member;

an outer bearing member configured and positioned to rotatably support the other end of said main assembly coupling member;

a coupling cam having a cam portion, provided rotatably between said inner bearing member and said main assembly coupling member and configured and positioned to move said main assembly coupling member in a direction of a rotational axis of said main assembly coupling member by rotation thereof and cooperation of said cam surface; and a spring configured and positioned to urge said main assembly coupling member toward said inner bearing member between said outer bearing member and said main assembly coupling member.

18. An apparatus according to claim 17, further comprising a timing member including:

an engaging portion configured and positioned to rotatably engage said coupling cam; and an elongated hole including:

a linear portion which is provided at an end portion adjacent to said engaging portion and to which a boss of said cam plate is slidably connected;

an arcuate portion having a radius substantially equal to a rotational radius of the boss of said cam plate;

an inclined portion connecting said linear portion and said arcuate portion, wherein during movement of said main assembly side guide with rotation of said cam plate, the boss of said cam plate moves in said elongated hole of said timing member, and when said main assembly side guide is at rest, the boss of said cam plate is contacted to an end portion of said linear portion of said elongated hole to operate said coupling cam.

19. An apparatus according to claim 18, wherein said linear portion is substantially perpendicular to a line connecting said engaging portion and the end of said linear portion, and said inclined portion continues to a lower portion of said linear portion and inclines downwardly, wherein a center of said arcuate portion when the boss of said cam plate is at said arcuate portion, is substantially aligned with a center of rotation of said cam plate.

20. An apparatus according to claim 19, wherein said main assembly side guide is provided with a projection outwardly projected from a free end of a boss of said main assembly guide and said timing member is provided with a contact surface contactable with said projection, wherein said projection moves upwardly at an initial stage of an opening motion of said opening and closing member to contact the contact surface by which said timing member is rotated to move the boss of said cam plate from said linear portion to said inclined portion.

21. An electrophotographic image forming apparatus to which a process cartridge is detachably mountable, said process cartridge including an electrophotographic photosensitive drum, process means actable on the electrophotographic photosensitive drum, a cartridge frame supporting the electrophotographic photosensitive drum and the process means, a cartridge guide projecting from the cartridge frame, and a cartridge coupling member provided at one end of the electrophotographic photosensitive drum, said electrophotographic image forming apparatus comprising:

an opening through which the process cartridge is detachably mountable;

an opening and closing member configured and positioned to open and close said opening;

a side plate constituting a side of said opening;

a guide rail provided on said side plate;

a main assembly guide having a boss slidable on said guide rail, said boss being disposed on a surface opposite from a surface engageable with said cartridge guide with respect to a longitudinal axis of the electrophotographic photosensitive drum, wherein said main assembly guide is movable in interrelation with the opening and closing of said opening and closing member in the state in which said process cartridge is set in said electrophotographic image forming apparatus and wherein said main assembly guide is engageable with said cartridge guide, wherein said main assembly guide is movable between a first position for permitting mounting and demounting of the process cartridge and a second position in which the process cartridge is capable of performing an image forming operation;

a main assembly coupling member, movable in a direction substantially perpendicular to a process cartridge mounting direction in which the process cartridge is mounted to a main assembly of said electrophotographic image forming apparatus, configured and positioned to connect to the cartridge coupling member to transmit a driving force from a driving source in said electrophotographic image forming apparatus to the cartridge coupling member;

driving connecting means for effecting connection and disconnection between said main assembly coupling member and the cartridge coupling member by moving said main assembly coupling member in the direction substantially perpendicular to the process cartridge mounting direction in interrelation with the opening and closing of said opening and closing member;

a cam plate rotatably supported on a side of said side plate opposite from the side having said main assembly guide with respect to the direction of the longitudinal axis of said electrophotgraphic photosensitive drum when the process cartridge is mounted to said electrophotographic image forming apparatus and having a cam groove to which said boss is contactable; and a connecting member connecting said opening and closing member and said cam plate to constitute a quadric link mechanism with said opening and closing member and said cam plate, wherein said main assembly guide moves and stops with opening and closing operations of said opening and closing member by operations of said cam groove and said guide rail, and wherein when said opening and closing member is closed, said main assembly guide supporting the process cartridge is moved from the first position to the second position by said driving connecting means, and thereafter, said main assembly coupling member contacts the cartridge coupling member, and when said opening and closing member is opened, said main assembly coupling member is released from the cartridge coupling member by said driving connecting means, and thereafter, said main assembly guide supporting the process cartridge is moved from the second position to the first position.

22. An apparatus according to claim 21, further comprising retaining means for preventing operation of said driving connecting means during movement of said main assembly guide in interrelation with the operation of said opening and closing member.

23. An apparatus according to claim 21, wherein said driving connecting means includes:

an inner bearing member fixed on said side plate to rotatably support one end of said main assembly coupling member and having a cam surface on the side opposite to said main assembly coupling member;

an outer bearing member configured and positioned to rotatably support the other end of said main assembly coupling member;

a coupling cam having a cam portion, provided rotatably between said inner bearing member and said main assembly coupling member and configured and positioned to move said main assembly coupling member in a direction of a rotational axis of the said main assembly coupling member by rotation thereof and operation of said cam surface; and a spring configured and positioned to urge said main assembly coupling member toward said inner bearing member and positioned between said outer bearing member and said main assembly coupling member.

24. An apparatus according to claim 23, further comprising a timing member including:

an engaging portion configured and positioned to rotatably engage said coupling cam; and an elongated hole including:

a linear portion which is provided at an end portion adjacent to said engaging portion and to which a boss of said cam plate is slidably connected, an arcuate portion having a radius substantially equal to a rotational radius of the boss on said cam plate, and an inclined portion connecting said linear portion and said arcuate portion, wherein during movement of said main assembly guide with rotation of said cam plate, the boss of said cam plate moves in said elongated hole, and when said main assembly guide is at rest, the boss of said cam plate contacts an end portion of said linear portion of the said elongated hole to operate said coupling cam.

25. An apparatus according to claim 24, wherein said linear portion is substantially perpendicular to a line contacting said engaging portion and an end of said linear portion, wherein said inclined portion constitutes a lower portion of said linear portion and inclines downwardly, and wherein a center of said arcuate portion when the boss of said cam plate is at said arcuate portion, is substantially aligned with a center of rotation of said cam plate.

26. An apparatus according to claim 25, wherein said main assembly guide is provided with a projection outwardly projected from a free end of said boss of said main assembly guide, and said timing member is provided with a contact surface contactable with said projection, wherein said projection moves upwardly at an initial stage of an opening motion of said opening and closing member to contact said contact surface by which said timing member is rotated to move the boss of said cam plate from said linear portion to said inclined portion.

27. An apparatus according to claim 26, wherein said timing member is provided above said contact surface with a recess contactable to a rib extending in a direction substantially perpendicular to said side plate, wherein when the boss of said the cam plate is in said arcuate portion or said inclined portion, a surface of said recess contacts the rib to prevent movement of said timing member.

* * * * *

UNITED STATES PATENT AND TRADEMARK OFFICE

CERTIFICATE OF CORRECTION

PATENT NO. : 7,006,776 B2
APPLICATION NO. : 10/098419
DATED : February 28, 2006
INVENTOR(S) : Kenji Matsuzaka et al.

It is certified that error appears in the above-identified patent and that said Letters Patent is hereby corrected as shown below:

COLUMN 2
Line 17, “has the” should read --has been--.

COLUMN 8
Line 38, “a on” should read --on--.

COLUMN 10
Line 10, “lid” should read --11d--.

COLUMN 13
Line 51, “plate.” should read --plate--.

COLUMN 36
Line 12, “lid” should read --11d--.
Line 16, “lid,” should read --11d,--.
Line 24, “lid” should read --11d--.
Line 45, “lid,” should read --11d,--.
Line 50, “if,” should read --1f,--.
Line 53, “if,” should read --1f,--.
Line 61, “lid,” should read --11d,--.

COLUMN 39
Line 20, “than” should read --that--.

COLUMN 43
Line 56, “pushing” should read --pusher--.
Line 59, “pushing” should read --pusher--.

COLUMN 55
Line 50, “guide 18b,” should read --guide 18b--.

COLUMN 58
Line 45, “being the” should read --being--.
Line 61, “portion 40a” should read --portion 40a2--.

UNITED STATES PATENT AND TRADEMARK OFFICE

CERTIFICATE OF CORRECTION

PATENT NO. : 7,006,776 B2
APPLICATION NO. : 10/098419
DATED : February 28, 2006
INVENTOR(S) : Kenji Matsuzaka et al.

It is certified that error appears in the above-identified patent and that said Letters Patent is hereby corrected as shown below:

COLUMN 60
Line 57, “according to” (second occurrence) should be deleted.
Line 59, “according to” (second occurrence) should be deleted.

COLUMN 64
Line 29, “mounted;” should read --mounted; and--.

COLUMN 65
Line 2, “plate;” should read --plate; and--.

COLUMN 66
Line 14, “electrophotgraphic” should read --electrophotographic--.

COLUMN 68
Line 16, “said the” should read --said--.

Signed and Sealed this

Twenty-second Day of July, 2008

JON W. DUDAS
*Director of the United States Patent and Trademark Office*